US006169777B1

(12) United States Patent
Yoshizawa et al.

(10) Patent No.: US 6,169,777 B1
(45) Date of Patent: Jan. 2, 2001

(54) FUEL TRANSPORT CONTAINER AND METHOD OF TRANSPORTING A FUEL ASSEMBLY

(75) Inventors: Hiroyasu Yoshizawa, Ohmiya; Tamotsu Ozawa, Chigasaki, both of (JP)

(73) Assignee: Kabushiki Kaisha Toshiba, Kawasaki (JP)

( * ) Notice: Under 35 U.S.C. 154(b), the term of this patent shall be extended for 0 days.

(21) Appl. No.: 09/107,990

(22) Filed: Jul. 1, 1998

(30) Foreign Application Priority Data

Jul. 4, 1997 (JP) ..... 9-180128
Mar. 12, 1998 (JP) ..... 10-061639

(51) Int. Cl.[7] ..... G21C 19/06
(52) U.S. Cl. ..... 376/272; 376/261
(58) Field of Search ..... 250/506.1, 507.1, 250/518.1; 376/272, 260–261; 220/524, 504, 6, 7

(56) References Cited

U.S. PATENT DOCUMENTS

| | | | | |
|---|---|---|---|---|
| 4,232,730 | * | 11/1980 | Reese | 250/506.1 |
| 4,636,351 | * | 1/1987 | Rohr | 376/272 |
| 5,035,342 | * | 7/1991 | Houghton | 220/23.2 |
| 5,263,063 | * | 11/1993 | Sappey | 376/261 |
| 5,263,064 | * | 11/1993 | Sappey | 376/261 |
| 5,481,117 | | 1/1996 | Gilmore et al. | 376/272 |
| 5,490,186 | * | 2/1996 | Gilmore et al. | 376/272 |
| 5,515,405 | * | 5/1996 | Gilmore et al. | 376/272 |

FOREIGN PATENT DOCUMENTS

| | | | |
|---|---|---|---|
| 835 600 | | 2/1970 | (CA) . |
| 0 128 236 | | 12/1984 | (EP) . |
| 0 506 512 | | 9/1992 | (EP) . |
| 62-12899 | | 1/1987 | (JP) . |
| 2-222866 | | 9/1990 | (JP) . |
| 409113687A | * | 5/1997 | (JP) . |
| 410268081A | * | 10/1998 | (JP) . |
| 411002693A | * | 1/1999 | (JP) . |
| 411052092A | * | 2/1999 | (JP) . |

OTHER PUBLICATIONS

Patent Abstracts fo Japan, vol. 096, No. 004, Apr. 30, 1996 JP 07 330160, Dec. 19, 1995.

* cited by examiner

*Primary Examiner*—Michael J. Carone
*Assistant Examiner*—Fredrick T. French, III
(74) *Attorney, Agent, or Firm*—Oblon, Spivak, McClelland, Maier & Neustadt, P.C.

(57) ABSTRACT

In a fuel transport container, basket has a basket hole including at least two adjacent inner side walls to be fit to a fuel assembly for housing the fuel assembly element in the basket hole. The fuel assembly element is directly housed in the basket hole of the basket. The fuel assembly housed in the basket hole is slid by bias means toward the two adjacent inner side walls thereof without pushing the fuel assembly thereby biasing the housed fuel assembly so that the fuel assembly element is in contact with the two adjacent inner side walls of the basket hole.

8 Claims, 27 Drawing Sheets

(A)

(B)

(B)

(A)

(B)

(A)

FUEL TRANSPORT CONTAINER AND METHOD OF TRANSPORTING A FUEL ASSEMBLY

BACKGROUND OF THE INVENTION

1. Field of the Invention

The present invention relates to a fuel transport container to transport a reactor fuel while housing a reactor fuel (fuel assembly) and a method of transporting the fuel assembly.

In particular, the present invention relates to a transport container having a compact size and a large capacity, which is able to simultaneously transport a great many of light water reactor fuels, such as mixed-oxide fuel assemblies and a method of transporting the great many light water reactor fuels.

2. Description of the Prior Art

In a light water reactor such as a boiling water reactor, a pressurized water reactor or the like, a mixed-oxide fuel assembly (hereinafter, referred to simply as MOX fuel assembly), which mixes a plutonium oxide ($PuO_2$) and an uranium oxide ($UO_2$), is used as a reactor fuel. The MOX fuel assembly is made in a fuel processing facility, and thereafter, is protected while being housed in a fuel protective container. Then, the fuel protective container is transported while being mounted into a fuel transport container.

In the case of transporting a light water reactor fuel assembly such as MOX fuel assembly, when a vibration is applied to the light water reactor fuel assembly, an abrasion is caused in a metallic contact portion of the light water reactor fuel assembly. This is undesirable to maintain economy and reliability of the light water reactor fuel assembly. On the other hand, a spent fuel assembly has no problem with abrasion caused during transport. Therefore, no special vibration preventive measures is taken with respect the spent fuel assembly. Thus, because the spent fuel assembly does not require special vibration preventive measures, there has been developed a fuel transport container which has a compact size and large capacity with a simple structure and can house a great many spent fuel assemblies.

On the contrary, in the case of transporting a new fuel assembly such as MOX fuel assembly, the MOX fuel assembly is used as a reactor fuel after transport. For this reason, vibration preventive measures must be taken during transport for safety and reliability. More specifically, the new fuel assembly or a fuel protective container housing the new fuel assembly is housed in a basket of a fuel transport container, and thereafter, there is a need of fixedly supporting the new fuel assembly to the basket, for example, by a fixedly supporting device. In this case, a ratio of a space occupied by the fixedly supporting device becomes large in the basket. This is a factor hindering the development of fuel transport containers which have a large capacity and a compact size and can collectively and simultaneously house a great many new fuel assemblies. For this reason, a transport container equivalent to the transport container for the spent fuel assembly, that is, a compact-size and large-capacity transport container for the new fuel assembly, such as the MOX fuel assembly, has not been developed.

In the case of transporting the MOX new fuel assembly, it is extremely well known to use a protective container or an internal container having a relatively large rigidity, which is provided with a protective member or a buffer member. That is, it is carried out to house the MOX new fuel assembly in the protective container to transport the protective container housing the MOX new fuel assembly, together. A conventional fuel transport container has the following problems. More specifically, in the case of inserting the MOX new fuel assembly directly into a narrow basket hole of the conventional fuel transport container so as to house the MOX new fuel assembly therein, because there is the possibility of the MOX fuel assembly being wounded by contact upon insertion, an area of the opening of the basket hole is enlarged to some degree.

Moreover, in the case of inserting the MOX new fuel assembly directly into the narrow basket hole, because it is difficult to arrange the MOX fuel assembly to one side in the transport container, that is, a so-called "one-side biased arrangement" is not carried out therein, there is a need of pressing four side surfaces (side walls) of the new fuel assembly by using the fixedly supporting device so that the new fuel assembly can be fixedly supported in the basket hole of the fuel transport container. Thus, in the fuel transport container, a space occupied by the fixedly supporting device becomes large. Therefore, in the entirety of the fuel transport container, a large space is occupied by the fixedly supporting device as compared with the case of using the protective container for housing the new fuel assembly.

In this case, the aforesaid "one-side biased arrangement" is employed to mean the following operation that the fuel assembly vertically inserted into the basket hole of the fuel transport container is moved into contact with two adjacent inner surfaces of the basket hole.

However, since the fuel assembly has a small bending rigidity, in the case of pressing (biasing) and moving the fuel assembly from one side surface or two side surfaces thereof in the basket hole, it is difficult to arrange the fuel assembly in a one-side biased state because there is the possibility that the fuel assembly itself becoming bent.

In the case of pressing the MOX new fuel assembly from four side surfaces thereof so as to fixedly support it in the basket hole of the fuel transport container, one fixedly supporting device is situated under the fuel assembly in a state that the fuel transport container is horizontally placed, that is, an axial direction (longitudinal direction) of the fuel transport container is positioned along a horizontal plane, during the transporting operation of the fuel transport container. Since the fixedly supporting device situated under the fuel assembly must receive the weight of the fuel assembly, there is required a great force for tightly fixing the fuel assembly to the fuel transport container. In order to obtain the tightly fixing great force, the fixedly supporting device must be firmly constructed. This is a factor of making large the fixedly supporting device, and increasing the space occupied by the fixedly supporting device.

If the MOX new fuel assembly is transported while being housed directly in the basket hole of the fuel transport container without housing the fuel assembly in the fuel protective container, it is possible to dispense with a process for housing the fuel assembly in the fuel protective container. Therefore, it is possible to reduce the cost of transporting the fuel transport container.

However, since the fuel assembly has a small bending rigidity and there is a problem relative to the above difficulty of the one-side biasing, the fuel assembly is not transported while being directly housed in the basket hole of the fuel transport container.

On the other hand, in the case where the MOX new fuel assembly is housed in the fuel protective container, and is transported with the use of the fuel transport container, the following problem relative to the difficulty of the one-side biasing is caused.

In the case of housing the MOX new fuel assembly one by one in the fuel protective container, the protective container housing the fuel assembly is relatively light weight; therefore, no problem relative to one-side biasing is caused therein. On the contrary, in order to provide a fuel transport container which is a compact size and has a large capacity, in recent years, there has been proposed a fuel protective container which can house a plurality of fuel assemblies, that is, four fuel assemblies. In this case, the protective container housing the fuel assembly is relatively heavy weight, for this reason, there is a problem that it is difficult to bias the fuel assembly to one side.

In the above transport containers, it has been strongly expected to develop a fuel transport container having a compact size and large capacity. However, in order to develop the aforesaid fuel transport container having a compact size and large capacity, there is a need of solving the following problem. More specifically, in a case where a light water reactor fuel assembly such as MOX new fuel assembly is transported while being directly housed in the basket hole of the fuel transport container, or in the case where the protective container housing the fuel assembly is transported while being housed in the basket hole thereof, the fuel assembly or the fuel protective container must be biased to one side in the basket hole.

Furthermore, in order to develop the aforesaid fuel transport container having a compact size and large capacity, it requires development of a fixedly supporting method which can obtain the optimum fixedly supporting effects with a small fastening force (fixedly supporting force) obtained by a small-size fixedly supporting device. However, such fixedly supporting method capable of obtaining the optimum supporting effects with the small fastening force has not been realized yet.

Moreover, since the MOX fuel assembly of light water reactor fuel assembly is exothermic, when an internal temperature of the fuel transport container rises, there is caused an elongation difference resulting from a difference in thermal expansion between the MOX fuel assembly and the basket hole. In a case where the MOX fuel assembly is fixedly supported directly by a fuel spacer and a transport spacer, a displacement is caused in position between components of the MOX fuel assembly due to elongation differences resulting from thermal expansion. For this reason, it is strongly desirous to provide a fixedly supporting method which can solve the problem of the positional displacement resulting from thermal expansion. However, in the fuel transport container directly housing the MOX fuel assembly in the basket hole, it is difficult to solve the aforesaid problems with the use of usual fuel transport containers.

SUMMARY OF THE INVENTION

The present invention is directed to overcoming the foregoing problems.

Accordingly, it is one object of the present invention to provide a fuel transport container having a compact size and a large capacity and to provide a method of transporting a fuel assembly, which are capable of stably housing in a basket hole a fuel assembly such as MOX fuel assembly directly or a fuel protective container to improve safety and reliability of transporting the fuel assembly.

Further, another object of the present invention is to provide a fuel transport container and method of transporting a fuel assembly, which are capable of directly housing the fuel assembly in a basket hole or housing a fuel protective container including the fuel assembly while the fuel assembly or the fuel protective container is biased toward one side, effectively and sufficiently exhibiting a fixedly supporting effect by a small fastening force, solving a problem resulting from a difference in thermal expansion, and collectively and simultaneously transporting a plurality of reactor fuel assemblies.

Furthermore, a further object of the present invention is to provide a fuel transport container, which can simultaneously and safely transport a plurality of fuel assemblies, while reducing a transport cost of the fuel assemblies.

To achieve such objects, according to one aspect of the present invention, there is provided a fuel transport container having a fuel assembly element for transporting the fuel assembly element, the fuel transport container comprising basket having a basket hole including at least two adjacent inner side walls to be fit to the fuel assembly element for housing the fuel assembly element in the basket hole; and bias means for sliding the fuel assembly element housed in the basket hole toward the two adjacent inner side walls thereof without pushing the fuel assembly thereby biasing the housed fuel assembly element so that the fuel assembly element is in contact with the two adjacent inner side walls of the basket hole.

In the preferred embodiment of this aspect, the fuel assembly element is a fuel assembly having four side surfaces including the two adjacent side surfaces, said fuel assembly being directly housed in the basket hole so that the two adjacent side surfaces of the fuel assembly are opposite to the two adjacent inner side walls, said basket hole has four inner side walls including the two adjacent inner side walls, and providing a substantially square shape in its lateral cross section, and wherein said fuel assembly is biased to the two adjacent inner side walls so that the two adjacent side surfaces thereof contact with the two adjacent inner side walls of the basket hole, respectively.

This aspect of the present invention further comprises fixedly supporting means for pushing the other two side surfaces of the fuel assembly biased to the two adjacent inner side walls of the basket hole so as to fixedly fit a corner portion formed by the two adjacent side surfaces of the fuel assembly to an inner corner portion formed by the two adjacent inner side walls of the basket hole thereby fixedly supporting the biased fuel assembly to the basket hole.

In the preferred embodiment of this aspect, the bias means has means, when the fuel transport container is arranged such that a center axis of the fuel transport container is orthogonal to a horizontal plane, for keeping the basket inclined along a line connecting the inner corner portion and the center axis of the fuel transport container so that a center axis of the basket hole is inclined toward the inner corner portion thereof with respect to the center axis of the fuel transport container.

In the preferred embodiment of this aspect, the keeping means has a receiving base mounted to a bottom surface of the basket hole and has a receiving portion mounted onto the receiving base so as to be biased toward the inner corner portion of the basket hole, said receiving portion being arranged such that a lower end portion of the biased fuel assembly is supported to the receiving portion, and has a guide portion formed on the receiving portion so as to guide the lower end portion of the fuel assembly housed in the basket hole to the receiving portion.

This aspect of the present invention has an arrangement such that, when the fuel transport container is arranged such that the center axis of the fuel transport container is parallel to the horizontal plane in order to transport the fuel transport container, one of the two adjacent inner side walls of the basket hole is inclined at a predetermined angle with respect to the horizontal plane, said inner corner portion formed by the two adjacent inner side walls are positioned to a lower side of the fuel assembly and is formed as a substantially V shape so that the biased fuel assembly is supported by the lower side inner corner portion of the basket hole, and wherein said fixedly supporting means are attached to the other two adjacent inner side walls of the basket hole so as to push the other two side surfaces of the biased fuel assembly toward the two lower side inner side walls, respectively, thereby fastening the fuel assembly to the lower side inner corner portion of the basket hole and fixedly supporting the fuel assembly thereto.

This aspect of the present invention has an arrangements such that, when the fuel transport container is arranged such that a center axis of the fuel transport container is orthogonal to a horizontal plane, the bias means is arranged at a lower side of the basket and adapted to support a lower end portion of the fuel assembly element housed in the basket hole.

In the preferred embodiment of this aspect, the bias means has a supporting unit for supporting the lower end portion of the fuel assembly element housed in the basket hole and a drive device operatively connected to the supporting unit for moving the supporting unit along a direction orthogonal to a center axis of the basket hole so as to contact the fuel assembly element with the two adjacent inner side walls of the basket hole.

In the preferred embodiment of this aspect, the supporting unit includes a receiving base for supporting the lower end portion of the fuel assembly element housed in the basket hole and a floating device operatively connected to the receiving base for floating the receiving base by using a pressurized gas.

This aspect of the present invention has an arrangement that the basket has a basket main body having plurality of basket holes and a basket bottom plate fixed to a bottom portion of the basket main body, said supporting unit has a housing space formed between the basket main body and the basket bottom plate and a receiving base housed in the housing space for supporting the lower end portions of plurality of fuel assembly elements housed in the plurality of basket holes, respectively, and wherein said drive device is operatively connected to the receiving base for sliding the receiving base along the direction orthogonal to the center axis of the plurality of basket holes so as to move simultaneously all of the plurality of fuel assembly elements thereby contacting the fuel assembly elements with the two adjacent inner side walls of the plurality of basket holes, respectively.

For achieving such objects, according to another aspect of the invention, there is provided a fuel transport container having a fuel assembly container for transporting the fuel assembly, the fuel transport container comprising fuel protective container housing the fuel assembly; and a basket having a basket hole including at least two adjacent inner side walls to be fit to the fuel protective container for housing the fuel protective container in the basket hole, when the fuel transport container is arranged such that a center axis of the fuel transport container is parallel to the horizontal plane in order to transport the fuel transport container, wherein said one of the two adjacent inner side walls of the basket hole is inclined at a predetermined angle with respect to the horizontal plane, said two adjacent inner side walls forming an inner corner portion are positioned to a lower side of the fuel assembly so as to be formed as a substantially V shape, whereby the fuel protective container is supported by the lower side inner corner portion of the basket hole, and wherein said basket and basket hole are arranged In the fuel transport container so that an outer corner portion of the basket hole opposite to the lower side inner corner portion is inclined with respect to the horizontal plane while a bottom side of the basket hole is directed downward and a top side thereof is directed upward in a center axial direction of the basket hole.

In order to achieve such objects, according to a further aspect of the present invention, there is provided a method of transporting a fuel transport container, in which a basket having a basket hole including at least two adjacent inner side walls to be fit to a fuel assembly element is housed, the method comprising the steps of inserting the fuel assembly element into the basket hole of the basket of the fuel transport container arranged such that a center axis of the fuel transport container is orthogonal to the horizontal plane; sliding the fuel assembly element housed in the basket hole toward the two adjacent inner side walls thereof without pushing the fuel assembly thereby biasing the housed fuel assembly element so that the fuel assembly element is in contact with the two adjacent inner side walls of the basket hole; pushing the other two side surfaces of the fuel assembly element biased to the two adjacent inner side walls of the basket hole so as to fixedly fit a corner portion formed by the two adjacent side surfaces of the fuel assembly element to an inner corner portion formed by the two adjacent inner side walls of the basket hole thereby fixedly supporting the biased fuel assembly element to the basket hole; and transporting the fuel transport container including the biased and fixedly supported fuel assembly element while the fuel transport container is arranged such that the center axis of the fuel transport container is parallel to the horizontal plane.

For achieving such objects, according to a further aspect of the present invention, there is provided a method of transporting a fuel transport container, in which a basket having a basket hole including at least two adjacent inner side walls to be fit to a fuel protective container is housed, the method comprising the steps of: housing a fuel assembly in the fuel protective container; housing the fuel protective container in the basket hole; and transporting the fuel protective container while the fuel transport container is arranged such that a center axis of the fuel transport container is parallel to the horizontal plane in order to transport the fuel transport container, one of the two adjacent inner side walls of the basket hole is inclined at a predetermined angle with respect to the horizontal plane, the two adjacent inner side walls forming an inner corner portion are positioned to a lower side of the fuel assembly so as to be formed as a substantially V shape, whereby the fuel protective container is supported by the lower side inner corner portion of the basket hole, and while the basket and basket hole are arranged in the fuel transport container so that an outer corner portion of the basket hole opposite to the lower side inner corner portion is inclined with respect to the horizontal plane in a state that a bottom side of the basket hole is directed downward and a top side thereof is directed upward in a center axial direction of the basket hole.

As described above, in the fuel transport container and in the method of transporting a fuel assembly, according to the present invention, it is possible to solve the problem relative to one-side biasing of the fuel assembly or the fuel protective container housed in the basket hole of the fuel transport container. Thus, there is provided the fuel transport container which can house a plurality of fuel assemblies and the plurality of fuel assemblies with the use of the compact fuel transport container, so that a reduction of transport cost can be achieved. Further, by directly housing the fuel assembly in the basket hole of the fuel transport container, there is no need of using the fuel protective container. Thus, more fuel assemblies are effectively housed in the fuel transport container, making it possible to provide a fuel transport container which is more compact in size and has a large capacity. Accordingly, it is possible to simultaneously and effectively transport a plurality of fuel assemblies.

Furthermore, according to the transport container, and the method of the present invention, the fuel assembly is directly housed in the basket hole, and the maximum fixedly supporting effect is exhibited by a small fastening force of a small-size fixedly supporting device. In addition, it is possible to solve the problem relative to the difference of thermal expansion. Therefore, it is possible to effectively and stably transport a plurality of assemblies such as MOX fuel assemblies at the same time, so that the transport cost of the plurality of fuel assemblies can be reduced.

Moreover, since the protective container housing the fuel assembly is housed in the basket hole of the basket, this serves to dispense with the fixedly supporting device, and to provide a small-sized and compact fuel transport container. In addition, even if the fuel transport container is made small and compact, a plurality of fuel assemblies are collectively and simultaneously transported, therefore, a transport cost of the plurality of fuel assemblies can be reduced.

BRIEF DESCRIPTION OF THE DRAWINGS

Other objects and aspects of the present invention will become apparent from the following description of embodiments with reference to the accompanying drawings in which.

DESCRIPTION OF THE PREFERRED EMBODIMENTS

The embodiments of the present invention will be described below with reference to the accompanying drawings.

Figure 1:
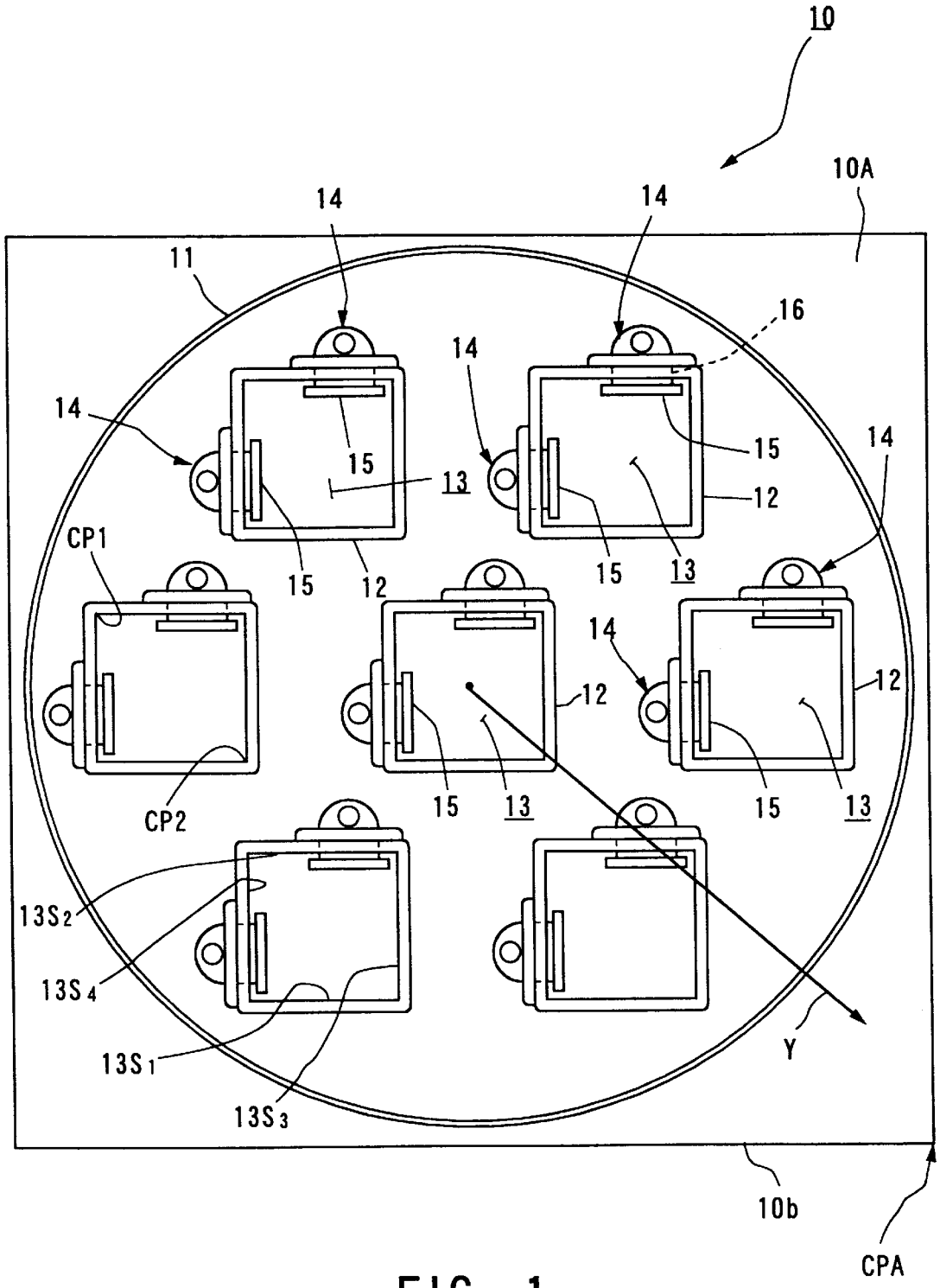
FIG. 1 is a top plan view of a fuel transport container arranged in a vertical arrangement, according to a first embodiment of the present invention.
Figure 2:
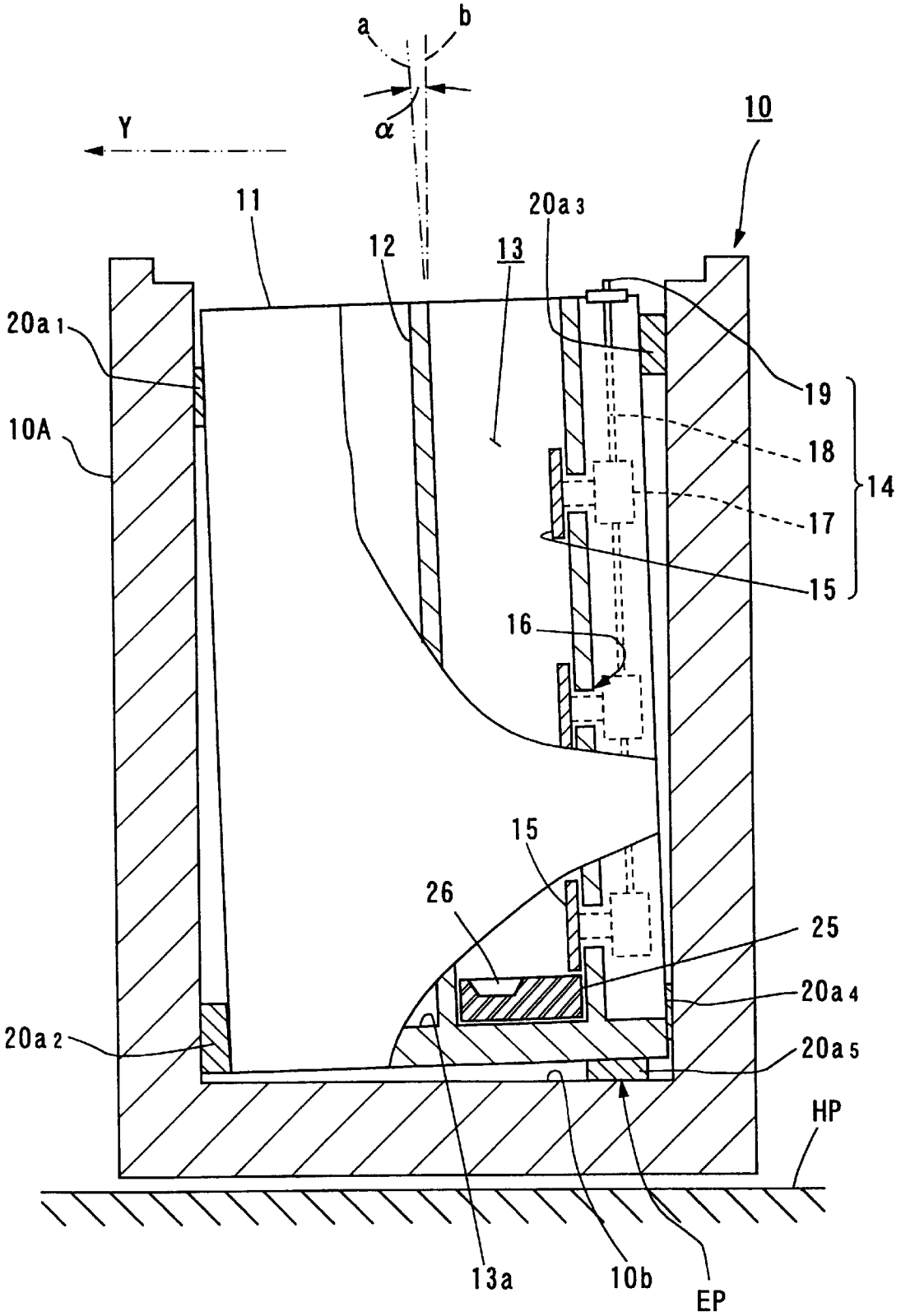
FIG. 2 is a longitudinal sectional view showing a fuel transport container arranged in the vertical arrangement according to the first embodiment of the present invention.

FIG. 1 is a top plan view showing a transport container according to a first embodiment of the present invention. In FIG. 1, a reference numeral 10 denotes a fuel transport container directly housing an MOX fuel assembly as a light water reactor fuel. The fuel transport container 10 is applicable to house a new fuel assembly of a reactor fuel such as UO2 fuel assembly in addition to the MOX fuel assembly. The fuel transport container 10 wholly has a substantially cylindrical shape and a substantially rectangular shape in its lateral cross section. The fuel transport container 10 is vertically arranged (placed) on a horizontal plane HP, as shown in FIG. 2. A longitudinal direction corresponding to an axial direction of the fuel transport container 10 is positioned along a vertical direction orthogonal to the horizontal plane HP when the fuel assembly is housed in the fuel transport container 10. In addition, in the specification, this arrangement of the fuel transport container shown in FIG. 2 is defined as "vertical arrangement".

The fuel transport container 10 is provided with a container main body (outer container) 10A having a substantially cylindrical shape, having a substantially rectangular shape in its lateral cross section and having an inner hollow cylindrical chamber. Moreover, the fuel transport container 10 is provided with a basket 11, which has a cylindrical shaped outline coaxially housed in the inner hollow cylindrical chamber of the container main body 10A, for directly housing a fuel assembly without using a protective container for housing the fuel assembly. The container main body 10A has a standard surface 10*b* and the standard surface 10*b* is adapted to be arranged along the axial direction of the fuel transport container 10 and to be arranged, when the fuel transport container 10 is transported by a transport means, along the horizontal plane HP. In addition, this arrangement of the fuel transport container 10 in that the standard surface 10*b* of the container main body 10 is positioned along the horizontal plane HP is defined as "horizontal arrangement" in the first embodiment to a seventh embodiment of this specification.

The basket 11 of the fuel transport container 10 includes a plurality of basket hole elements 12 each of which is constructed by a rectangular tube or rectangular cylinder. Each of these basket hole elements 12 is formed with a basket hole 13 having a cylindrical and a rectangular shape in its lateral cross section. Each basket holes is adapted to constitute a chamber for housing the fuel assembly.

The basket 11 is constructed in that the plurality of basket hole elements 12 are arranged with a predetermined intervals and combined integrally by a joining member (not shown) so that the basket 11 is formed as the substantially cylindrical shaped outline.

To take one example of many, FIG. 2 is a longitudinal sectional view showing the fuel transport container 10 housing the basket 11 which has four basket holes 13 arranged symmetrically with respect to a center. Each of the basket holes 13 has a bottom surface 13*a*, a top surface opposite to the bottom surface 13*a*, which is opening, and four inner side walls 13*s*1~13*s*4 constituting the chamber for housing the fuel assembly. As shown in FIGS. 1 and 2, the basket 11 is mounted in the container main body 10A such that one pair of side walls 13*s*1, 13*s*2, which are opposite each other, are parallel to the standard surface 10*b* of the container main body 10*b*.

The fuel assembly is housed in the basket hole 13, and thereafter, the housed fuel assembly is fastened so as to be fixedly supported by means of a fixedly supporting device 14.

The fixedly supporting device 14 is provided with a plurality of mounting holes 16 mounted to the inner side wall 13*s*2 and one side wall (for example, inner side wall 13*s*4) of the inner side walls 13*s*3, 13*s*4 adjacent to the inner side wall 13*s*2 along the axial direction of the basket hole 13. The inner side wall 13*s*2 is far from the standard surface 13*s*1 as compared with the inner side wall 13*s*1. The mounting holes 16 are provided at a predetermined interval along the longitudinal direction of the basket hole 13 so that the fastening plates 15 mounted in the mounting holes 16 are also provided at the predetermined interval therealong.

The respective fastening plates 15 are mounted in the respective mounting holes 16 so that the fastening plates 15 mounted therein are also provided at the predetermined interval therealong. The respective fastening plates 15 are capable of moving close to the housed fuel assembly and far therefrom. In this case, a fastening direction by the fixedly supporting device 14 provided on each basket hole element 12 (basket hole 13) is two directions common to all basket holes 13, that is, a downward direction and a right direction on FIG. 1. That is, the housed fuel assembly is fastened by the respective fastening plates 15 toward the inner side walls 13*s*1 and 13*s*3.

Further, the fixedly supporting device 14 includes a drive mechanism 17 which supports each of the fastening plates 15 for moving close to the housed fuel assembly and far therefrom in each of the basket holes 13, a rotating shaft 18 for rotatably driving the drive mechanism 17, and a fastening control shaft 19 for rotatably driving the rotating shaft 18. By rotatably driving the fastening control shaft 19, a rotation is transmitted to the drive mechanism 17 via the rotating shaft 18 so that the fastening plate 15 moves close to the housed fuel assembly and far therefrom.

The fuel transport container 10 is arranged in the vertical arrangement when mounting the fuel assembly into the fuel transport container 10. As shown in FIG. 2, when mounting the fuel assembly thereinto, the basket 11 is arranged in the container main body 10A such that a basket axial line "a" longitudinally extending is inclined by an angle of α° with respect to a vertical axis "b" corresponding to the axial direction of the container main body 10A. In a case of the basket 11 shown in FIG. 1, the top portion of the basket 11 is inclined to a diagonal direction of the two fastening directions by the fixedly supporting devices 14, as shown by an arrow Y (see FIG. 1). That is, the basket 11 is inclined toward a corner portion CPA of the container main body 10A, which is adjacent to a corner portion CP2 formed by the inner side walls 13*s*1, 13*s*3, as compared with a corner portion CP1 formed by the inner side walls 13*s*2, 13*s*4 along a line connecting the corner portion CP2 and the corner portion CP1 (the center axis of the fuel transport container 10).

As shown in FIG. 2, the basket 11 is provided with inclining and fixing elements 20, such as five inclining and fixing spacers 20*a*1~20*a*5, for keeping the basket 11 inclining toward the corner portion CPA. First and second inclining and fixing spacers 20*a*1, 20*a*2 are attached at one upper and lower portions of the cylindrical side surface of the basket 11 along the diagonal direction shown by the arrow Y, respectively. Third and fourth inclining and fixing spacers 20*a*3, 20*a*4 are attached at other upper and lower portions, which are opposite the one upper and lower portions, of the cylindrical side surface of the basket 11 along the diagonal direction shown by the arrow Y, respectively. Moreover, fifth inclining and fixing spacer 20*a*5 having a top inclined surface is detachably mounted onto a corner portion CP2 side end portion EP of a bottom inner surface 10*b* of the container main body 10A along the diagonal direction.

The first and second inclining and fixing spacers 20*a*1, 20*a*2 are operatively connected to a first handle unit (not shown) mounted to the basket 11 so that the first and second inclining and fixing spacers 20*a*1, 20*a*2 are adapted to move along the diagonal direction, individually, by a rotation of the first handle unit. Similarly, the third and fourth inclining and fixing spacers 20*a*3, 20*a*4 are operatively connected to a second handle unit (not shown) mounted to the basket 11 so that the third and fourth inclining and fixing spacers 20*a*3, 20*a*4 are adapted to move along the diagonal direction, individually, by a rotation of the second handle unit.

When mounting the fuel assembly into the fuel transport container 10, the container main body 10A of the fuel transport container 10 is placed while being vertical to the horizontal plane HP. At that time, the fifth spacer 20*a*5 is mounted onto the corner portion side end portion EP of the bottom inner surface 10*b* of the container main body 10A along the diagonal direction and, after that, the basket 11 is mounted onto the bottom inner surface 10*b* and the fifth spacer 20*a*5 so that an end portion of a bottom outer surface of the basket 11, which is opposite to the top inclined surface of the fifth inclining and fixing spacer 20*a*5, is fitted to the top inclined surface of the fifth inclining and fixing spacer 20*a*5 thereby being inclined by the angle of α° with respect to the inner bottom surface 10*b*. That is, the vertical axis "a" of the basket 11 is inclined by the angle of α° with respect to the vertical axis "b" which is orthogonal to the horizontal plane HP corresponding to a center axis of the container main body 10A toward the corner portion CPA of the container main body 10A.

Then, the first handle unit is rotated so that the first and second inclining and fixing spacers 20*a*1, 20*a*2 individually project from the basket 11 toward an inner cylindrical side surface of the container main body 10A whereby the first and second inclining and fixing spacers 20*a*1, 20*a*2 are in contact with the inner cylindrical side surface thereof. At the same time, the second handle unit is rotated so that the third and fourth inclining and fixing spacers individually project from the basket 11 toward the inner cylindrical side surface of the container main body 10A whereby the first and second inclining and fixing spacers 20*a*1, 20*a*2 are in contact with the inner cylindrical side surface thereof. Each of projecting length of the first, second, third and fourth inclining and fixing spacers is different each other according to the mounted positions thereof. In this embodiment, the projecting length of the second inclining and fixing spacer 20*a*2 is longer than the projecting length of the first inclining and fixing spacer 20*a*1 and the projecting length of the third inclining and fixing spacer 20*a*3 is longer than the projecting length of the fourth inclining and fixing spacer 20*a*4.

As a result of that, the inclining and fixing spacers 20*a*1, 20*a*2, 20*a*3 and 20*a*4 push out against the inner cylindrical side surface of the container main body 10A, respectively, so that the basket 11 is fixed to the container main body 10A while being inclined by the angle of α° with respect to the vertical axis "b" toward the corner portion CPA of the container main body 10A, as shown by the arrow Y of FIG. 1 wherein the indicating direction of the arrow Y is referred as "an inclining direction".

On the other hand, the basket 11 is provided with a fuel assembly receiving base with a one-side biasing function onto the bottom surface 13*a* of the basket hole 13. The fuel assembly receiving base 25 is formed with a fuel assembly receiving portion 26 having a substantially concave shape, which is biased toward one-side direction, that is, the inclining direction Y with respect to a center axis of the basket hole 13, in order to maintain the aforesaid one-side biasing function. The fuel assembly receiving portion 26 is located at a position where the fuel assembly is biased to one side by fastening of the fixedly supporting device 14.

As shown in FIG. 3(A) and FIG. 3(B), the fuel assembly receiving base 25 with one-side biasing function is provided with a fuel assembly receiving portion 26 at a position shifted toward the lower left side (inclining direction Y side) from the center axis of the basket hole 13. The fuel assembly receiving portion 26 includes a conical portion 27 having a tapered or cone shape at an upper portion thereof which is tapered from the upper portion toward a lower portion of the receiving portion 26. The conical portion 27 is adapted to serve as a fuel assembly one-side biasing guide. The fuel assembly receiving portion 26 also includes a fuel assembly receiving concave portion 28 extending from the cone-like portion 27, and a Y shaped guide groove 29 which is formed on the bottom portion of the receiving concave portion 28.

Figure 4:
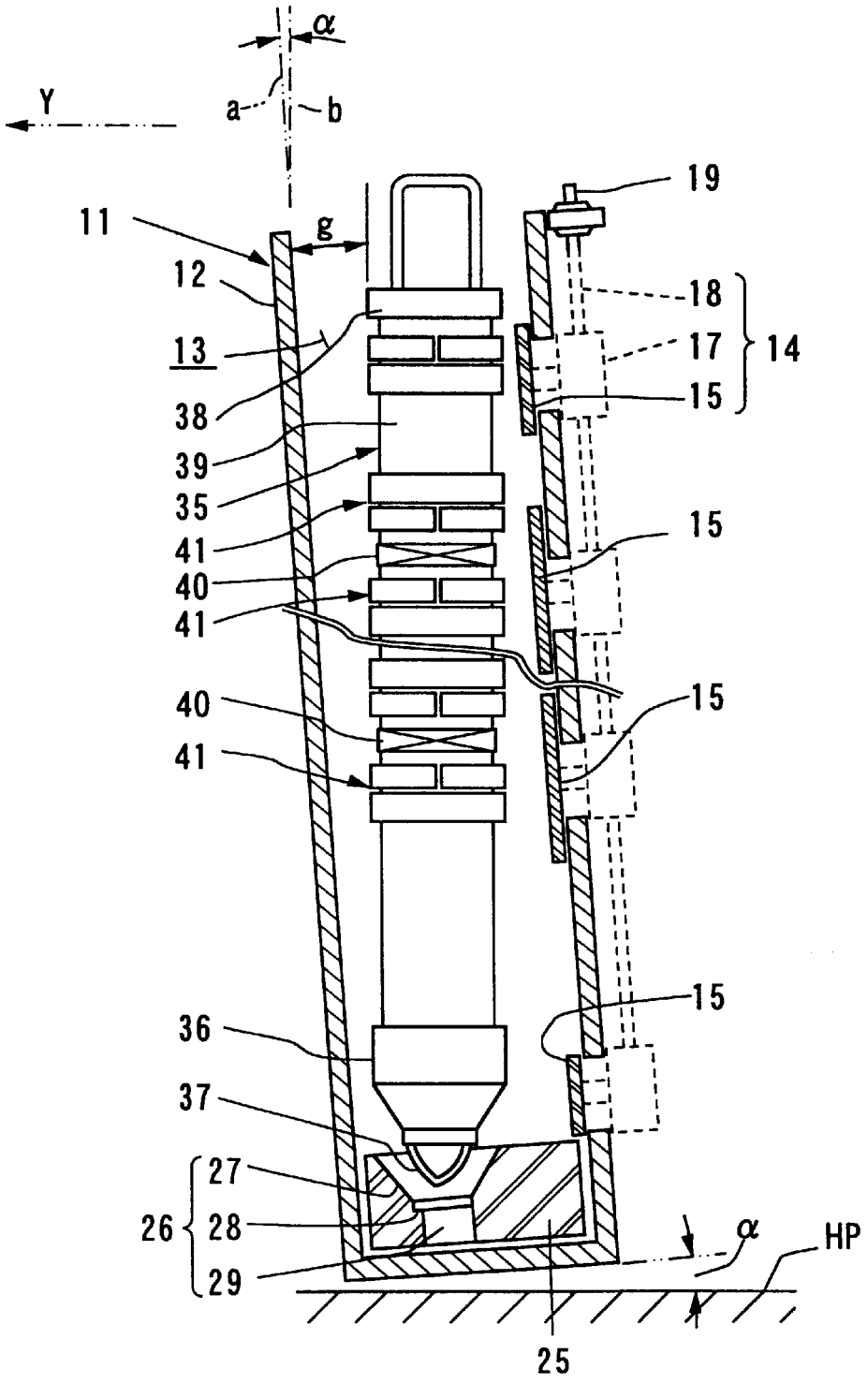
FIG. 4 is a partially longitudinal sectional view showing the fuel transport container arranged in the vertical arrangement, in which a fuel assembly is housed, according to the first embodiment.
Figure 5:
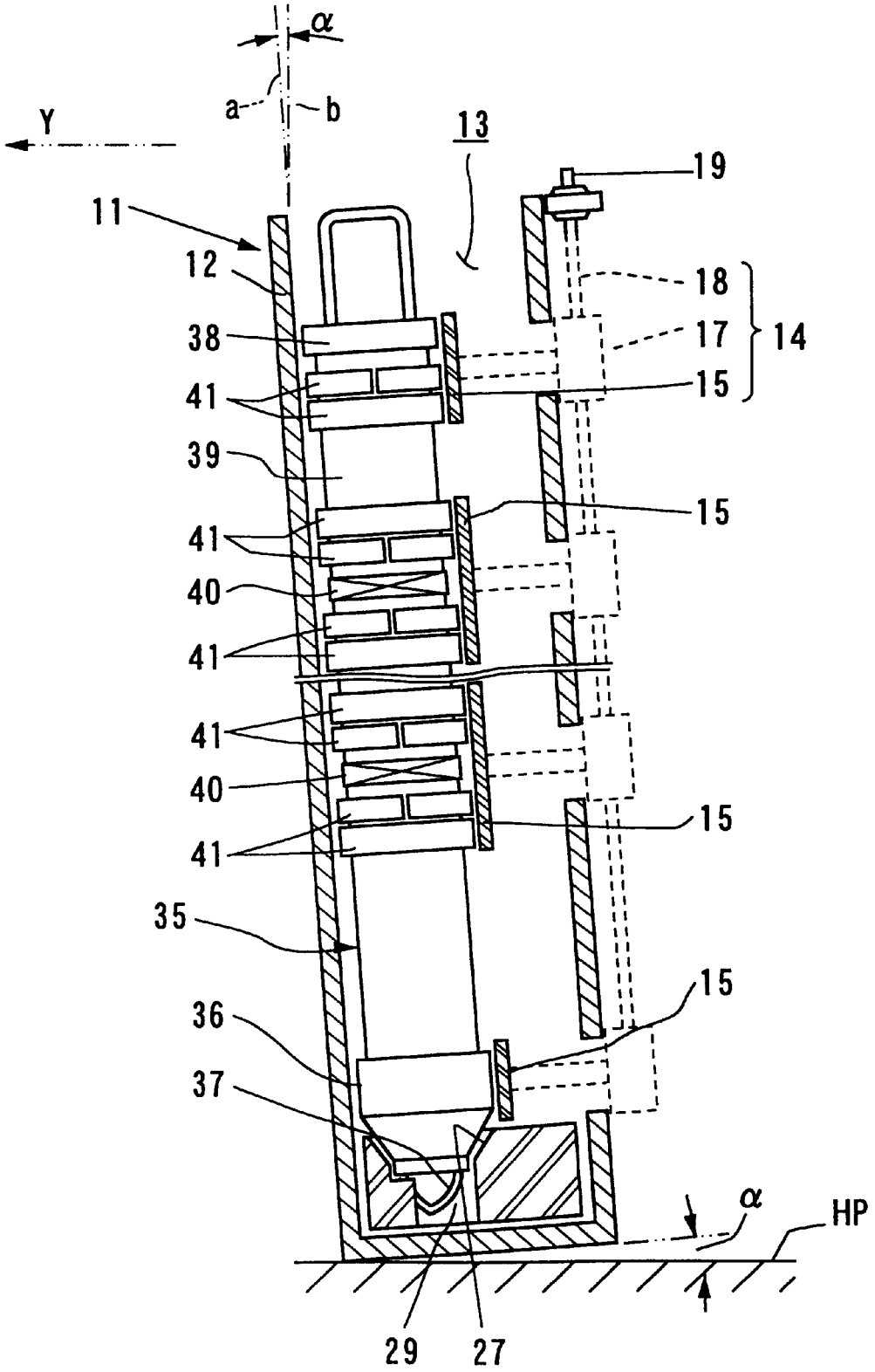
FIG. 5 is a partially longitudinal sectional view showing the fuel transport container arranged in the vertical arrangement, in which the fuel assembly is housed, for explaining a method of transporting the fuel transport container according to the first embodiment.

To give an example of a light water reactor fuel, a MOX fuel assembly 35 of a boiling water reactor (BWR) is constructed as shown in FIG. 4 and FIG. 5. A lower tie-plate 36 of the fuel assembly 35 is formed with a Y shaped protrusion 37 at the distal end thereof. The Y shaped protrusion 37 is adapted to be guided and received in the guide groove 29 of the fuel assembly receiving portion 26.

The fuel assembly 35 is provided with an upper tie-plate 38 at an upper portion thereof. Fuel rods 39 are fixedly supported and held by means of the upper tie-plate 38 and the lower tie-plate 36. A plurality of fuel spacers 40 are interposed between fuel rods 39 at regular intervals. Further, a transport separator 41 is removably provided on the upper and lower portions of the fuel spacers 40 so as to protect these fuel spacers 40 or the like.

When inserting the MOX fuel assembly 35 into the basket hole 13 of the basket hole element 12 to hold it in the basket 11, the Y shaped protrusion 37 at the distal end of the lower tie-plate 36 of the fuel assembly 35 is guided and received onto the guide groove 29 from the conical portion 27 functioning as the fuel assembly one-side biasing guide of the fuel assembly receiving portion 26. Thus, in the bottom portion of the basket hole 13, the fuel assembly 35 is placed on the fuel assembly receiving portion 26 which is biased according to the inclination of the basket 11 toward the lower left side, that is, the inclining direction Y side, from the center axis of the basket hole 13 in FIG. 3(A).

Next, a method of transporting the fuel assembly will be described hereinafter with reference to FIG. 4 and FIG. 5.

The method of transporting the fuel assembly 35, at least, comprises steps of: mounting the MOX fuel assembly 35 in the fuel transport container 10 while the fuel transport container 10 is arranged in the vertical arrangement; and transporting the fuel transport container 10 from fuel processing facilities to an atomic power plant or other storage facilities, or transporting it from these storage facilities to the atomic power plant or other storage facilities while the fuel transport container 10 is arranged in the horizontal arrangement.

Figure 3:
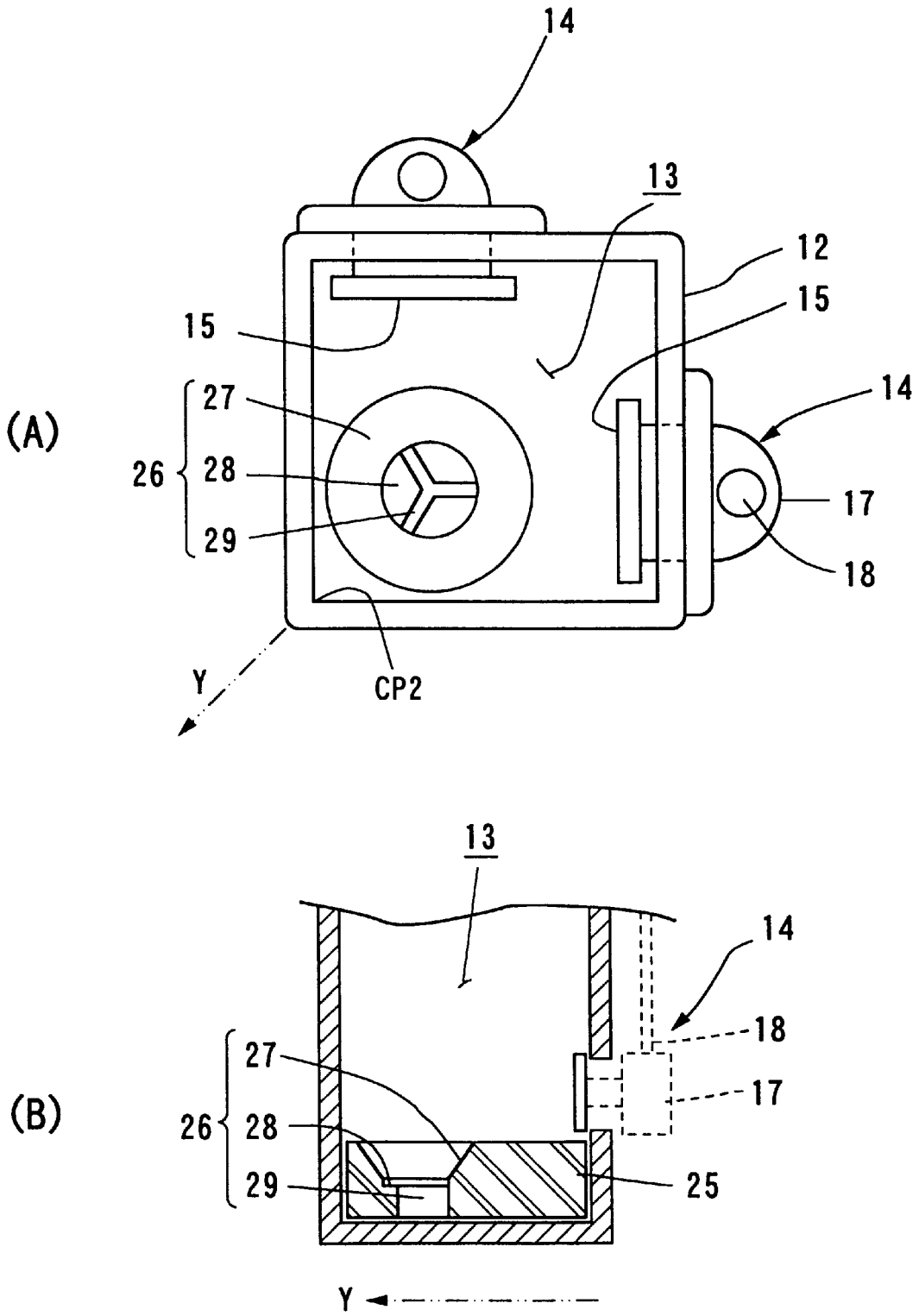
FIG. 3(A) is an enlarged top plan view showing a basket hole of the fuel transport container arranged in the vertical arrangement according to the first embodiment.
FIG. 3(B) is an enlarged longitudinal sectional view showing a bottom side of the basket hole of the fuel transport container shown in FIG. 3(A)

FIG. 4 and FIG. 5 are views to explain a mounting process for mounting the MOX fuel assembly 35 of a light water reactor fuel in the fuel transport container 10. The fuel transport container 10 used in this case is the same as shown in FIG. 1 to FIG. 3. When mounting the fuel assembly 35 into the fuel transport container 10, the fuel assembly 35 connected a hoisting accessory (not shown) of, for example, a crane (not shown) is hoisted down by a drive of the crane so as to be vertically mounted in the container main body 10A while the vertical axial line "a" of the basket 11 is inclined by the angle of $\alpha°$ with respect to the vertical axis "b".

At the bottom portion of each of the basket hole element 12 of the basket 11, the fuel assembly receiving base 25 having one-side biasing function is mounted. As shown in FIG. 4, the basket hole element 12 of the basket 11 is located while being inclined by the angle of $\alpha°$ with respect to the vertical axis "b" and then, the MOX fuel assembly 35 is hoisted and taken down vertically so as to be inserted in the basket hole 13 of the basket hole element 12.

As shown in FIG. 4, the inclination angle of the $\alpha°$ of the basket 11 to the vertical axis "b" is determined on the basis of a necessary gap "g" between the fuel assembly 35 and the corner portion CP2 formed by the inner side wall 13*s*1 and the inner side wall 13*s*3 of the basket hole 13 and an entire length of the basket hole element 12. In general, the angle of $\alpha°$ is a very small angle of 1° or less.

The fuel assembly 35 is taken down and inserted vertically into the inclined basket hole 13. Then, when the Y shaped protrusion 37 at the distal end of the lower tie-plate 36 reaches the fuel assembly receiving base 25, the lower tie-plate 36 is guided to the conical portion 27, and is moved to a position to be biased to the one side (the inclining direction Y side) so that the Y shaped protrusion 37 of the lower tie-plate 36 is inserted through the receiving concave portion 28 into the Y shaped guide groove 29 of the fuel assembly receiving portion 26 thereby being supported by the receiving portion 26.

Figure 6:
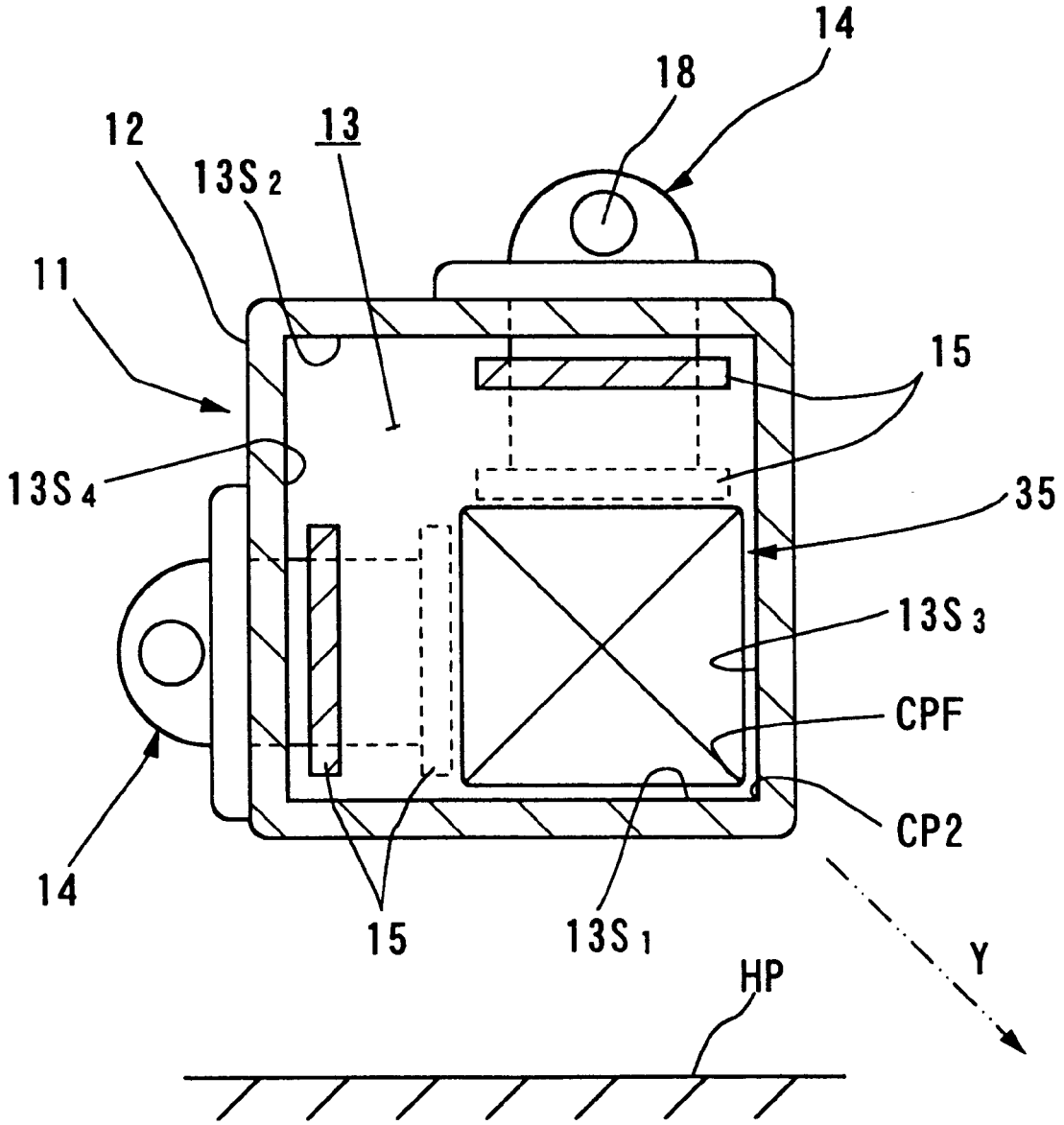
FIG. 6 is a lateral sectional view showing the fuel transport container which is arranged in a horizontal arrangement and houses the fuel assembly for explaining the method of transporting the fuel transport container according to the first embodiment.

The lower tie-plate 36 of the fuel assembly 35 is supported on the biased fuel assembly receiving portion 26 of the fuel assembly receiving base 25. After that, when the hoisting accessory is removed therefrom, the fuel assembly 35 leans on inner side walls 13*s*1 and 13*s*3 of the basket hole element 12 because the inner walls 13*s*1 and 13*s*3 of the basket hole element 12, that is, the basket hole 13 and the fuel assembly receiving portion 26 are inclined so that, as shown in FIG. 6, a corner portion CPF of the fuel assembly 35, which is opposite to the corner portion CP2 formed by the inner side walls 13*s*1 and 13*s*3, is in contact with the corner portion CP2. Namely, the fuel assembly 35 is inserted into the basket hole 13 of the basket hole element 12 while automatically and smoothly being biased to the one side (the inclining direction Y side).

After the fuel assemblies 35 are inserted into the respective basket holes 13 of the basket 11, respectively, as shown in FIG. 5, the fixedly supporting device 14 is operated so as to move the fastening plates 15 close to the inserted fuel assembly 35. By moving the fastening plates 15 close thereto, the fuel assembly 35 is pressed and fastened by these fastening plates 15 so that the corner portion CPF of the fuel assembly 35 is fixedly fitted to the corner portion CP2 of the basket hole 13. As a result of that, the fuel assembly 35 is fixedly supported to the basket hole 13. After that, an upper portion of the basket 11 and the fuel transport container 10 is covered by a cap member and the cap member is fixed to the fuel transport container 10, and thus, the mounting process of the fuel assembly 35 is completed In a transport process, as shown FIG. 6, the MOX fuel assembly 35 is transported while being housed in the basket hole 13. More specifically, the fuel assembly 35 is transported while being biased to the one side (the inclining direction Y side) in the basket hole 13 in a manner that one of two inner side surfaces 13*s*1, 13*s*3 of the basket hole 13 contacting with the fuel assembly 35 is situated under the fuel assembly 35. That is, the fuel assembly 35 is transported together with the fuel transport container 10 while the fuel transport container is arranged in the horizontal arrangement.

In the fuel transport container 10, as described in FIG. 1, the fuel assembly 35 is pressed and fastened to two directions common to all basket holes 13 so as to be biased to the one side (the inclining direction Y side). Therefore, in the fuel transport container 10, by housing the basket 11 in the container main body 10A, a fuel assembly transport mode as shown in FIG. 6 is commonly obtained in all basket holes 13.

In the fuel transport container 10 shown in FIG. 1 to FIG. 6, the basket 11 is housed in the container main body 10A in a state of being inclined, and thereby, the fuel assembly 35 can be simply and readily housed in the basket hole 13 while being biased to the one side (the inclining direction Y side). Therefore, the fuel assembly 35 can be stably housed and fixedly supported in the basket hole 13.

Figure 7:
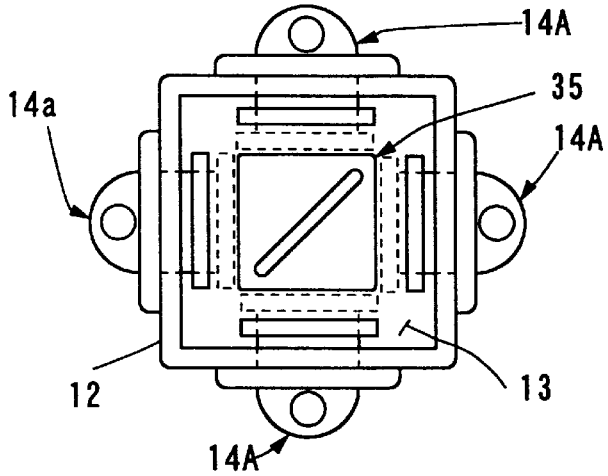
FIG. 7(A) is a top plan view showing an usual fuel transport container arranged in a vertical arrangement, in which a fuel assembly is housed.
FIG. 7(B) is a partially longitudinal sectional view showing the usual fuel transport container shown in FIG. 7(A)
Figure 7:
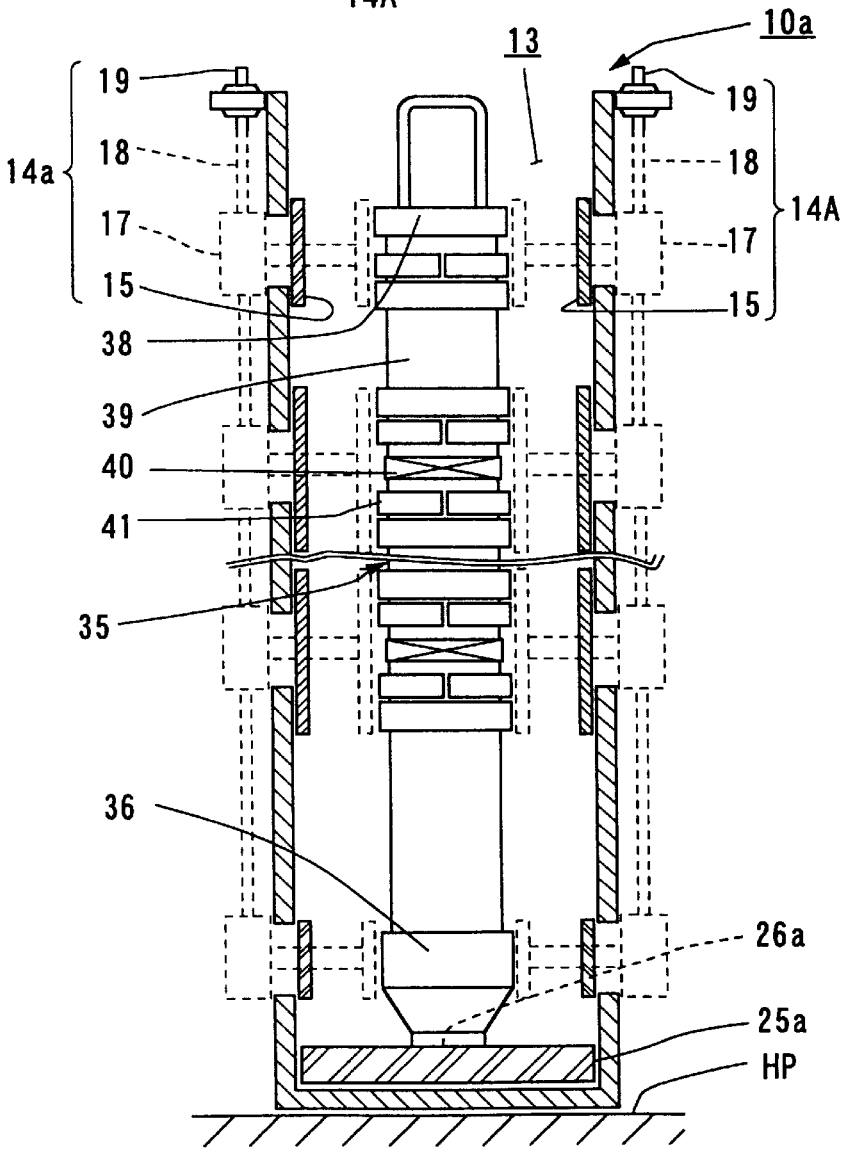

In a case where it is impossible to perform the one-side biasing of the fuel assembly 35 in the basket hole 13 of the basket 11 of the fuel transport container 10*a* having no inclining and fixing element, as shown in FIG. 7(A) and FIG. 7(B), in general, the basket hole 13 is vertically held, and then, the fuel assembly 35 is hoisted down and vertically inserted into the basket hole 13.

The lower tie-plate 36 of the fuel assembly 35, which is hoisted down, is placed on a fuel assembly receiving portion 26*a* formed in a center portion of a fuel assembly receiving base 25*a*. Thereafter, four fixedly supporting devices 14A and 14*a* are driven so that four side surfaces of the fuel assembly 35 are pressed and fastened by the fastening plates 15, and thus, it is general that the fuel assembly 35 is fixedly supported.

The fixedly supporting devices 14A and 14*a* may have the same fastening force. However, a fuel transport container 10*a* is arranged in the horizontal arrangement during the transporting process, for this reason, a necessary fastening force is different depending upon a position where the fixedly supporting device 14A and 14*a* is attached. For example, during the transporting operation, in a case where the fuel transport container 10*a* is arranged in the horizontal arrangement while a left-hand side surface of the fuel transport container 10*a* is situated downward, the fixedly supporting device 14*a*, which is also situated downward, must receive the own weight of the fuel assembly 35 so that a strong supporting force of the fixedly supporting device 14*a* is generally required as compared with that of other three fixedly supporting devices 14A.

Figure 8:
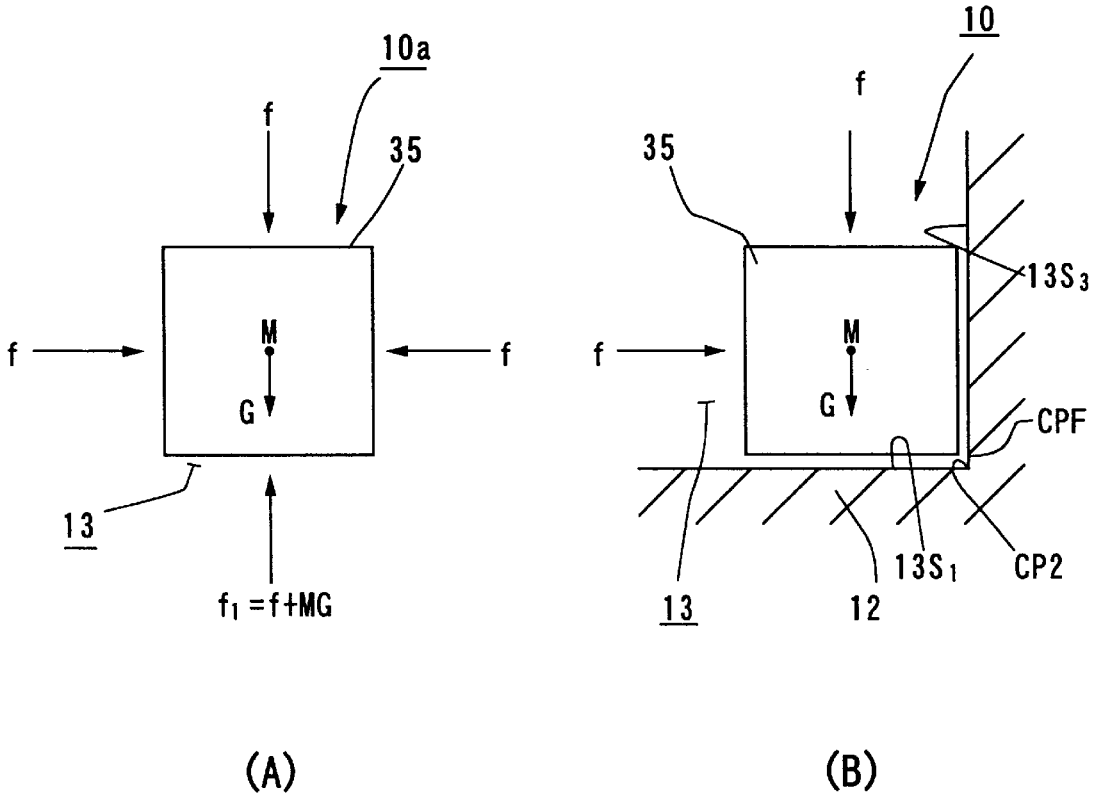
FIG. 8(A) is a schematic view for explaining a principle of a fixedly supporting method of the usual transport container shown in FIGS. 7(A) and 7(B)
FIG. 8(B) is a schematic view for explaining a principle of a fixedly supporting method of the transport container shown in FIGS. 4, 5 and 6 according to the present invention.

FIG. 8(A) and FIG. 8(B) are schematic views to explain a comparison of principles of fixedly supporting an usual fuel transport container 10*a* and the fuel transport container 10 of the present invention in a state that these fuel transport containers are horizontally placed.

FIG. 8(A) is a view relative to the conventional fuel transport container 10*a*, and FIG. 8(B) is a view relative to the fuel transport container 10 of the present invention. In the conventional fuel transport container 10*a*, four side surfaces of the rectangular and cylindrical fuel assembly 35 are fastened by means of four fixedly supporting devices 14A and 14*a* with fastening forces f, f1. In these fastening force f and f1, fastening force f1 by the fixedly supporting device 14*a*, which is situated below, is larger than the fastening force f by other three fixedly supporting devices 14A. The fastening force f1 must support the weight of the fuel assembly 35. In a case where the fuel assembly mass is M, and an acceleration of gravity is G, the fastening force f1 is expressed by the sum of the fastening force f and the fuel assembly weight M·G. Each of the fastening forces f, f1 is the totaled value of fixing forces subjected per each side surfaces of the rectangular and cylindrical fuel assembly 35 which is pressed and fastened by the plurality of fastening plates 15 arranged dispersively along the longitudinal direction. Arrows of the fastening forces f, f1 show fastening directions, respectively.

In the fuel transport container 10*a* shown in FIG. 8(A), the fixedly supporting devices are provided on four side surfaces of the fuel assembly 35, and the fixedly supporting device 14*a* which is situated below has the fastening force f1, which is equal to (f+M·G). For this reason, the fixedly supporting device 14*a* itself need to be made large; therefore, there is required a large space for providing the fixedly supporting devices around the fuel assembly 35. Further, the fastening force f required for other fixedly supporting devices 14A is generally substantially value of 1·M·G although it is different depending upon transport conditions of the fuel assembly 35.

Thus, the fastening force f1 of the fixedly supporting device 14*a* situated below is substantially twice as much as the fastening force f, by which the fixedly supporting device 14*a* situated below the fuel assembly 35 must be firmly constructed, and a larger space is required.

On the contrary, in the fuel transport container 10 shown in FIG. 8(B), since two adjacent side surfaces of the fuel assembly 35 are supported by inner side walls (inner side surfaces) 13*s*1, 13*s*3 of the basket hole 13 formed in the basket hole element 12 so that the corner portion CPF of the fuel assembly 35 is fixedly fitted to the corner portion CP2 of the basket hole 13, the fixedly supporting device 14 may be merely provided on the upper side surface and one side face of the fuel assembly 35 and there is no need of providing the fixedly supporting device 14 below the fuel assembly 35.

Accordingly, in the fuel transport container 10 of the present invention, the number of the fixedly supporting devices 14 can be reduced by half as compared with the conventional fuel transport container 10*a* and each of the fixedly supporting devices 14 of the present invention does not require a large fastening force as compared with the conventional fuel transport container 10*a*. Thus, it is possible to make small each of the fixedly supporting devices 14 of the present invention as compared with each of the conventional fixedly supporting devices 14A, 14*a*, and to make small a space occupied by providing the fixedly supporting devices 14, so that there can be provided the fuel transport container 10 which is compact and has a large capacity.

Moreover, in the fuel transport container 10 of the present invention, the fuel assembly 35 is directly inserted and housed in the basket hole 13 of the basket 11. When inserting the fuel assembly 35, it is possible to house the fuel assembly 35 in the basket hole 13 while the fuel assembly is smoothly biased to the one side (the inclining direction Y side) therein. Whereby it is possible to realize the fuel transport container 10 which dispenses a fixedly supporting device to be provided below the fuel assembly 35 while the fuel transport container 10 is arranged in the horizontal arrangement during transporting the fuel transport container 10. Therefore, it is possible to be provided the fuel transport container 10 which is compact and has a large capacity. Furthermore, there can be a method of transporting the fuel assembly 35, which can collectively and simultaneously transport a plurality of fuel assemblies 35 from fuel facilities to an atomic power plant or other facilities.

Figure 9:
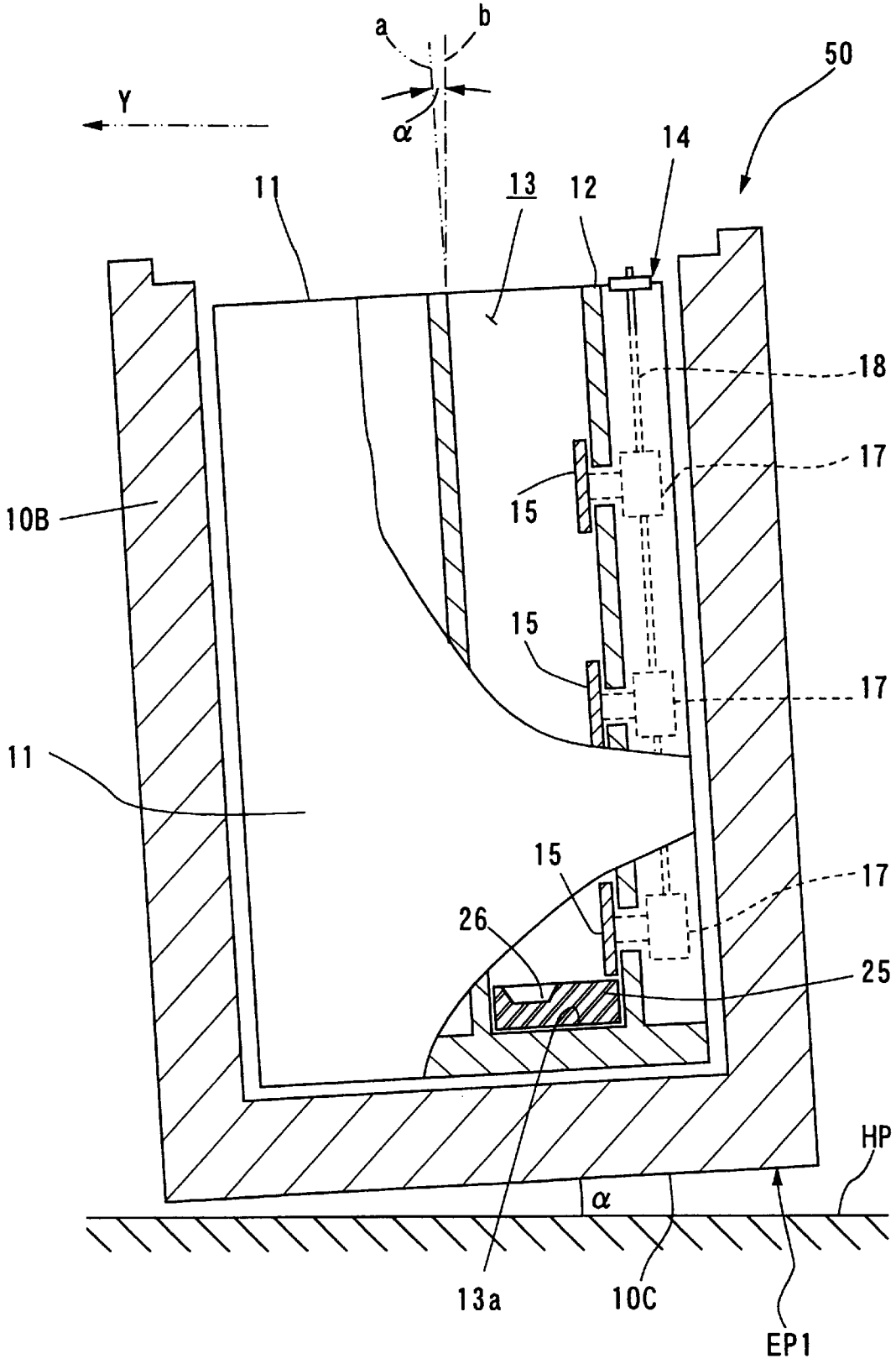
FIG. 9 is a longitudinal sectional view showing a fuel transport container arranged in the vertical arrangement according to a modification the first embodiment of the present invention.

FIG. 9 shows a modification of the transport container according to the first embodiment of the present invention.

In the fuel transport container 50 shown in the modification, the container main body 10B housing the basket 11 is held while being inclined by the angle of α° to the horizontal plane HP by means of an inclining and fixing device for inclining the container main body 10B along the inclining direction Y without using the inclining and fixing elements.

The inclining and fixing device may have inclination members, such as spacers, which has a simple system, adapted to be inserted between, for example, a corner portion CP2 side end portion EP1 of a bottom surface 10C of the container main body 10*b* and the horizontal plane HP so as to keep the fuel transport container 50 inclining along the inclining direction Y by the angle of α° with respect to the horizontal plane HP. Furthermore, the device may have a drive system for lifting up the corner portion CP2 side end portion EP1 of the bottom surface 10C of the container main body 10B so as to keep the fuel transport container 50 inclining along the inclining direction Y by the angle of α° with respect to the horizontal plane HP. In addition, there can be provided various devices for keeping the fuel transport container 50 inclining along the inclining direction Y.

The container main body 10A is inclined by the angle of α° with respect to the horizontal plane HP; therefore, the basket axial line "a" is inclined by the angle of α° with respect to the vertical axis "b". The direction of the inclination of basket 11 and the fuel assembly receiving base 25 with one-side biasing function which is provided on the bottom surface 13*a* of the basket hole 13 are the same as these of the fuel transport container 10 shown in FIG. 1 to FIG. 3. Thus, same reference characters are used to designate the same components, and their explanations are omitted.

In the fuel transport container 10A shown in the modification, the basket 11 does not need to be housed while being inclined in the container main body 10B. Thus, the basket 11 is stably housed in the container main body 10B.

Figure 10:
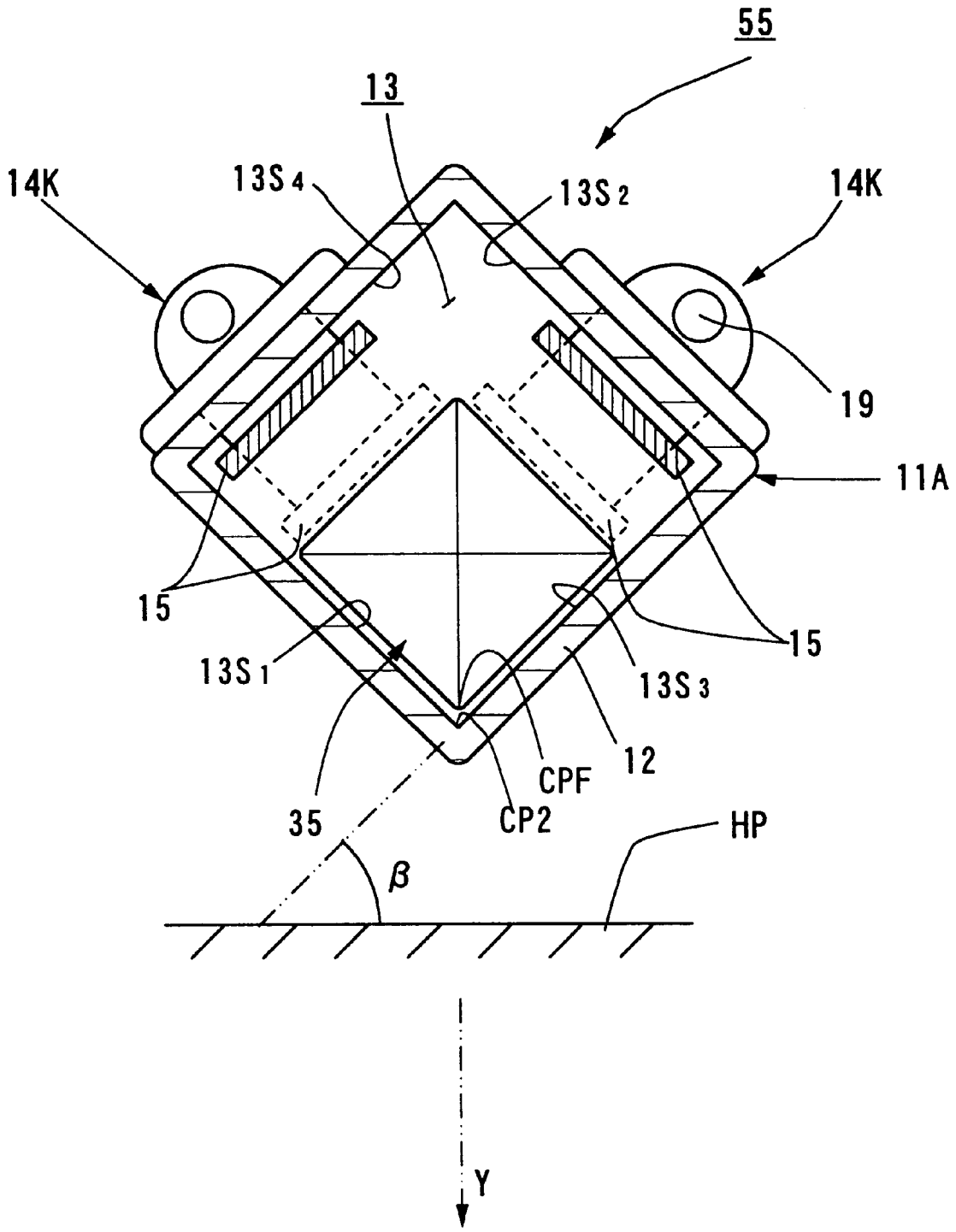
FIG. 10 is a lateral sectional view showing one basket hole of a fuel transport container arranged in the horizontal arrangement, in which a fuel assembly is housed, for explaining the method of transporting the fuel transport container according to a second embodiment of the present invention.

FIG. 10 shows a transport container according to a second embodiment of the present invention.

The transport container shown in this second embodiment is different from the fuel transport container 10 shown in the first embodiment in a structure of a basket 11A housed in the container main body, and other construction is the substantially same as the first embodiment. Thus, same reference characters are used to designate the same components, and their explanations are omitted.

A fuel transport container 55 shown in FIG. 10 is characterized in an arrangement of a basket hole element 12 constituting a basket 11A. The basket 11A includes a plurality of basket hole elements 12 each of which is constructed by a rectangular tube or rectangular cylinder. Each of these basket hole elements 12 is formed with a basket hole 13 having a cylindrical and a rectangular shape in its lateral cross section. Each basket holes is adapted to constitute a chamber for housing the fuel assembly.

The basket 11A is constructed in that the plurality of basket hole elements 12 are arranged with a predetermined intervals and combined integrally by a joining member (not shown) so that the basket 11A is formed as the substantially cylindrical shaped outline. All of the basket hole elements 12 constituting the basket 11A are arranged in the identical direction.

FIG. 10 is a lateral sectional view showing the basket hole element 12 in the basket 11A of the fuel transport container 55 while the fuel transport container 55 is arranged in the horizontal arrangement.

The basket 11A is accommodated in the inner hollow cylindrical chamber of the container main body 10A so that, when the fuel transport container 55 is arranged in the horizontal arrangement, the lower-side corner portion CP2 formed by the inner side walls 13*s*1, 13*s*3 adjacent each other of the basket hole 13 are positioned to a lower side of the fuel assembly 35 and the inner side walls 13*s*3 and 13*s*4 are inclined at a predetermined angle of, for example, substantially 45° with respect to the horizontal surface HP. The corner portion CP2 is formed as a substantially V shape so as to be fitted to the corner portion CPF of the fuel assembly 35, by which the fuel assembly 35 is supported by the V shaped corner portion CP2.

It is preferable that the inclination angle with respect to the horizontal plane HP is substantially 45° in balance. However, the inclination angle is not limited to the above, and may be set within a range of, for example, 30° to 60°.

The fixedly supporting device 14K is mounted to the inner side walls 13*s*2, 13*s*4 situated on the upper side of the fuel assembly 35. The fuel assembly 35 mounted in the basket hole 13 is pushed against the inner side walls 13*s*1, 13*s*3 by the fastening plates 15 moving close to the fuel assembly 35 so that the corner portion CPF of the fuel assembly 35, having a V shape and positioned opposite to the corner portion CP2, is fitted to the V-shaped corner portion CP2 of the basket hole 13 by the pushing force of the fastening plates 15, by which the fuel assembly 35 is fixedly supported to the V-shaped corner portion CP2 of the basket hole 13.

Next, a method of transporting the fuel assembly 35 by using the fuel transport container 55 will be described hereinafter.

The method of transporting the fuel assembly 35 with the use of the fuel transport container 55 comprises a mount process for mounting the MOX fuel assembly 35 in a state that the fuel transport container 55 is arranged in the vertical arrangement, and a transport process for transporting the fuel transport container 55 from fuel facilities to an atomic power plant or other storage facilities while the fuel transport container 55 is arranged in the horizontal arrangement.

In the mount process, similarly to the first embodiment, the fuel assembly 35, which is not housed in a protective container, is directly inserted and mounted into the basket hole 13 of the basket hole element 12 while automatically and smoothly being biased to the one side (the inclining direction Y side) so that the corner portion CPF of the fuel assembly 35 is in contact with the corner portion CP2 of the basket hole 13.

After the fuel assemblies 35 are inserted into the respective basket holes 13 of the basket 11, respectively, the fixedly supporting device 14K is operated so as to move the fastening plates 15 close to the inserted fuel assembly 35. By moving the fastening plates 15 close thereto, the fuel assembly 35 is pressed and fastened by these fastening plates 15 so that, as shown in FIG. 10, the corner portion CPF of the fuel assembly 35 is fixedly fitted to the corner portion CP2 of the basket hole 13. As a result of that, the fuel assembly 35 is fixedly supported to the basket hole 13, and thus, the mounting process of the fuel assembly 35 is completed.

In a transport process, as shown FIG. 10, the MOX fuel assembly 35 is transported while being housed in the basket hole 13. More specifically, the fuel assembly 35 is transported while being biased to the one side (the inclining direction Y side) in the basket hole 13 in a manner that the corner portion CP2 of the basket hole 13 contacting with the corner portion CPF of the fuel assembly 35 is positioned to the lower side of the fuel assembly 35. That is, the fuel assembly 35 is transported together with the fuel transport container 55 while the fuel transport container is arranged in the horizontal arrangement.

Therefore, in a case where the fuel transport container 55 vibrates along the horizontal direction during the transporting operation, since the fuel transport container 55 is fitted to the V-shaped corner portion CP2 of the basket hole 13 so as to be fixedly restricted, the fuel transport container 55 is exceedingly stable against the vibration along the horizontal direction.

Figure 11:
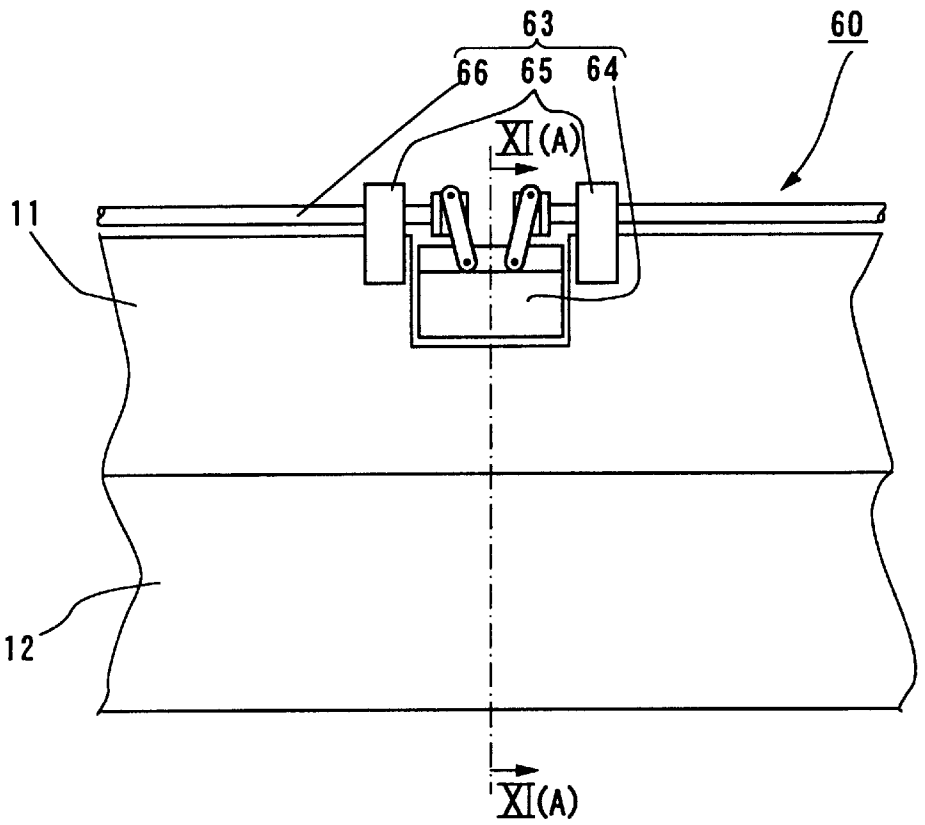
FIG. 11(A) is a partially lateral sectional view taken on line XI(A)—XI(A) of FIG. 11(B) showing one basket hole of a fuel transport container which is arranged in the horizontal arrangement, in which a fuel assembly is housed, according to a third embodiment of the present invention.
FIG. 11(B) is a longitudinal side view showing the one basket hole of the fuel transport container shown in FIG. 11(A)
Figure 11:
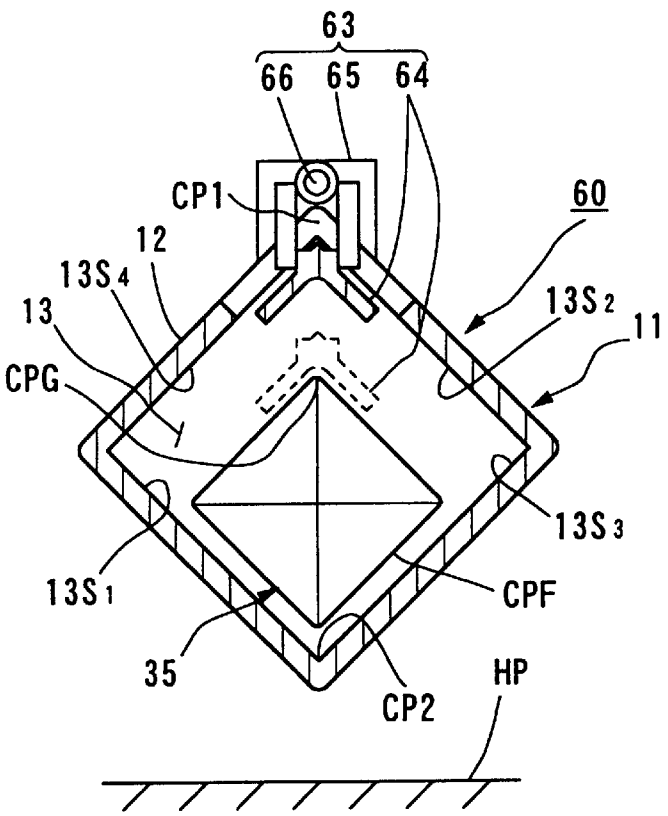

FIG. 11 shows a transport container according to a third embodiment of the present invention.

In a transport container shown in this third embodiment, one fixedly supporting device 63 is provided on each basket holes 13, and other construction is the same as the fuel transport container 55 of the second embodiment. Thus, same reference characters are used to designate the same components, and their explanations are omitted.

In a fuel transport container 60 shown in FIG. 11(A) and FIG. 11(B), the basket hole element 12 is provided with one fixedly supporting device 63. The fixedly supporting device 63 is provided on the diagonal to the basket hole element 12 so that the fixedly supporting device 63 is located, when the fuel transport container 60 is arranged in the horizontal arrangement, on an upper-side corner portion CP1 formed by the inner side walls 13*s*2, 13*s*4 which is positioned to an upper side of the housed fuel assembly 35. The basket 11 of the fuel transport container 60 is constructed in a manner of integrally connecting a many of basket hole elements 12 by means of a connective member. All of basket hole elements 12 constituting the basket 11 are arranged in the identical direction as the basket hole element 12 shown in FIG. 11(A). FIG. 11(A) is a partially lateral sectional view taken on line XI(A)—XI(A) of FIG. 11(B) showing the basket hole 13 of the fuel transport container 60 which is arranged in the horizontal arrangement, in which the fuel assembly 35 is housed and FIG. 11(B) is a longitudinal side view showing the basket hole 13 of the fuel transport container 60 shown in FIG. 11(A).

When the fuel transport container 60 is arranged in the horizontal arrangement, during transport process, the basket hole 13 of the basket 11 constitutes a fuel assembly housing chamber. In the basket hole 13 of the basket 11, the two inner side surfaces 13*s*1, 13*s*3 of the basket hole 13, which are in contact with the fuel assembly 35, are positioned to the lower side of the fuel assembly 35, and the inner side surfaces 13*s*3 and 13*s*4, which are parallel each other, are inclined at an angle of, for example, substantially 45° with respect to the horizontal plane HP. Thus, the V shaped corner portion CP2 formed by the inner side surfaces 13*s*1, 13*s*3 is adapted to support the fuel assembly 35. This construction is the same as the fuel transport container 55 of the second embodiment. Simultaneously to the second embodiment, it is preferable that the inclination angle with respect to the horizontal plane HP is substantially 45° in balance. However, the inclination angle is not limited to the above, and may be set within a range of, for example, 30° to 60°.

The fuel transport container 60 is basically different from the second embodiment in that one fixedly supporting device 63 is provided on the upper-side corner portion CP2 of the basket hole element 12, and in that a plurality of fastening plates 64 having a V shape in its lateral cross section are separately arranged in the longitudinal direction (axial direction) of the basket hole 13 so as to move close to and far from the housed fuel assembly 35 by a drive of the fixedly supporting device 63. Each of the V shaped fastening plates 64 is adapted to be fitted to an upper side corner portion CPG of the fuel assembly 35.

The fixedly supporting device 63 comprises a plurality of fastening plates 64, a drive mechanism 65 having a small jack principle operatively connected to each fastening plates 64 for moving each fastening plate 64 and a rotating shaft 66 operatively connected to the drive mechanism 65 for driving the drive mechanism 65. When the rotating shaft 66 is driven, each fastening plates 64 is projected from the upper corner portion CP1 of the basket hole 13 so as to press and fasten the MOX fuel assembly 35 to the inclining direction Y, that is, a downward direction, whereby the fuel assembly 35 is fixedly supported to the basket hole 13.

When the fixedly supporting device 63 is driven, the fastening plates 64, which are separately arranged in the longitudinal direction of the basket hole 13, are synchronously moved close to and far from the fuel assembly 35. As shown in FIG. 11(A), the fixedly supporting device 63 drives the fastening plates 64 so that the fastening plates 64 advances and retreats between a housing position shown by a solid line and a fastening position shown by a broken line. In the fastening position, the fastening plates 64 press the fuel assembly 35 so that the fuel assembly 35 is fastened between the V shaped lower side corner portion CP2 of the basket 13 and the V shaped fastening plates 64, thereby fixedly supporting the fuel assembly 35 to the basket hole 13.

Next, a method of transporting the fuel assembly 35 by using the fuel transport container 60 will be described hereinafter.

The method of transporting the fuel assembly 35 with the use of the fuel transport container 60 comprises a mount process for mounting the MOX fuel assembly 35 in a state that the fuel transport container 60 is arranged in the vertical arrangement, and a transport process for transporting the fuel transport container 60 from fuel facilities to an atomic power plant or other storage facilities while the fuel transport container 60 is arranged in the horizontal arrangement.

In the mount process, similarly to the first embodiment, the fuel assembly 35, without using a protective container, is directly inserted and mounted into the basket hole 13 of the basket hole element 12 while automatically and smoothly being biased to the one side (the inclining direction Y side), whereby the corner portion CPF of the fuel assembly 35 is in contact with the corner portion CP2 of the basket hole 13.

After the fuel assemblies 35 are inserted into the respective basket holes 13 of the basket 11, respectively, the fixedly supporting device 63 is operated so as to move the fastening plates 64 close to the inserted fuel assembly 35 toward the inclining direction Y (the downward direction). By moving the fastening plates 64 close thereto, the fastening plates 64 are fitted to the upper side corner portion CPG so that the fuel assembly 35 is pressed and fastened by these fastening plates 64.

As a result of that, as shown in FIG. 11(A), the corner portion CPF of the fuel assembly 35 is fixedly fitted to the corner portion CP2 of the basket hole 13. Therefore, the fuel assembly 35 is fastened by the fastening plates 64 and the corner portion CP2 of the basket hole 13 so that the fuel assembly 35 is fixedly supported to the basket hole 13, and thus, the mounting process of the fuel assembly 35 is completed.

In a transport process, as shown FIGS. 11(A), 11(B), the MOX fuel assembly 35 is transported while being housed in the basket hole 13. More specifically, the fuel assembly 35 is transported while being biased to the one side (the inclining direction Y side) in the basket hole 13 in a manner that the corner portion CP2 of the basket hole 13 contacting with the corner portion CPF of the fuel assembly 35 is positioned to the lower side of the fuel assembly 35. That is, the fuel assembly 35 is transported together with the fuel transport container 60 while the fuel transport container is arranged in the horizontal arrangement.

Therefore, in a case where the fuel transport container 60 vibrates along the horizontal direction during the transporting operation, since the fuel transport container 60 is fitted to the V-shaped lower side corner portion CP2 of the basket hole 13 and fitted to the V-shaped fastening plates 64 so as to be fixedly restricted, the fuel transport container 60 is exceedingly stable against the vibration along the horizontal direction.

Figure 12:
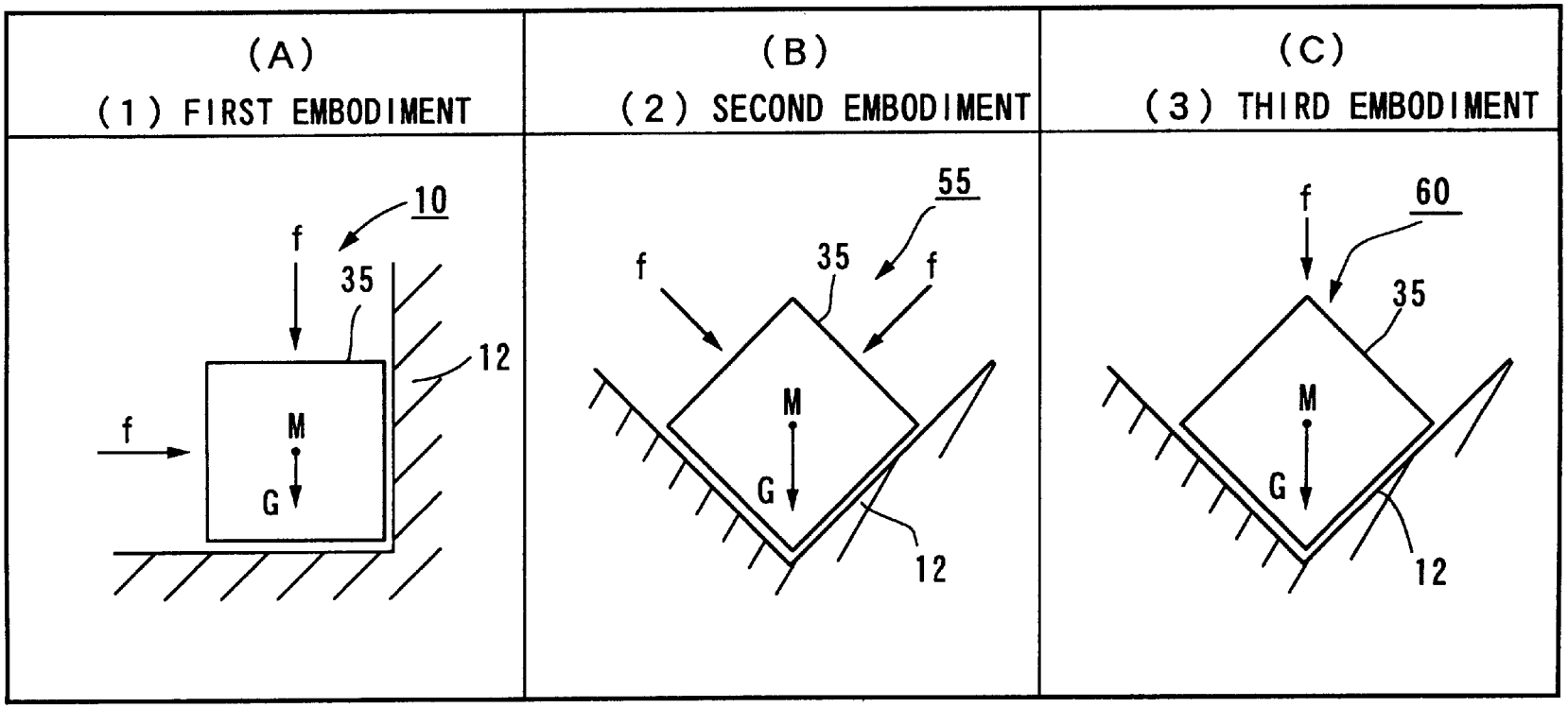
FIG. 12 is a view showing a comparative result in effect between the fuel transport containers according to the first to third embodiments.

Next, the operation and effect of the fuel transport containers 10, 55 and 60 shown in the first to third embodiments will be described below with reference to FIG. 12.

FIGS. 12(A), (B) and (C) are operation and principle views for showing a relationship between fastening forces and fastening directions by the fixedly supporting devices of the fuel transport containers 10, 55 and 60 according to of the first to third embodiments, respectively. FIGS. 12(A), (B) and (C) schematically show, while the fuel transport containers is arranged in the horizontal arrangement, a method of fixedly supporting the fuel assembly 35 in the first to third embodiments, respectively.

According to the fixedly supporting method of each embodiment, it is possible to calculate a limiting acceleration such that the fuel assembly 35 fastened by the fastening force f starts to slide or start to move in the basket hole 13 by a model of a system of particle, referred to "particle model" herein after, regarding the fuel assembly 35 as a particle. In actual, the fuel assembly 35 is not the particle; however, a calculation of the particle model is effective as a criterion for obtaining a necessary fastening force with respect to an anticipated acceleration.

For example, in the method of fixedly supporting the fuel assembly 35 in the first embodiment, a limitation acceleration γc, when an acceleration acts in a left direction, is obtained by the following equation.

$$\gamma c = G\mu + f/M(1+2\mu)$$

Where, $\mu$ is a frictional coefficient between the fuel assembly 35 and a member which is in contact with the fuel assembly 35, and assuming as an identical value regardless of a kind of the member, the frictional coefficient is, for example, 0.3 in the following calculation.

Figure 13:
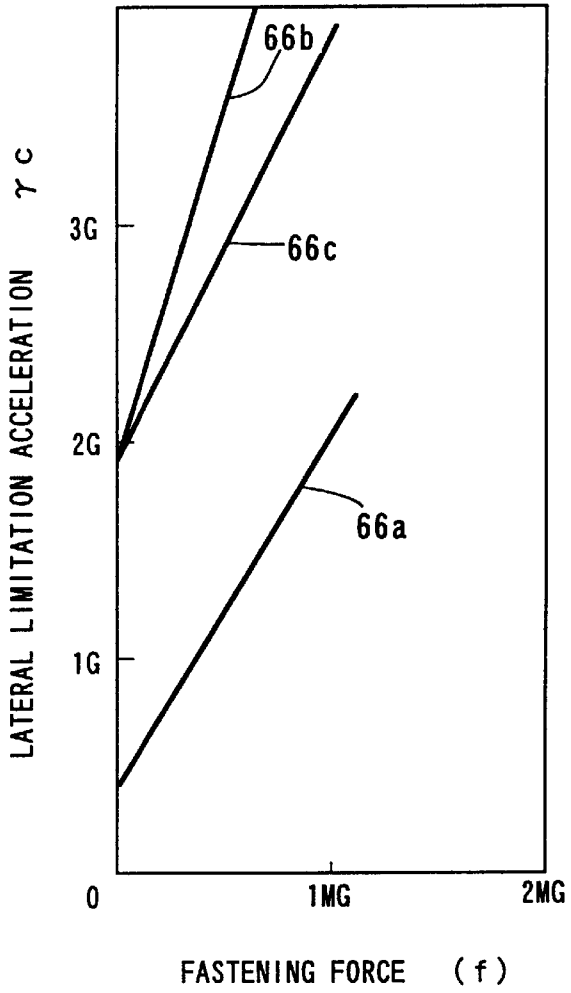
FIG. 13(A) is a graph showing a calculation result of an upward limitation acceleration $\gamma$ c according to the first to third embodiments.
FIG. 13(B) is a graph showing a calculation result of a lateral limitation acceleration $\gamma$ c according to the first to third embodiments.
Figure 13:
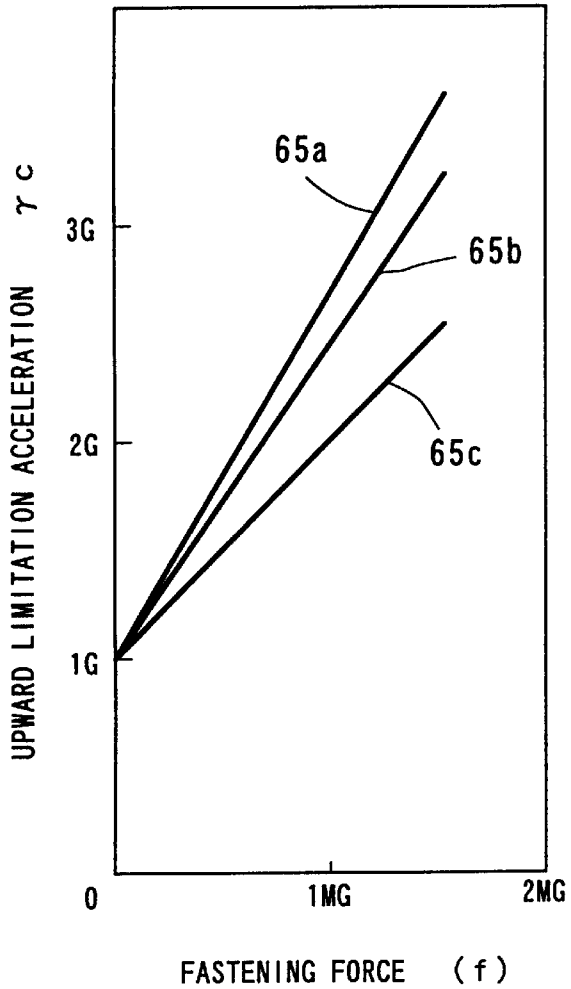

FIG. 13 shows a calculation result of the limitation acceleration γc. FIG. 13(A) shows a upward limitation acceleration, and FIG. 13(B) shows a lateral limitation acceleration.

The acceleration acting on the fuel assembly 35 during transporting operation is different depending upon transport conditions. In general, the lateral acceleration is the maximum, and the acceleration becomes small in the order of the vertical direction, longitudinal direction. Thus, it is important to sufficiently and fixedly support the fuel assembly 35 in the lateral direction.

As seen from the upward limitation acceleration curve 65*a* according to the fastening force of the first embodiment, the upward limitation acceleration curve 65*b* according to the fastening force of the second embodiment and the upward limitation acceleration curve 65*c* according to the fastening force of the third embodiment, which are shown in FIG. 13(A), there is no great difference in three cases of the first to third embodiments. In other words, the upward limitation acceleration is 1 G when the fastening force f is 0, and is increased in proportion as the fastening force f increases.

On the other hand, as seen from the lateral limitation acceleration curve 66*a* according to the fastening force of the first embodiment, the lateral limitation acceleration curve 66*b* according to the fastening force of the second embodiment and the lateral limitation acceleration curve 66*c* according to the fastening force of the third embodiment, which are shown in FIG. 13(B), there is great difference in the fixedly supporting method of the fuel assembly between the first, second and third embodiments.

According to the fixedly supporting method of the fuel assembly 35 of the first embodiment, assuming that the fuel assembly 35 is fastened by a fastening force f equivalent to 1 MG, the fastening force is stable with respect to the lateral acceleration of substantially 2 G. However, if the fastening force is loose, and is reduced to a half, the fuel assembly 35 starts to move at the lateral acceleration of substantially 1.2 G. Thus, in the case of the fixedly supporting method of the first embodiment, there is a need of preventing the fastening force f being loose. In order to prevent the fastening force from loose, each of the fastening plates 15 may be pressed by means of an elastic member such as a spring or the like.

On the contrary, according to the fixedly supporting method of the fuel assembly 35 of the second and third embodiments, even if the fastening force f gets to be 0 (zero), the fuel assembly 35 is stable up to the lateral acceleration of substantially 1.8 G. Thus, a great fastening force f is not so required. Further, there is no need of preventing the fastening force from being loose, so that the fixedly supporting device 14K of the second embodiment and the fixedly supporting device 63 of the third embodiment can be made small and compact as compared with that of the first embodiment. This is because the fuel assembly 35 is supported to the corner portion CP2 forming the V shape.

As described above, according to the fixedly supporting method of the fuel assembly 35 of the second and third embodiments, no great fastening force f is required, and there is no need of taking measures for preventing the fastening force f from being loose, so that the fixedly supporting devices 14K, 63 can be made small and compact as compared with the fixedly supporting method of the first embodiment. Therefore, there can be provided fuel transport containers 55 and 60 which are a smaller and compact size and have a large capacity, and a method of transporting the plurality of fuel assemblies by using the fuel transport containers 55 and 60.

In the case of making a comparison between the second and third embodiments, each of the fixedly supporting devices has the substantially same function. In the second embodiment, two fixedly supporting devices 14K are required per one fuel assembly, on the contrary, in the third embodiment, one fixedly supporting device is required per one fuel assembly. Therefore, in the case where the fixedly supporting method of the fuel assembly 35 of the third embodiment is employed, the employed method contributes for obtaining a fuel transport container 55 having a more compact and large capacity.

FIG. 14 to FIG. 17 show a transport container according to a fourth embodiment of the present invention.

FIG. 14(A) is a partially longitudinal sectional view showing the basket hole 13 of the fuel transport container 70 which is arranged in the horizontal arrangement, in which the fuel assembly 35 is housed, according to the fourth embodiment. Moreover, FIG. 14(B) is a lateral end view of the basket hole 13 of the fuel transport container 70 shown in FIG. 14(A). FIGS. 14(A) and (B) show one example of the basket hole element 12, and other basket hole elements 12 are arranged in the identical direction. The basket 11 is constructed in a manner of integrally connecting basket hole elements 12 by means of a connective member. In the basket 11, each basket hole element 12 is formed with a basket hole 13 forming a fuel housing chamber.

Each of the basket holes 13 (basket hole elements 12) is arranged in the basket 11 so that, when the fuel transport container 70 is arranged in the horizontal arrangement, the lower-side corner portion CP2 formed by the inner side walls 13*s*1, 13*s*3 adjacent each other of the basket hole 13 are positioned to a lower side of the fuel assembly 35 and the inner side walls 13*s*3 and 13*s*4 are inclined at a predetermined angle of, for example, substantially 45° with respect to the horizontal surface HP. The corner portion CP2 is formed as a substantially V shape so as to be fitted to the corner portion CPF of the fuel assembly 35, by which the fuel assembly 35 is supported by the V shaped corner portion CP2.

Further, the basket 11 and the basket hole element 12 are arranged in the fuel transport container 70 so that an outer corner portion OC of the basket hole 13 (basket hole element 12) opposite to the corner portion CP2 is inclined at a predetermined angle of, for example, θ° with respect to the horizontal plane HP so that the bottom portion BP of the bottom surface 13*a* side of the basket hole element 12 is directed downward, and the top portion of the top surface side thereof is directed upward in the longitudinal direction.

The inclination angle θ° is, for example, substantially 30°. In the inclined basket hole 13, the fuel assembly 35 is so leaned as to be supported to the inner side walls 13s1, 13s3 of the basket hole 13 forming the V shaped corner portion CP2 in a state that the lower tie-plate 36 is placed on the fuel assembly receiving base 25 with the one-side biasing function. Further, a pair of spacers 71 is removably provided in order to fill a gap between the two upper side surfaces of the upper tie-plate 38 and the upper side inner side walls 13s2, 13s4 of the basket hole 13.

A method of transporting the fuel assembly 35 with the use of fuel transport container 70 basically comprises a mount process for mounting the MOX fuel assembly 35 in a state that the fuel transport container 70 is arranged in the vertical arrangement, and a transport process for transporting the fuel transport container 70 from fuel facilities to an atomic power plant or other storage facilities while the fuel transport container 70 is arranged in the horizontal arrangement.

In the mount process, similarly to the first embodiment, the fuel assembly 35, without using a protective container, is directly inserted and mounted into the basket hole 13 of the basket hole element 12 while automatically and smoothly being biased to the one side (the inclining direction Y side).

After the fuel assemblies 35 are inserted into the respective basket holes 13 of the basket 11, the fuel transport container 70 is arranged in the horizontal arrangement so that the inner side walls 13s1, 13s3 of the basket hole 13 contacting with the fuel assembly 35 are positioned to the lower side of the fuel assembly 35, and are inclined at the angle of the β° with respect to the horizontal plane HP, and thus, the corner portion CP2 formed by the inner side walls 13s1, 13s3 forming the V shape is adapted to support the fuel assembly 35.

Further, when the fuel transport container 70 is arranged in the horizontal arrangement, the basket hole element 12 (the basket hole 13) is arranged in the fuel transport container 70 so that the outer corner portion OC of the basket hole 13 is inclined at the angle of θ° with respect to the horizontal plane HP and that the bottom portion BP of the basket hole element 12 is directed downward and the top portion of the top surface side thereof is directed upward in the longitudinal direction.

After that, the fuel transport container 70 is transported while the outer corner portion OC of each of the basket holes 13 is inclined at the angle of θ°, the bottom portion BP of the basket hole element 12 is directed downward and the top portion of the basket hole element 12 is directed upward in the longitudinal direction. During the transport of the fuel transport container 70, the advancing direction is the bottom portion BP in the longitudinal direction, that is, a direction from the left hand to the right hand in FIG. 14(A).

The example shown in FIG. 14(A) and FIG. 14(B) relates to the fuel transport container 70 and the transport method in a case where vibratory condition by the transport is not so strict, that is, in a case where a speed of transport means such as a trailer or the like for transporting the fuel transport container 70 is relatively low, or a relatively large transport means is used to prevent vibration from being generated.

As described in FIG. 13(B), in the case where the fuel assembly 35 is supported to the V shaped corner portion CP2 formed by the inner side walls 13s1, 13s3, the fuel assembly is stably supported respect to the lateral acceleration. Further, the fuel assembly 35 is stably supported until the upward acceleration becomes 1 G. In the case where the fuel assembly 35 is transported by means of transport means which has vibration preventive effect at a relatively low speed, the acceleration generated in the vertical direction is often 1 G or less.

During mounting work by using a crane or the like, there may be the case where an upward acceleration of 1 G or more is instantaneously generated. In the case where the upward acceleration of 1 G or more acts, in order to prevent the fuel assembly 35 from jumping up in the basket hole 13, the lower tie-plate 36 and the upper tie-plate 38 are held down by means of the fuel assembly receiving base 20 and the pair of spacers 40, respectively. Therefore, even if the upward acceleration of 1 G or more acts, the fuel assembly 35 is prevented from jumping up.

Figure 14:
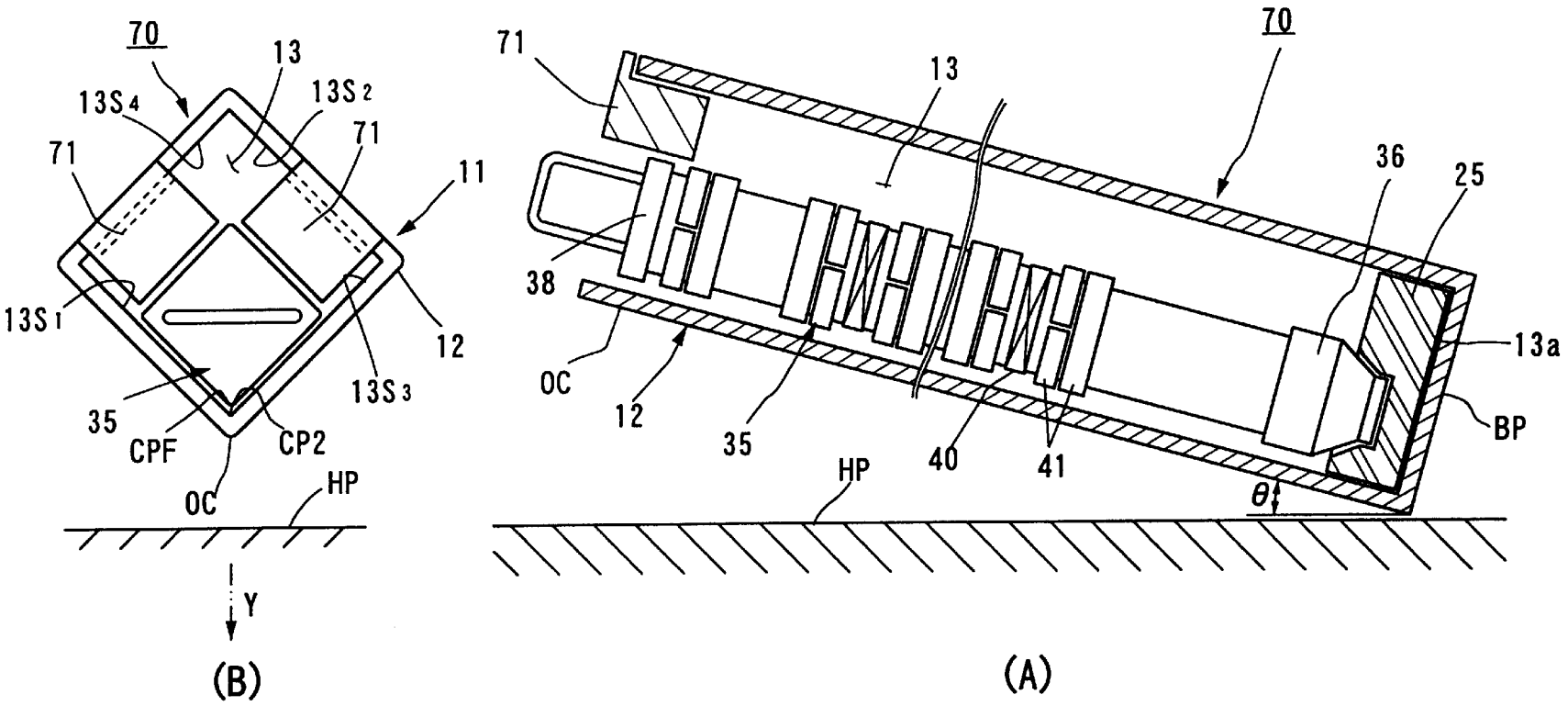
FIG. 14(A) is a partially longitudinal sectional view showing one basket hole of a fuel transport container which is arranged in the horizontal arrangement, in which a fuel assembly is housed, according to a fourth embodiment of the present invention.
FIG. 14(B) is a lateral end view of the one basket hole of the fuel transport container shown in FIG. 14(A)

In the fuel transport container 70 of the fourth embodiment, a fastening force does not act on the fuel assembly 35, for this reason, there is a problem as to whether or not the fuel assembly 35 starts to move in the longitudinal acceleration. In FIG. 14(*a*) and FIG. 14(B), the fuel transport container 70 during the transport advances from the left hand to the right hand direction. Even if a relatively large acceleration is generated in the advancing direction, the fuel assembly 35 is supported on the fuel assembly receiving base 20, therefore, the fuel assembly 35 does not move.

Figure 15:
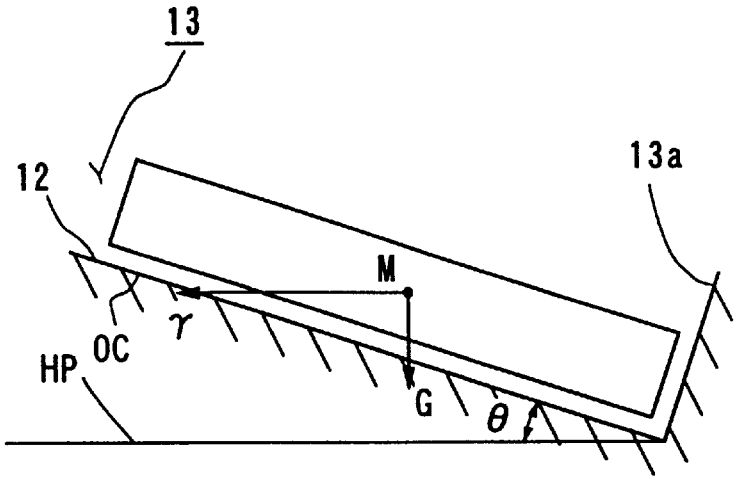
FIG. 15 is a view showing a model of system of particle for calculating stability of the fuel assembly with respect to an acceleration due to a breaking reaction according to the fourth embodiment.
Figure 16:
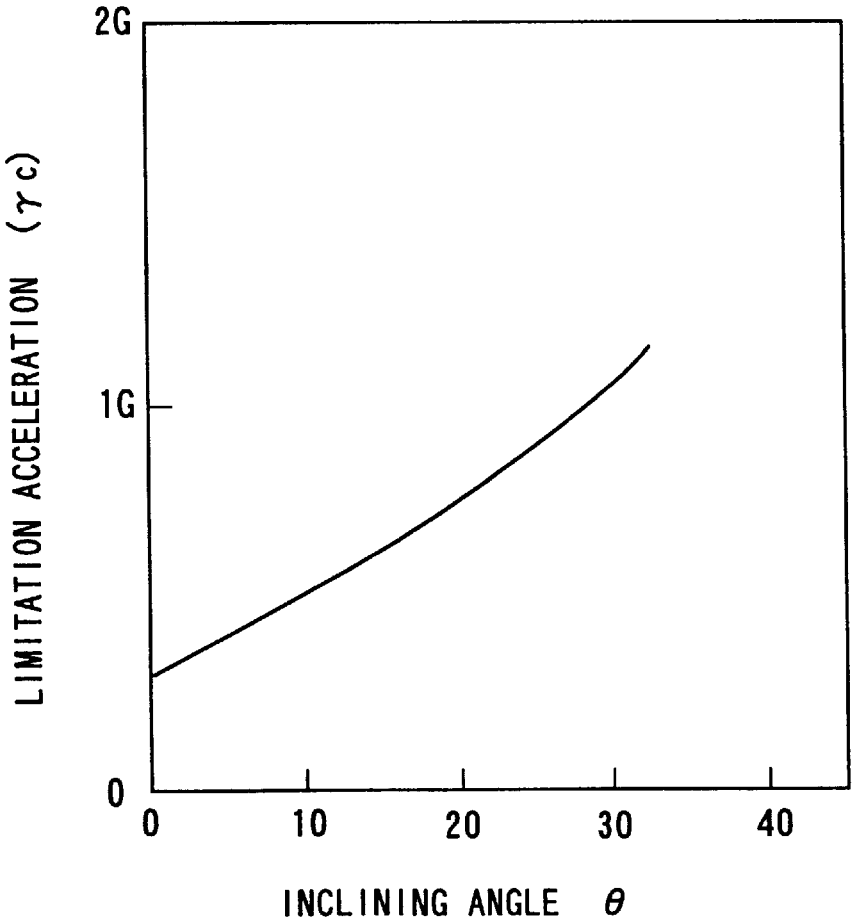
FIG. 16 is a view showing a calculation result of the model of system of particles shown in FIG. 15.
Figure 17:
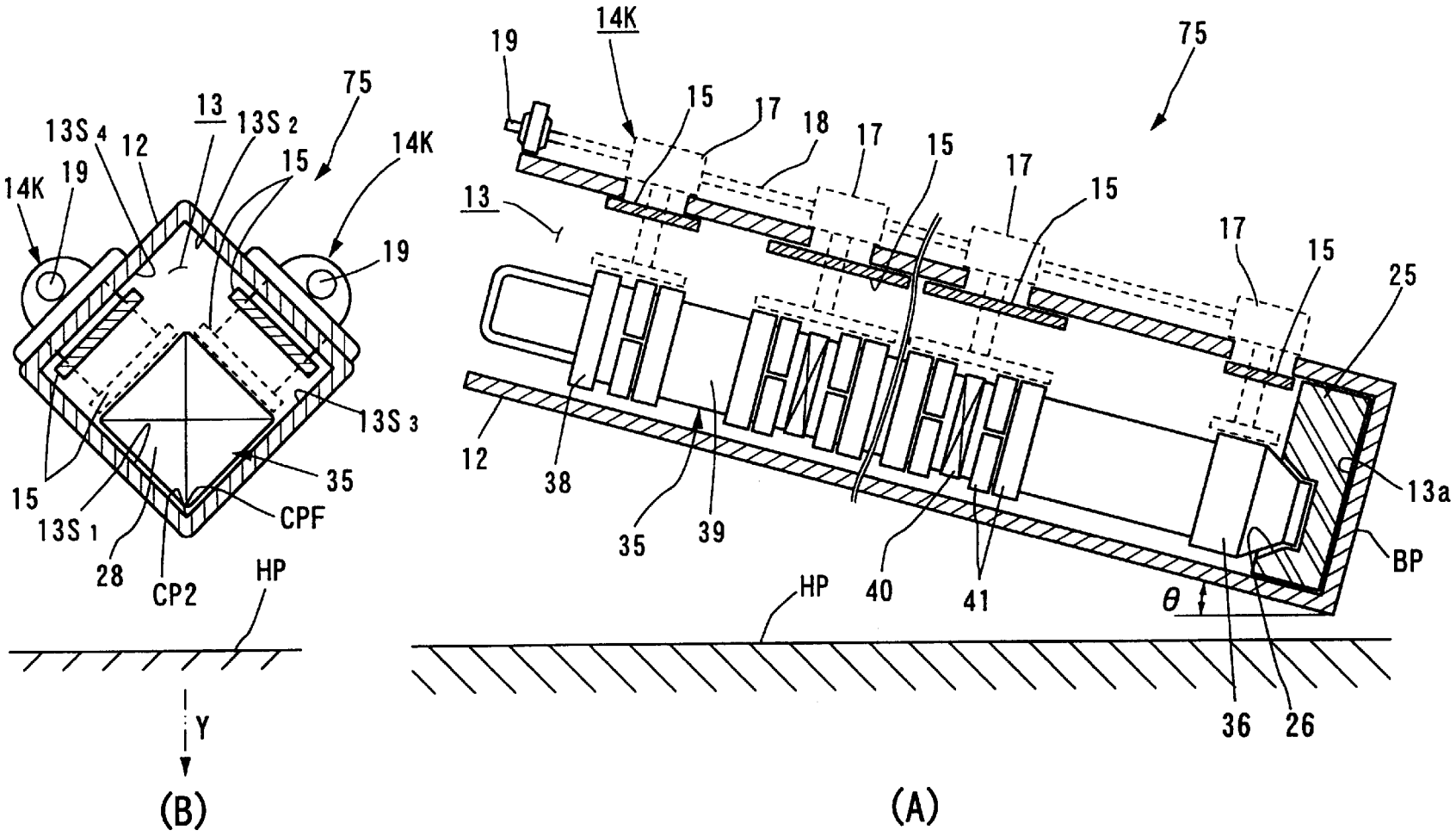
FIG. 17(A) is a partially longitudinal sectional view showing one basket hole of a fuel transport container which is arranged in the horizontal arrangement, in which a fuel assembly is housed, according to a modification of the fourth embodiment.
FIG. 17(B) is a lateral sectional view of the one basket hole of the fuel transport container shown in FIG. 17(A)

When the transport means is applied by a brake, there is the case where a reverse acceleration is generated in a direction reverse to the advancing direction due to the breaking reaction. The reverse acceleration is substantially 0.8 G, or as the case may be, possibly gets to be 1 G. FIG. 15 shows a particle model for calculating stability of the fuel assembly 35 with respect to the reverse acceleration due to the breaking reaction. The characters shown in FIG. 15 are the same as FIG. 9. FIG. 16 shows the calculation result of the particle model. As seen from FIG. 16, if an inclining angle θ° is substantially 30°, it is found that the fuel assembly 35 does not slide even if the acceleration of substantially 1 G is generated in the reverse direction reverse to the advancing direction.

The fuel transport container 70 and the transport method of the fourth embodiment are example applied to the case where the transport conditions are relatively gentle. That is, in this embodiment, since the fuel assembly 35 is fixedly supported to the corner portion CP2 of the inner side walls 13s1, 13s3 basket hole walls forming V shape and each of the basket holes 13 is inclined in the longitudinal direction, the fixedly supporting device, such as fixedly supporting device 14K, or fixedly supporting device 63, is dispensed with. Therefore, there can be provided the fuel transport container 70 having a compact and large capacity and a method capable of transporting a plurality of fuel assemblies 35 collectively and simultaneously by using the fuel transport container 70.

As shown in FIG. 17(A) and FIG. 17(B), the fuel transport container 75 of the fourth embodiment may be provided with the fixedly supporting device 14K as the fuel transport container 55 of the second embodiment. Whereby the fuel assembly 35 can be more stably transported even under more strictly transport conditions as compared with a case of using the fuel transport container 70.

Figure 18:
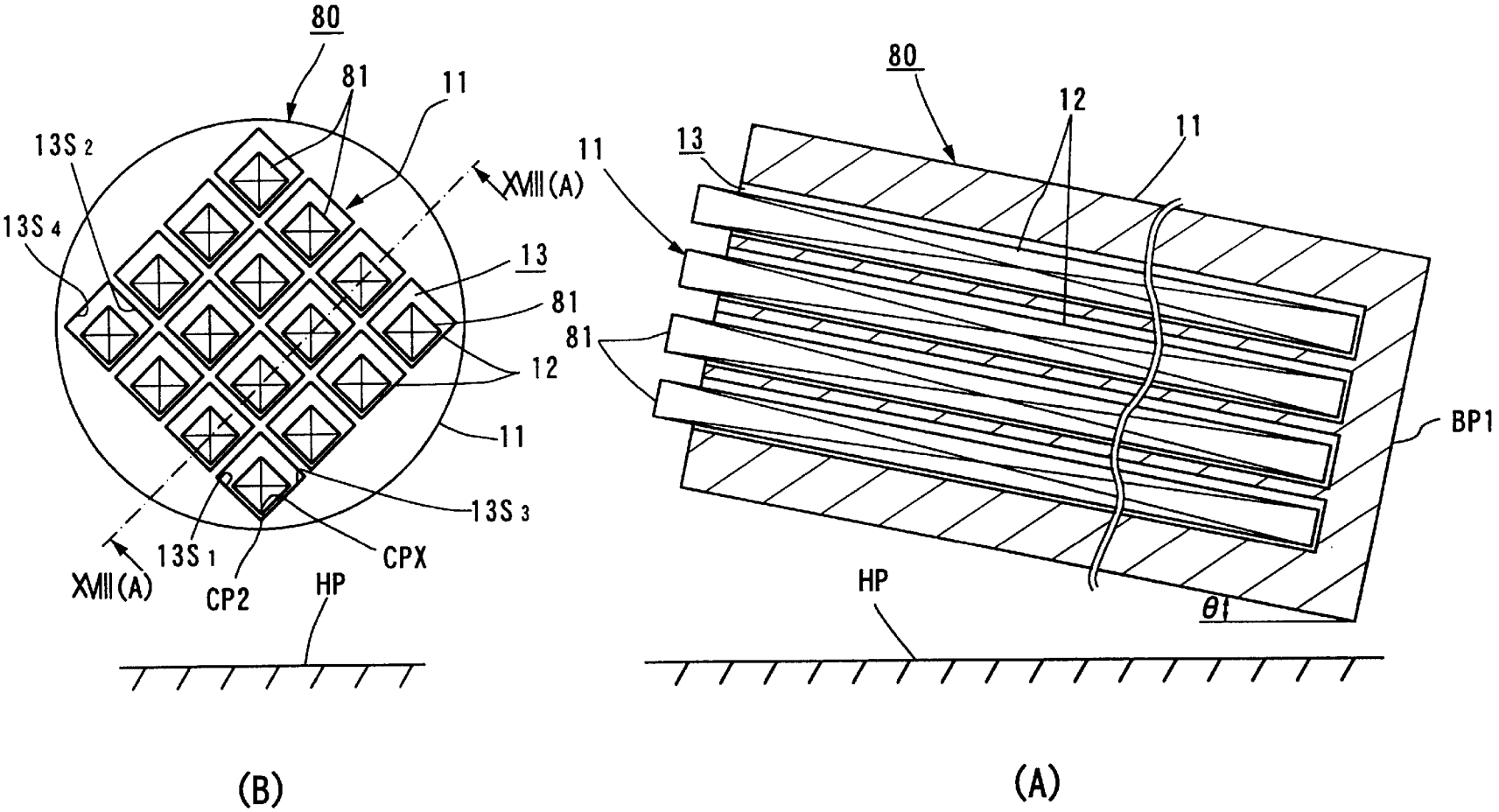
FIG. 18(A) is a partially longitudinal sectional view showing a basket of a fuel transport container which is arranged in the horizontal arrangement, in which a fuel protective container is housed, according to a fifth embodiment of the present invention.
FIG. 18(B) is a lateral end view of the basket of the fuel transport container shown in FIG. 18(A)

FIG. 18 shows a transport container according to a fifth embodiment of the present invention.

In the transport container 80 of this fifth embodiment, a protective container 81 housing a fuel assembly (not shown) is housed in the basket hole 13 of the basket 11, and the basket hole 13 is formed as a housing chamber for the fuel protective container 81 housing the fuel assembly. The fuel protective container 81 has a cylindrical shape and rectangular shape in its lateral cross section.

FIG. 18(A) is a partially longitudinal sectional view showing the basket 11 of the fuel transport container 80 which is arranged in the horizontal arrangement, in which the fuel protective container is housed and FIG. 18(B) is a lateral end view of the basket 11 of the fuel transport container 80 shown in FIG. 18(A).

In a fuel transport container 80, the basket 11 is constructed in a manner of integrally connecting basket hole elements 12 by means of a connective member. In the basket 11, each basket hole element 12 is formed with a basket hole 13 forming a chamber for housing the fuel protective container 81.

The basket 11 is accommodated in the inner hollow cylindrical chamber of the container main body 10A so that, when the fuel transport container 80 is arranged in the horizontal arrangement, the lower-side corner portion CP2 formed by the inner side walls 13*s*1, 13*s*3 contacting the fuel protective container 81 are positioned to a lower side of the fuel protective container 81 and the inner side walls 13*s*3 and 13*s*4 are inclined at a predetermined angle of, for example, substantially 45° with respect to the horizontal surface HP. The corner portion CP2 is formed as a substantially V shape so as to be fitted to a corner portion CPX of the fuel protective container 81, which is opposite to the corner portion CP2, by which the fuel protective container 81 is supported by the V shaped corner portion CP2.

Further, the basket 11 is arranged in the container main body 10A of the fuel transport container 70 so that a center axis of the basket 11 is inclined at a predetermined angle of, for example, θ° with respect to the horizontal plane HP so that a bottom portion (bottom surface) BP1 of the basket 11 is directed downward, and a top portion of the basket 11 is directed upward in the longitudinal direction.

The inclination angle θ° is, for example, substantially 30°.

A method of transporting the fuel protective container 81 housing the fuel assembly with the use of the fuel transport container 80 basically comprises a mount process for mounting the fuel protective container 81 housing the fuel assembly in a state that the fuel transport container 80 is arranged in the vertical arrangement, and a transport process for transporting the fuel transport container 80 from fuel facilities to an atomic power plant or other storage facilities while the fuel transport container 80 is arranged in the horizontal arrangement.

In the mount process, the fuel protective container 81 is inserted and mounted into the basket hole 13 of the basket hole element 12.

After the fuel protective containers 81 are inserted into the respective basket holes 13 of the basket 11, the fuel transport container 80 is arranged in the horizontal arrangement so that the inner side walls 13*s*1, 13*s*3 of the basket hole 13 contacting with the fuel protective container 81 are positioned to the lower side of the fuel protective container 81 and are inclined at the angle of 45° with respect to the horizontal plane HP, and thus, the corner portion CP2 formed by the inner side walls 13*s*1, 13*s*3 forming the V shape is adapted to support the fuel protective container 81.

Further, when the fuel transport container 80 is arranged in the horizontal arrangement, the basket hole element 12 (the basket hole 13) is arranged in the fuel transport container 80 so that the bottom portion BP1 of the basket 11 is inclined at the angle of θ° with respect to the horizontal plane HP and that the bottom portion BP1 of the basket 11 is directed downward and the top portion of the top surface side thereof is directed upward in the longitudinal direction.

After that, the fuel transport container 80 is transported while the bottom portion BP1 of the basket 11 is inclined at the angle of θ°, the bottom portion BP1 thereof is directed downward and the top portion thereof is directed upward in the longitudinal direction.

The fuel transport container 80 and the transport method of the fifth embodiment have the same construction and method as the fourth embodiment except that the fuel assembly is transported in a state of being housed in the protective container 81. The same effect as the fourth embodiment is obtained, and the fuel assembly is housed in the protective container 81, so that metallic contacting portion of the fuel assembly can be prevented from wearing due to fine vibration.

Figure 19:
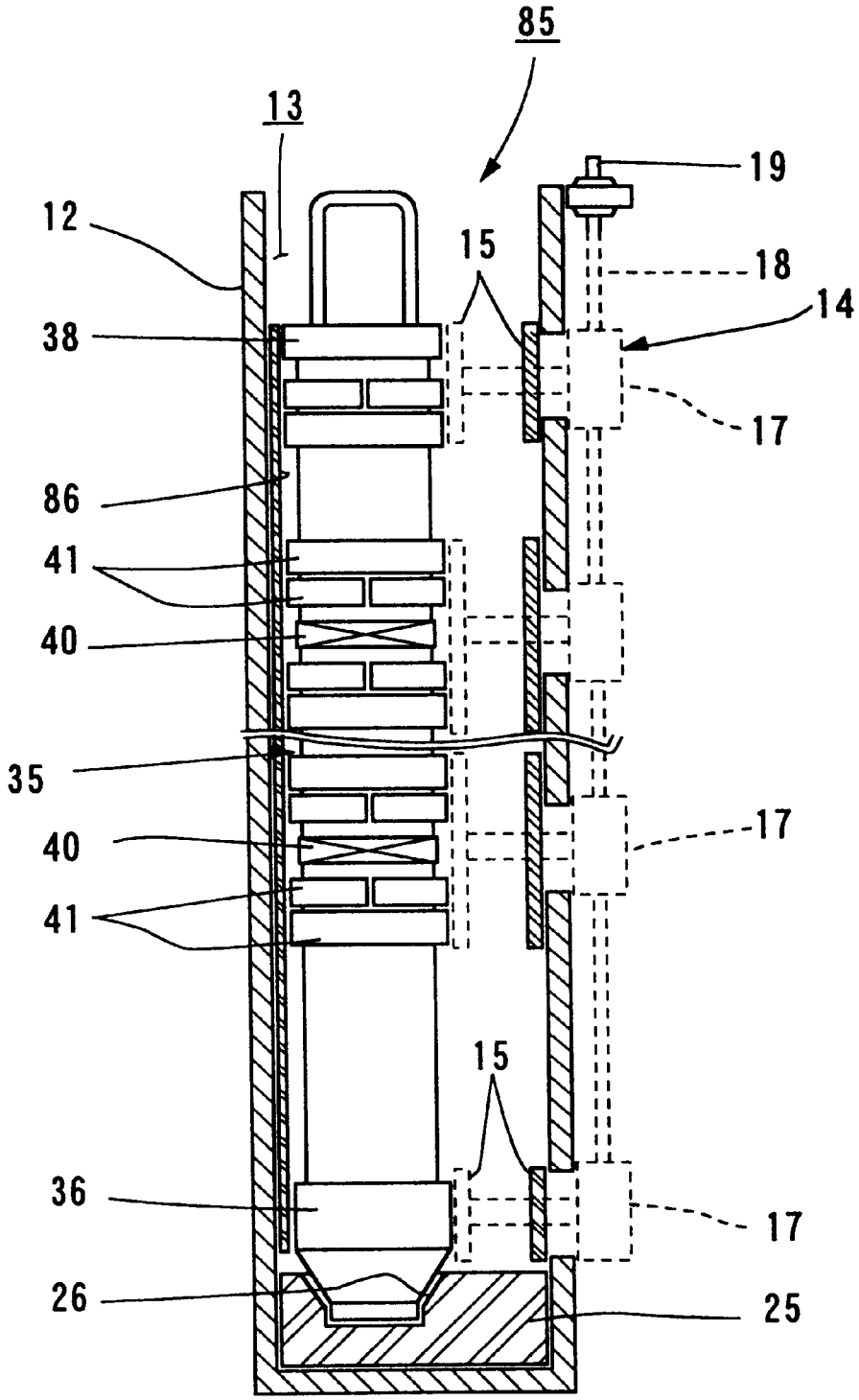
FIG. 19 is partially longitudinal sectional view showing a fuel transport container arranged in the vertical arrangement, in which a fuel assembly is housed, according to a sixth embodiment of the present invention.

FIG. 19 shows a transport container according to a sixth embodiment of the present invention.

In the transport container 85 of the sixth embodiment, the basket hole 13 of the basket 11 is provided with an intermediate member 86. The intermediate member 86 is provided as a thermal expansion absorbing means for absorbing thermal expansion of the fuel assembly 35, and has the substantially same thermal expansion coefficient as the fuel assembly 35. Other construction is the same as any of the first to third embodiments, therefore, like reference numerals are used to designate the same components, and their explanation is omitted.

In a fuel transport container 85 shown in FIG. 19, the basket hole 13 of the basket 11 is provided with an intermediate member 86 having a substantially plate-like shape at the two inner side walls 13*s*1, 13*s*3 contacting with the fuel assembly 35. The intermediate member 86 has a thermal expansion coefficient equal substantially to the fuel assembly 35 or has the same thermal expansion coefficient as a zirconium alloy. Further, the intermediate member 86 is located on the inner side walls 13*s*1, 13*s*3 of the basket hole 13 with the use of a bolt having a clearance hole so as to be freely expandable in the longitudinal direction. The basket 11 is constructed in a manner of integrally connecting many basket hole elements 12 by means of a connective member (not shown).

With the use of the fuel transport container 85 of the sixth embodiment, a transport method of the fuel assembly 35 basically comprises a mount process for mounting the MOX fuel assembly 35 in a state that the fuel transport container 85 is arranged in the vertical arrangement, and a transport process for transporting the MOX fuel assembly 35 together with the fuel transport container 85 from fuel facilities to an atomic power plant or other fuel facilities while the fuel transport container 85 is arranged in the horizontal arrangement.

Moreover, according to the transport method of this sixth embodiment, in the mount process, the intermediate member 86, which has a coefficient of linear expansion equivalent to a zirconium alloy, is provided on at least the two inner side walls 13*s*1, 13*s*3 of the basket hole 13 of the basket 11 contacting with the fuel assembly 35. Further, the intermediate member 86 is provided with the use of the bolt having the clearance hole so as to be freely expandable in the longitudinal direction with respect to the inner side walls 13*s*1, 13*s*3.

After that, the fuel assembly 35 is directly mounted in the basket hole 13 of the fuel transport container 85 which is provided with the intermediate member 86. In the transport process, the fuel assembly 35 is transported in a state that the inner side walls 13*s*1, 13*s*3 where the intermediate member 86 is provided are positioned to the lower side of the fuel assembly 35.

Since the MOX fuel assembly 35 is exothermic, the internal temperature of a fuel transport container rises up, and there is caused an elongation difference between the basket hole element 12 and the fuel assembly 35 resulting from difference in thermal expansion. In the case where the fuel assembly 35 is firmly fastened and fixedly supported by means of the fixedly supporting device, since a positional displacement is caused in the fuel spacer 40 of the fastening portion by the fastening plate and the transport separator 41, there is the possibility of affecting the fuel assembly 35.

However, in the fuel transport container 85 of the fifth embodiment, the intermediate member 86 having the same coefficient of linear expansion as the fuel assembly 35 is provided between the fuel assembly 35 and the inner side walls 13*s*1, 13*s*3 of the basket hole 13 contacting with the fuel assembly 35 so as to be freely expandable with respect to the inner side walls 13*s*1, 13*s*3 of the basket hole 13.

Therefore, the elongation difference is caused between the intermediate member 86 and the basket hole 13, however, no elongation difference is caused between the intermediate member 86 and the fuel assembly 35. Further, during the transport process, the intermediate member 86, which is positioned along the lower side of the fuel assembly 35, is adapted to directly support the fuel assembly 35. For this reason, in a case of making a comparison between a frictional force between the fuel assembly 35 and the intermediate member 86 and a frictional force between the fuel assembly 35 and the fastening plates 15, the former is overwhelmingly larger. Thus, a slide is caused in a contacting portion between the fuel assembly 35 and the fastening plates 15 in a state that the fuel assembly 35 is placed on the intermediate member 86 having no elongation difference, so that the positional displacement can be prevented from being caused in the fuel spacer 40 and the transport separator 41, which functions as the fastening portion.

In the fuel transport container 85 of the sixth embodiment, it is possible to solve the problem relative to the difference of thermal expansion when the fuel assembly 35 and the basket 11 are under high temperature. Thus, there can be provided the fuel transport container and the transport method which can safely transport the fuel assembly 35.

Figure 20:
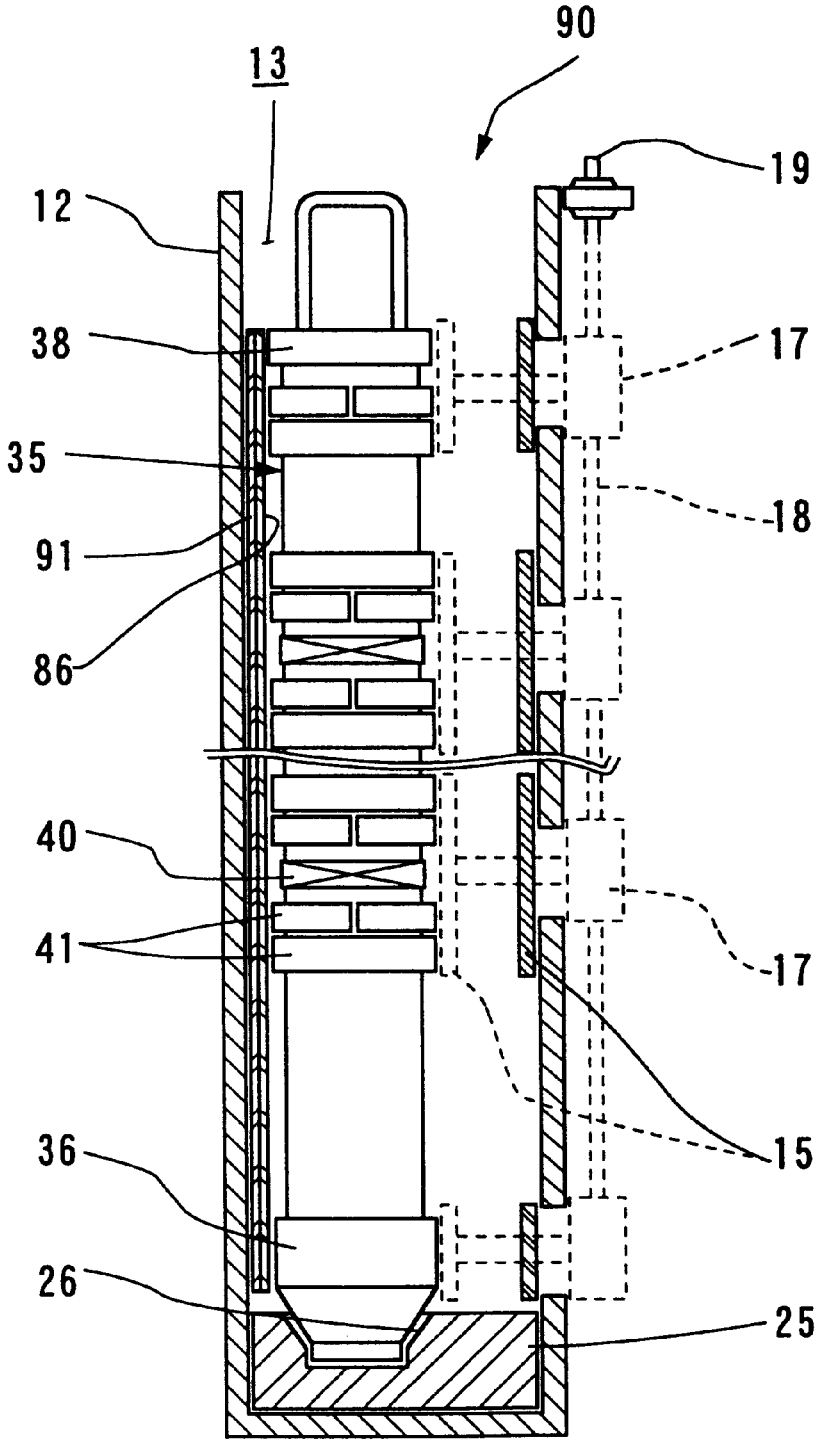
FIG. 20 is a partially longitudinal sectional view showing a fuel transport container arranged in the vertical arrangement, in which a fuel assembly is housed, according to a seventh embodiment of the present invention.

FIG. 20 shows a transport container of a reactor fuel according to a seventh embodiment of the present invention.

FIG. 20 is a longitudinal sectional view showing the fuel transport container 90 arranged in the vertical arrangement, in which the fuel assembly 35 is housed.

The transport container 90 of this seventh embodiment is provided with the intermediate member 86 which functions as thermal expansion absorbing means described above, and a buffer member 91 having a plate-like shape which functions as buffer means, in the basket hole 13 of the basket 11. The intermediate member 86 has a coefficient of thermal expansion equal substantially to the fuel assembly 35, and the buffer member 91 is adapted to absorb an impact stress acting on the fuel assembly 35. These members are provided while being laminated. The basket 11 constituting a fuel transport container 90 is constructed in a manner of integrally connecting many rectangular and cylindrical basket hole elements 12 by means of a connective member (not shown). All basket holes 13 of the basket 11 are arranged in the identical direction.

In the fuel transport container 90, the buffer member 91 such as honeycomb, rubber, resin members or the like, is provided on at least two inner walls 13*s*1, 13*s*3 of the basket hole 13 of the basket 11 contacting with the fuel assembly 35. Further, the above intermediate member 86 which has the same coefficient of linear expansion as a zirconium alloy, is provided.

With the use of the fuel transport container 90 of the seventh embodiment, a transport method of the fuel assembly 35 basically comprises a mount process for mounting the MOX fuel assembly 35 in the fuel transport container 90 which is arranged in the vertical arrangement, and a transport process for transporting the MOX fuel assembly 35 together with the fuel transport container 90 from fuel facilities to an atomic power plant or other fuel facilities while the fuel transport container 90 is arranged in the horizontal arrangement.

In the mount process, the buffer member 91 such as honeycomb, rubber, resin members or the like, is solely provided on at least the two inner side walls 13*s*1, 13*s*3 of the basket hole 13 contacting with the fuel assembly 35, or is provided thereon together with the intermediate member 86. Furthermore, the fuel assembly 35 is directly mounted in the fuel transport container 90, which is provided with the buffer member 91, without using the protective container. In the transport process, the fuel assembly 35 is transported together with the fuel transport container 90 while the inner side walls 13*s*1, 13*s*3 of the basket hole 13, onto which the buffer member 91 is provided, are positioned to the lower side of the fuel assembly 35.

In the fuel transport container 90 of the seventh embodiment, the buffer member 91 is provided in the inner side walls 13*s*1, 13*s*3 of the basket hole 13 which are positioned to the, lower side of the fuel assembly 35 during the transport process. Whereby fine vibration is absorbed, so that a metallic contacting portion of the fuel assembly 35 can be prevented from wearing due to the fine vibration.

Figure 21:
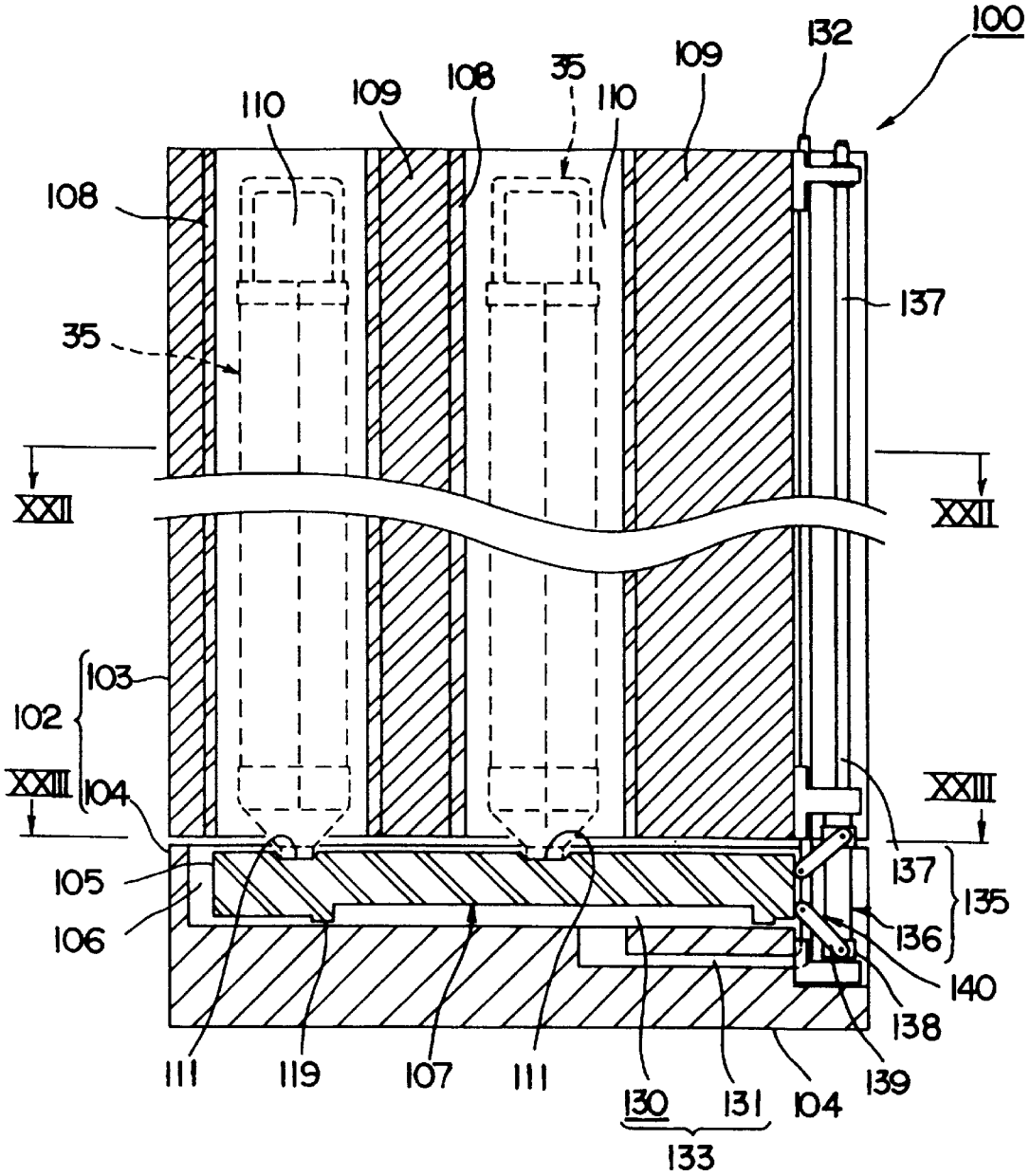
FIG. 21 is a longitudinal sectional view showing a basket of a fuel transport container arranged in the vertically arrangement according to an eighth embodiment of the present invention.

FIG. 21 is a longitudinal sectional view showing a fuel transport container arranged in the vertically arrangement according to an eighth embodiment of the present invention. In FIG. 21, a reference numeral 100 denotes a fuel transport container directly housing an MOX fuel assembly as a light water reactor fuel. The fuel transport container 100 is applicable to house a new fuel assembly of the reactor fuel such as UO2 fuel assembly in addition to the MOX fuel assembly. The fuel transport container 100 wholly has a substantially cylindrical shape and a substantially rectangular shape in its lateral cross section. The fuel transport container 100 is arranged in the vertical arrangement, as shown in FIG. 21.

The fuel transport container 100 is provided with a container main body, which is not shown in FIG. 21 and corresponds to the container main body 10A of the above first to seventh embodiments. Moreover, the fuel transport container 100 is provided with a basket 102, which has a cylindrical shaped outline coaxially housed in the inner hollow cylindrical chamber of the container main body, for directly housing the fuel assembly 35 without using a protective container for housing the fuel assembly.

The basket 102 of the fuel transport container 100 includes a basket main body 103 having the cylindrical and rectangular shape, a basket bottom plate 104 which is fixed to a bottom portion of the basket main body 103, which serves as a bottom cap body, and a fuel assembly receiving plate 105 which is interposed between the basket bottom plate 104 and the basket main body 103, which serves as a fuel support member or fuel receiving base. On the basket bottom plate 104, a housing space 106 having a substantially concave shape is recessed. The housing space 106 is adapted to house the receiving plate 105 therein so that the receiving plate 105 is capable of being floated. The housing space 106 may be formed in the bottom portion of the basket main body 103.

The basket main body 103 includes a plurality of basket hole elements 108 each of which is constructed by a rectangular tube or rectangular cylinder. Each of these basket hole elements 108 is formed with a basket hole 110 having a cylindrical and a rectangular shape in its lateral cross section. Each basket holes 110 is adapted to constitute a chamber for housing the fuel assembly.

The basket main body 103 is constructed in that the plurality of basket hole elements 108 are arranged with a predetermined intervals and combined integrally by a joining member 109 so that the basket main body 103 is formed as the substantially cylindrical shaped outline. The fuel assembly 35 is housed in the basket hole 110, and thereafter, lower side distal end portions of the fuel assemblies 35 are fitted to fuel receiving portions 111 recessed onto the receiving plate 105 so that the housed fuel assemblies 35 are located and supported in the receiving portions 111, respectively.

Figure 22:
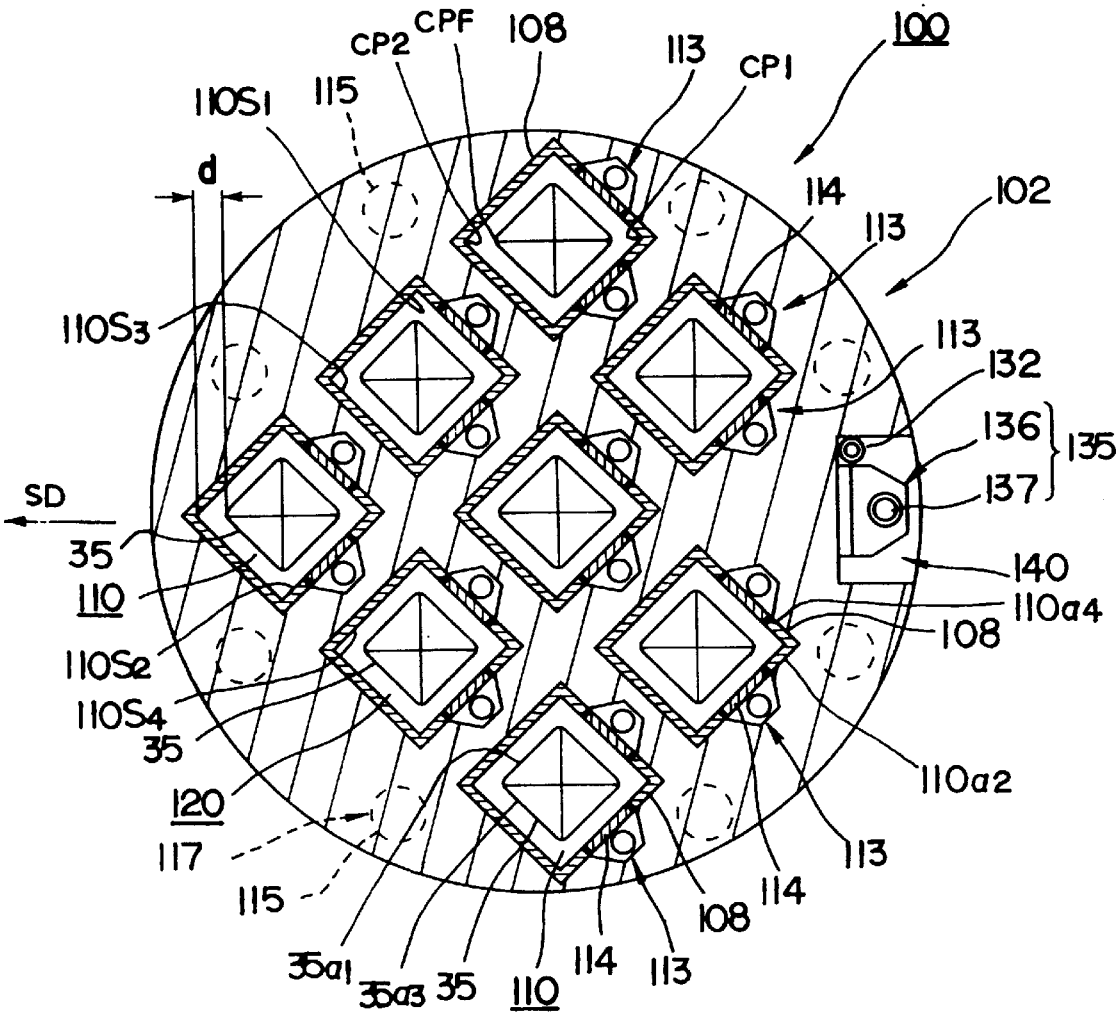
FIG. 22 is a lateral sectional view taken on line XXII—XXII of FIG. 21.

The fuel assembly 35 inserted into each basket hole 110 of the basket main body 103 is fastened and fixedly supported by means of a fixedly supporting device 113 as shown in FIG. 22. The plurality of fixedly supporting devices 113 are attached to two adjacent outer side walls 110*a*2, 110*a*4 of the basket hole element 108 in the axial direction with a given interval. The fixedly supporting devices 113 support a fastening plate 114 so that the fastening plates 114 move close to the housed fuel assemblies 35 in the basket holes 110 and far therefrom, respectively, simultaneously to the first embodiment.

The fastening directions of the fixedly supporting device 113 provided in each basket hole element 108 are first and second directions common to all basket holes 110. More specifically, in FIG. 22, the first fastening direction is a direction from the obliquely left side downward, which is parallel to the outer side wall 110*a*2, and the second direction is a direction from the obliquely left side upward, which is parallel to the outer side wall 110*a*4. The first and second fastening directions are orthogonal each other.

For example, in a case where the fuel assembly 35 housed in the basket hole 110 is shifted so that two adjacent side surfaces 35*a*1, 35*a*3 which is opposite to inner side walls 110*s*1, 110*s*3 of the basket hole 110, corresponding to the inner side walls 13*s*1, 13*s*3 of the first embodiment, is in contact therewith, respectively, when the fixedly supporting device 113 is driven, each fastening plate 114 moves close to the fuel assembly 35 housed in the basket hole 110 and far therefrom along a direction orthogonal to an insertion direction of the fuel assembly 35 corresponding to an axial direction of the basket 102 between a retreat position and a projection position in the basket hole 110. When the fastening plate 114 is projected into the basket hole 110 by the drive of the fixedly supporting device 113 and moved close to the fuel assembly 35 housed in the basket hole 110, the fuel assembly 35 housed therein is pressed by the fastening plate 114, and is in contact with the inner side walls 110*s*1, 110*s*3 of the basket hole 110.

As a result of that, a corner portion CPF of the fuel assembly 35 formed by two side surfaces 35*a*l, 35*a*3, which has a substantially V shape in its lateral cross section, is fitted to a corner portion CP2 having a substantially V shape in lateral cross section formed by the inner side walls 110*s*1, 110*s*3 so that the fuel assembly 35 is fixedly supported to the basket hole 110. In FIG. 22, a reference symbol "d" denotes a distance in which the fuel assembly 35 inserted into the basket hole 110 is shifted. In addition, a direction along which the fuel assembly 35 housed in the basket hole 110 moves toward the corner portion CP2 of the basket hole 110 is referred as "shifting direction SD" hereinafter.

When actually transporting the fuel assembly 35, the fuel transport container 100 is arranged such that the axial direction of the basket 102 is parallel to the horizontal plane HP and each of the corner portions CP2 of the basket holes 110 is positioned below the housed fuel assembly 35. That is, the left side of FIG. 22 is situated below. In addition, this arrangement of the fuel transport container 100, wherein the axial direction of the basket 102 is parallel to the horizontal plane HP and each of the corner portions CP2 of the basket holes 110 is positioned to a lower side of the housed fuel assembly 35, is defined as "horizontal arrangement" in the eighth embodiment and a ninth embodiment of this specification.

Figure 24:
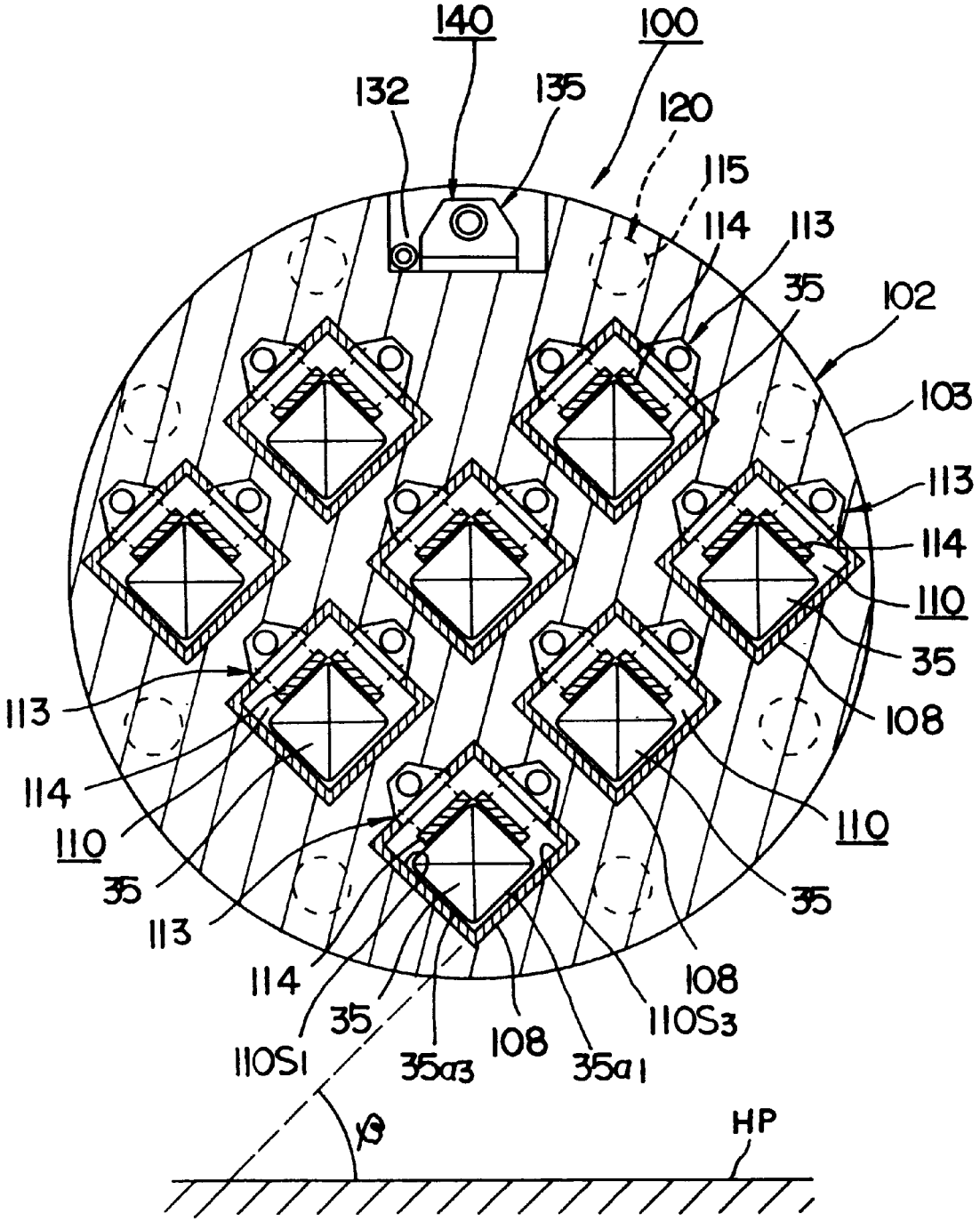
FIG. 24 is a lateral sectional view corresponding to FIG. 22 showing the basket arranged in the horizontal arrangement.

FIG. 24 shows the basket 102 of the fuel transport container 100 which is arranged in the horizontal arrangement, when transporting the fuel assembly 35. During the transport process, the basket 102 is arranged so that the inner side wall 110*s*3 of the basket hole 110 is inclined at an acute angle of β°, for example, at an angle of substantially 45° with respect to the horizontal plane HP.

FIG. 22 shows an example in which the fixedly supporting device 113 is located on adjacent two outer side walls 110*a*2, 110*a*4 of the basket hole 110 (basket hole element 108) forming V shape from the outside. The fixedly supporting device 113 may be provided on the diagonal of the basket hole element 108 so that the fixedly supporting device 113 is located, when the fuel transport container 100 is arranged in the horizontal arrangement, on an upper-side corner portion CP1 formed by inner side walls 110*s*2, 110*s*4 which are opposite to the inner side walls 110*s*1, 110*s*3 wherein the corner portion CP1 is positioned to an upper side of the housed fuel assembly 35.

In the case where the fixedly supporting device 113 may be locate on the diagonal of the basket hole element 108, the lateral cross section of the fastening plate 114 form a V shape, and the fastening plate 114 may be reciprocated from the diagonal direction in each basket hole 110. Therefore, there is no need of fastening the fuel assembly 35 from two different directions.

The bottom surface of the basket main body 103 is provided integrally with a plurality of connective rods 115 at a proper interval in a circumferential direction, and these connective rods 115 project downward. These connective rods 115 are fitted into connective holes 116 formed in the basket bottom plate 104 shown in FIG. 23 so that the basket main body 103 and basket bottom plate 104 are firmly connected. The connective holes 116 of the basket bottom plate 104 are formed at a position corresponding to the connective rods 115 so that a connecting unit 117 is constructed. The connecting unit 117 may be constructed such that the connective rods are provided in the basket bottom plate 104, and the connective holes are formed in the basket main body 103, or may be constructed such that the basket main body 103 and the basket bottom plate 104 are fastened together by means of, for example, a bolt. There may be considered various connecting units.

Figure 23:
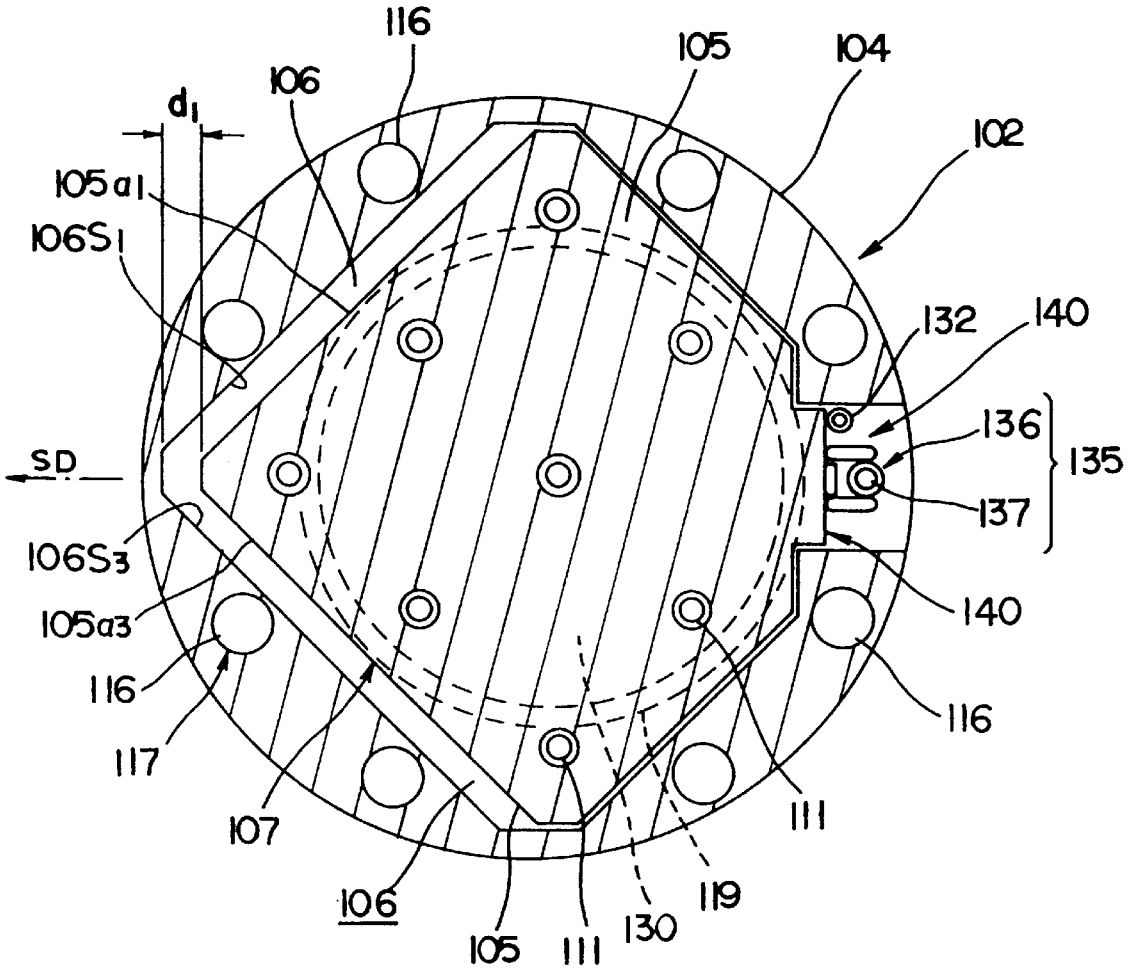
FIG. 23 is a lateral sectional view taken on line XXIII—XXIII of FIG. 21.

On the other hand, as shown in FIG. 23, the housing space 106 formed on the basket bottom plate 104 is larger by a shift direction dimension d1 than the fuel receiving plate 105 in view of the shift along the shifting direction SD by the fuel receiving plate 105. The shift direction dimension d1 is set so as to become equal to the shift distance d of the fuel assembly 35. The housing space 106 has the substantially similar shape to the fuel receiving plate 105. The shape of the fuel receiving plate 105 is, for example, substantially pentagonal in its lateral cross section. Two side surfaces 105*a*1, 105*a*3 of the fuel receiving plate 105 are substantially parallel to the side surfaces 35*a*1, 35*a*3 and are arranged to the shift side of the fuel receiving plate 105. The side surfaces 105*a*1, 105*a*3 of the fuel receiving plate 105 also forms as substantially V shaped portion and are substantially opposite to two inner side walls 106*s*, 106*s*3 of the housing space 106 forming as substantially V shaped portion. Therefore, the shift direction dimension dl corresponds to a gap between the two side surfaces 105*a*1, 105*a*3 of the fuel receiving plate 105 and the two inner side walls 106*s*1, 106*s*3 of the support member housing space 106.

Namely, the fuel receiving plate 105 is located in the support housing space 106 so as to be movable by the shift distance of the shift of the fuel assembly 35 by a shifting operation of a drive device 135.

As shown in FIG. 23, when the fuel receiving plate 105 is biased toward the corner portion CP1 side of the basket hole 110, that is, the right side in the support housing space 106, the fuel receiving portion 111 is positioned in the center of each basket hole 110. Thus, when the fuel assembly 35 is inserted into the center of the basket hole 110, the fuel assembly 35 is fitted into the fuel receiving portion 111 so as to be placed thereon. The fuel receiving portion 111 is formed so as to be enlarged upward, and then, is formed like a substantially taper shape, dish shape or trumpet shape.

Moreover, a support leg portion 119 having a substantially ring, truss or skirt shape is provided on the lower surface of the receiving plate 105 so that the support leg portion 119 projects therefrom. A pressurized gas supply space 130 is formed on the bottom surface of the housing space 106 surrounded by the support leg portion 119. As shown in FIG. 21, a gas supply hole 131 is opened so as to face the pressurized gas supply space 130. The gas supply hole 131 is connected to a gas supply source (not shown) via a gas supply pipe 132 so that a floating unit 133 for floating the fuel receiving plate 105 is constructed. The floating unit 133 supplies a pressurized gas such as high pressure air from the upper side of the basket 102 to the pressurized gas supply space 130. Furthermore, the floating device 133 constitutes a fuel supporting device 107 in cooperation with the fuel receiving plate 105.

At the side of the fuel receiving plate 105, a drive device 135 for moving the fuel receiving plate 105 is provided. The drive device 135 has a drive mechanism 136 connected to the fuel receiving plate 105 so as to drive the drive mechanism 136 by means of a rotating shaft 137.

The rotating shaft 137 is located at the side of the basket 102, and is linearly moved from the above of the basket 102 and is rotated by means of the drive of a motor.

The rotating shaft 137 of the drive mechanism 136 is provided with a screw shaft which is screwed at right and left sides thereof. A pair of boss-like slide blocks 138 is connected to the screw shaft by means of a screw. Each of the slide blocks 138 is connected to the fuel receiving plate 105 via a connective link 139 of FIG. 1, and thus, the four-joint drive link mechanism 136 is constructed.

The drive mechanism 136 is adapted to rotate the rotating shaft 137 so that, by the rotation of the rotating shaft 137, the pair of slide blocks 138 is mutually moved to a closing or separating direction, and the fuel receiving plate 105 is freely reciprocated with the movement of the slide block 138 between a fuel assembly receiving position for receiving the fuel assembly 35 and a one-side biasing position. The one-side biasing position is a position such that the outer surfaces 35*a*1, 35*a*3 of the fuel assembly 35 are in contact with the inner side walls 110*s*1, 110*s*3 of the basket hole 110, respectively. In place of the drive link mechanism, various reciprocating mechanisms such as pinion rack mechanism, worm gear mechanism may be used as the drive mechanism 136.

The drive device 135 and the fuel supporting device 107 including the floating device 133 constitutes a fuel one-side biasing device 140. The fuel one-side biasing device 140 is adapted to move all of the fuel assemblies 35 inserted into each basket holes 110 so that the distal end portions of all fuel assemblies 35 are simultaneously shifted so that the respective side surfaces 35*a*1, 35*a*3 of the respective fuel assemblies 35 are in contact with the respective inner side walls 110*s*1, 110*s*3 of the respective basket holes 110.

Next, a method of transporting the fuel assembly will be described hereinafter.

The method of transporting the fuel assembly 35, at least, comprises steps of: mounting the MOX fuel assembly 35 in the fuel transport container 100 while the fuel transport container 100 is arranged in the vertical arrangement; and transporting the fuel transport container 100 from fuel processing facilities to an atomic power plant or other storage facilities, or transporting it from these storage facilities to the atomic power plant or other storage facilities while the fuel transport container 100 is arranged in the horizontal arrangement.

In the fuel mount process of the fuel assembly 35, the fuel receiving plate 105 housed in the basket 102 is set in a state as shown in FIG. 21 and FIG. 23, and the fuel receiving plate 105 is situated at a state of being shifted (biased) to the right side in the supporter housing space 106, wherein the right side direction is opposite to the shifting direction SD. In the state that the fuel receiving plate 105 is biased to the right side, the fuel assembly 35 is inserted into the center of each basket hole 110 so that the distal end portion of each fuel assembly 35 is fitted into and placed on each fuel receiving portion 111 of the fuel receiving plate 105.

After all fuel assemblies 35 are inserted into the basket holes 110 of the basket 102, a pressurized gas, such as high pressure air is supplied from the gas supply source to the pressurized gas space 130 below the fuel receiving plate 105. During the supply of the pressurized gas, each fuel receiving plate 105, on which the fuel assembly 35 is placed, is slightly floated by means of the floating device 133. While the fuel receiving plate 105 is floated, when the drive device 135 is driven, the fuel receiving plate 105 is laterally moved along the shifting direction SD from the fuel assembly receiving position to the one-side biasing position by means of the drive mechanism 136, and simultaneously, the bottom portions (distal end portion) of all the fuel assemblies 35 housed in each basket hole 110 are moved and biased (shifted) so that the respective side surfaces 35*a*1, 35*a*3 of the respective fuel assemblies 35 are in contact with the respective inner side walls 110*s*1, 110*s*3 of the respective basket holes 110, by which the corner portion CPF of each fuel assembly 35 is fitted to the corner portion CP2 of each basket hole 110.

Next, the fixedly supporting device 113 provided on each basket hole element 108 is driven for each fuel assembly 35 so that the fastening plate 114 is projected from the retreated position. Thus, each fuel assembly 35 is pressed and fastened so that the fuel assembly 35 is fixedly supported to the basket hole 110.

In this embodiment, when fixedly supporting each fuel assembly 35 to each basket hole 110, since the bottom portion of the fuel assembly 35 is already biased (shifted) by means of the one-side biasing unit 140 along the shifting direction SD so that the respective side surfaces 35*a*1, 35*a*3 of the respective fuel assemblies 35 are in contact with the respective inner side walls 110*s*1, 110*s*3, it is possible to stably, smoothly and easily perform the fixedly supporting operations of all fuel assemblies 35 by fastening the respective fuel assemblies 35 by means of the respective fastening plates 114.

As described above, the fuel assembly 35 housed in each basket hole 110 is successively fastened and fixedly supported to each basket hole 110 by means of the fixedly supporting device 113, and thereby, all fuel assemblies 35 can be fixedly supported by means of the fixedly supporting device 113. Then, after fixedly supporting all fuel assemblies 35 to all of the basket holes 110, respectively, the fuel transport container 100 is transported, while the fuel transport container 100 is arranged in the horizontal arrangement, from each fuel facility to an atomic power plant or other fuel facilities.

FIG. 24 is a lateral sectional view corresponding to FIG. 22 showing the basket arranged in the horizontal arrangement.

Figure 25:
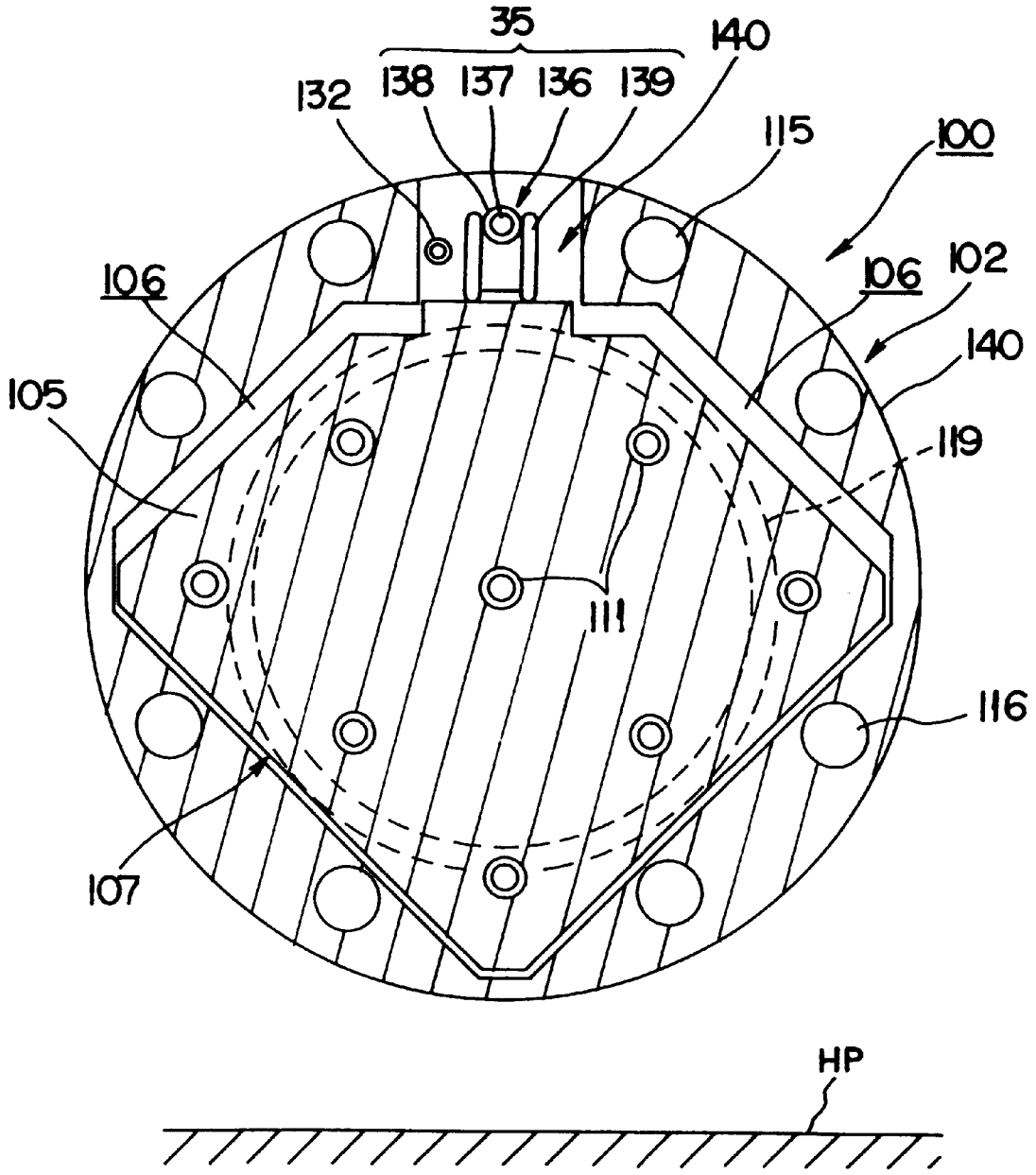
FIG. 25 is a lateral sectional view corresponding to FIG. 23 and showing the basket arranged in the horizontal arrangement.

As shown in FIG. 24, the fuel assembly 35 is biased so that the respective side surfaces 35*a*1, 35*a*3 of the respective fuel assemblies 35 are in contact with the respective inner side walls 110*s*1, 110*s*3 of the respective basket holes 110 by means of the fuel one-side biasing device 140, and then, is fastened and fixedly supported by means of the fastening plate 114 of the fixedly supporting device 113. At this time, two adjacent inner side walls 110*s*1, 110*s*3 of the basket hole 110 contacting with the fuel assembly 35 are positioned to the lower side of the fuel assembly 35 so as to form the V shape and is kept while being inclined at an acute angle of β°, for example, at an angle of substantially 45° to the horizontal plane HP. The fuel assembly 35, which is fixedly supported by means of the fixedly supporting device 113, contacts with the V shaped inner side walls 110*s*1, 110*s*3 of the basket hole 110 inclined at the acute angle β° of substantially 45° to the horizontal plane HP so that the own weight of the fuel assembly 35 is supported. In addition, as shown in FIG. 25, the weight of the fuel receiving plate 105 is supported by the two inner side walls 106*s*1, 106*s*3.

According to the transport method described above, in the fuel transport process, two inner side walls 110*s*1, 110*s*3 of the basket hole 110 contacting with the fuel assembly 35 are positioned to the lower side of the fuel assembly 35 which is biased so that the respective side surfaces 35*a*1, 35*a*3 of the respective fuel assemblies 35 are in contact with the respective inner side walls 110*s*1, 110*s*3 of the respective basket holes 110, and the axial line of the basket hole 110 is inclined at the angle of substantially 45° to the horizontal plane HP. Thus, all of the fuel assemblies 35 are transported while being stably supported by two inner side walls 110*s*1, 110*s*3 of the basket hole 110 forming the V shaped portion.

According to the transport method described above, when the fuel transport container 100 is in a state of being arranged in the horizontal arrangement during transporting process, each fuel assembly 35 and the fuel receiving plate 105 which is a part of the fuel one-side biasing device 140 are supported by the V shaped two inner side walls 110*s*1, 110*s*3 of the basket hole 110 of the basket and the two inner side walls 106*s*1, 106*s*2 of the support housing space 106 thereof. Therefore, the fuel assembly 35 can be very stably supported with respect to vibration during transporting process.

Accordingly, in the fuel transport container 100 of this embodiment, the fastening force of each of the fixedly supporting devices 113 can be reduced as compared with the conventional fuel transport container from the top side of each of the fuel assemblies 35. Thus, it is possible to make small each of the fixedly supporting devices 113 of this embodiment compared with each of the conventional fixedly supporting devices, and to make small a space occupied by providing the fixedly supporting devices 113, so that there can be provided the fuel transport container 100 which is compact and has a large capacity.

Moreover, in the transport container 100 shown in FIG. 21 to FIG. 25, the fuel assembly 35 is directly housed in the basket hole 110 of the fuel transport container 100. Since the fuel assembly 35 is directly housed in the basket hole 110, it is possible to make no use of the fuel protective container, thereby making the fuel transport container 100 more compact. Thus, even if the fuel transport container 100 is made compact, it is possible to collectively and simultaneously transport a plurality of fuel assemblies 100 by using the compact sized fuel transport container 100.

In this embodiment, without housing the fuel assembly 100 in the fuel protective container, there is provided the fuel one-side biasing device 140 which can solve the problem caused by biasing each fuel assembly 35 so that the respective side surfaces 35*a*1, 35*a*3 of the respective fuel assemblies 35 are in contact with the respective inner side walls 110*s*1, 110*s*3 of the respective basket holes 110 of the basket 102. The problem is the biggest matter caused when transporting the fuel assembly 35 which is in a state of being directly housed in the basket hole 110 of the fuel transport container 100. As a result of that, it is possible to make the fuel transport container 100 compact and large capacity, thereby reducing a fuel transport cost for transporting the fuel assemblies 35.

In this embodiment, there is described the fuel transport container 100 having means for housing the new MOX fuel assembly 35 directly in the fuel transport container 100 by means of biasing the new MOX fuel assembly 35 so that the side surfaces 35*a*1, 35*a*3 of the fuel assembly 35 is in contact with the inner side walls 110*s*1, 110*s*3 of the basket hole 110 and transporting the fuel transport container 100 in which the fuel assembly 35 is housed, without housing the fuel protective container in the fuel protective container and housing the fuel protective container in the fuel transport container.

The problem relative to biasing the fuel assembly is caused in a case where the fuel protective container housing, for example, four fuel protective is used. The fuel transport container 100 and the transport method for using the fuel transport container of this embodiment is applicable to the case where the fuel protective container is used.

Figure 26:
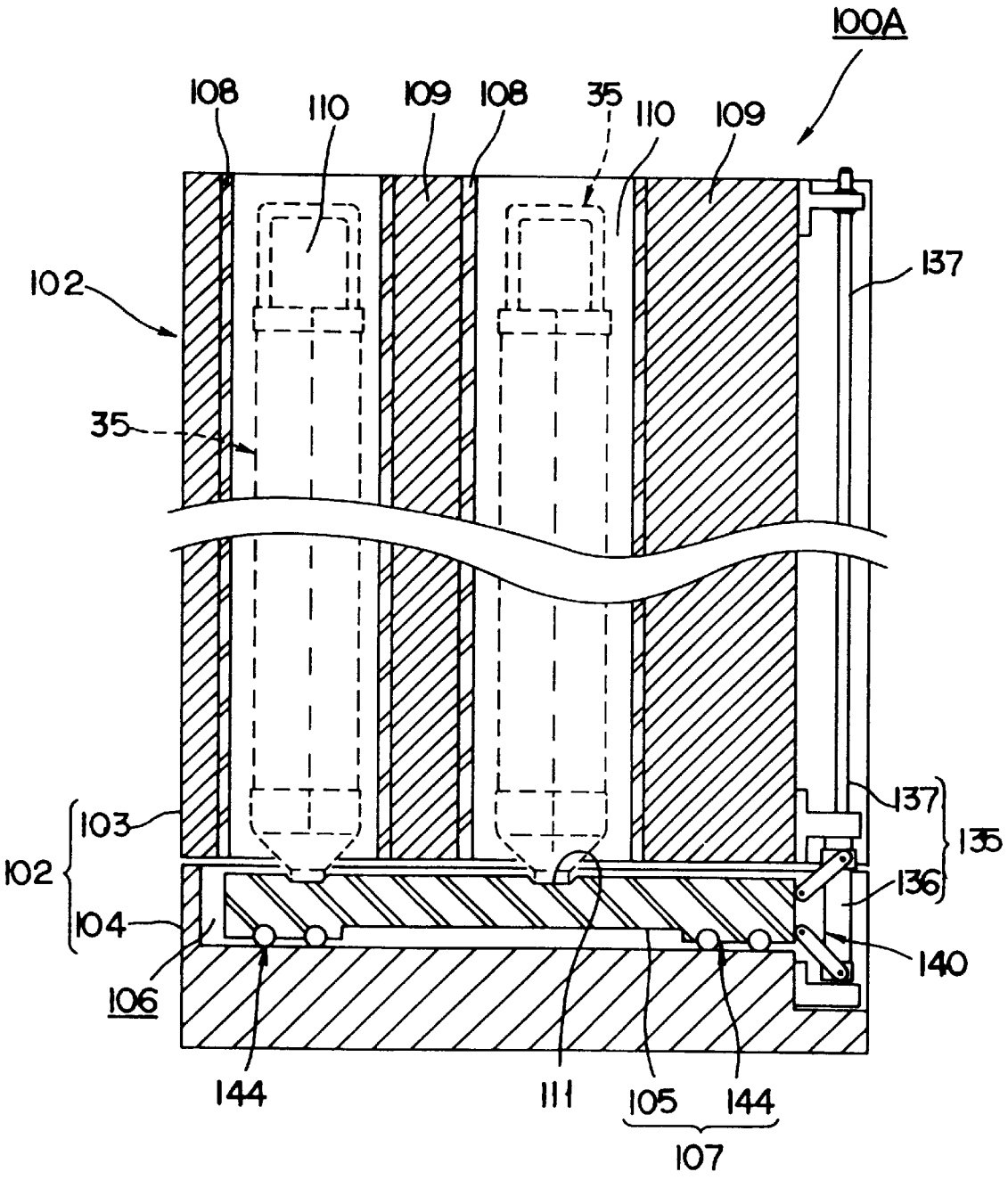
FIG. 26 is a longitudinal sectional view showing a fuel transport container arranged in the vertically arrangement according to a modification of the eighth embodiment.

Further, in the transport container 100 shown in FIG. 21, the floating device 133 for floating the fuel receiving plate 105 is provided on the bottom portion of the basket 102 of the fuel transport container 100, and the floating device 133 is included in the fuel supporting device 107. In place of including the floating device 133 in the fuel supporting device 107, as shown in FIG. 26 of the fuel transport container 100A in FIG. 26, the fuel receiving plate 105 may be supported by a slide supporting device 144. The slide supporting device 144 is provided in the fuel supporting device 107, and thereby, the fuel receiving plate 105 is stably and smoothly supported in the housing space 106 so as to be slidable (shifted) along the shifting direction SD and an opposite direction of the shifting direction SD. The slide supporting device 144 is constructed by interposing rollers, bearings or other similar slidable members between the fuel receiving plate 105 and the support housing space 106.

As shown in FIG. 26, the slide supporting device 144 is attached to the fuel supporting device 107, and the fuel receiving plate 105 is adapted to be supported via the slide supporting device 144 to the support housing space 106 so as to be freely slidable therein along the shifting direction SD and the opposite direction.

Since the fuel receiving plate 105 housed in the support housing space 106 is supported thereto via the slide supporting device 144, the fuel receiving plate 105 smoothly slides on the bottom surface of the housing space 106 by means of the drive device 135 between the fuel assembly receiving position and the one-side biasing position, thereby biasing the fuel assembly 35 so that the side surfaces 35*a*1, 35*a*3 of the fuel assembly 35 is in contact with the inner side walls 110*s*1, 110*s*3 of the basket holes 110.

Figure 27:
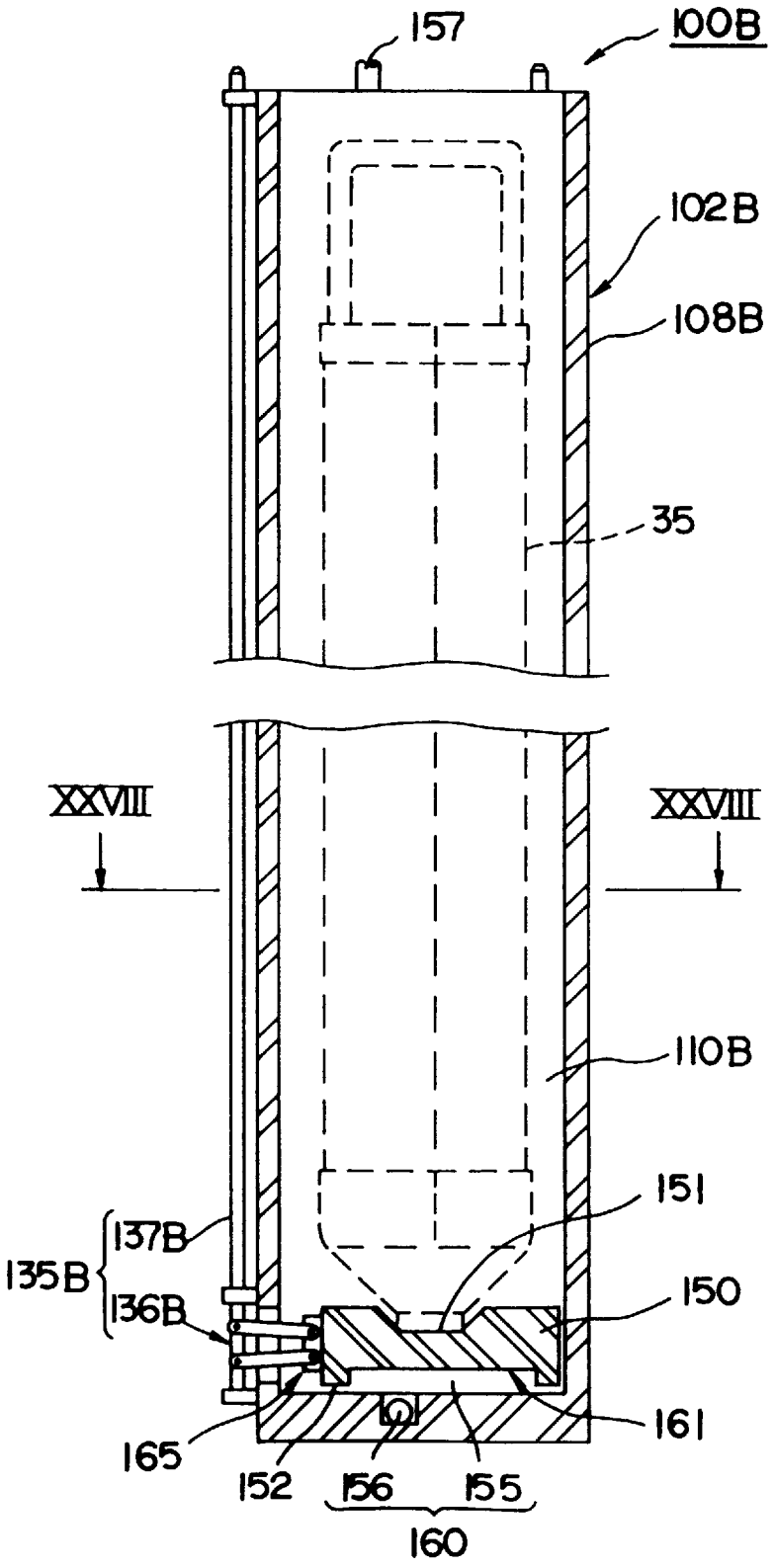
FIG. 27 is a longitudinal sectional view showing a basket of a transport container arranged in the vertical arrangement according to a ninth embodiment of the present invention.
Figure 28:
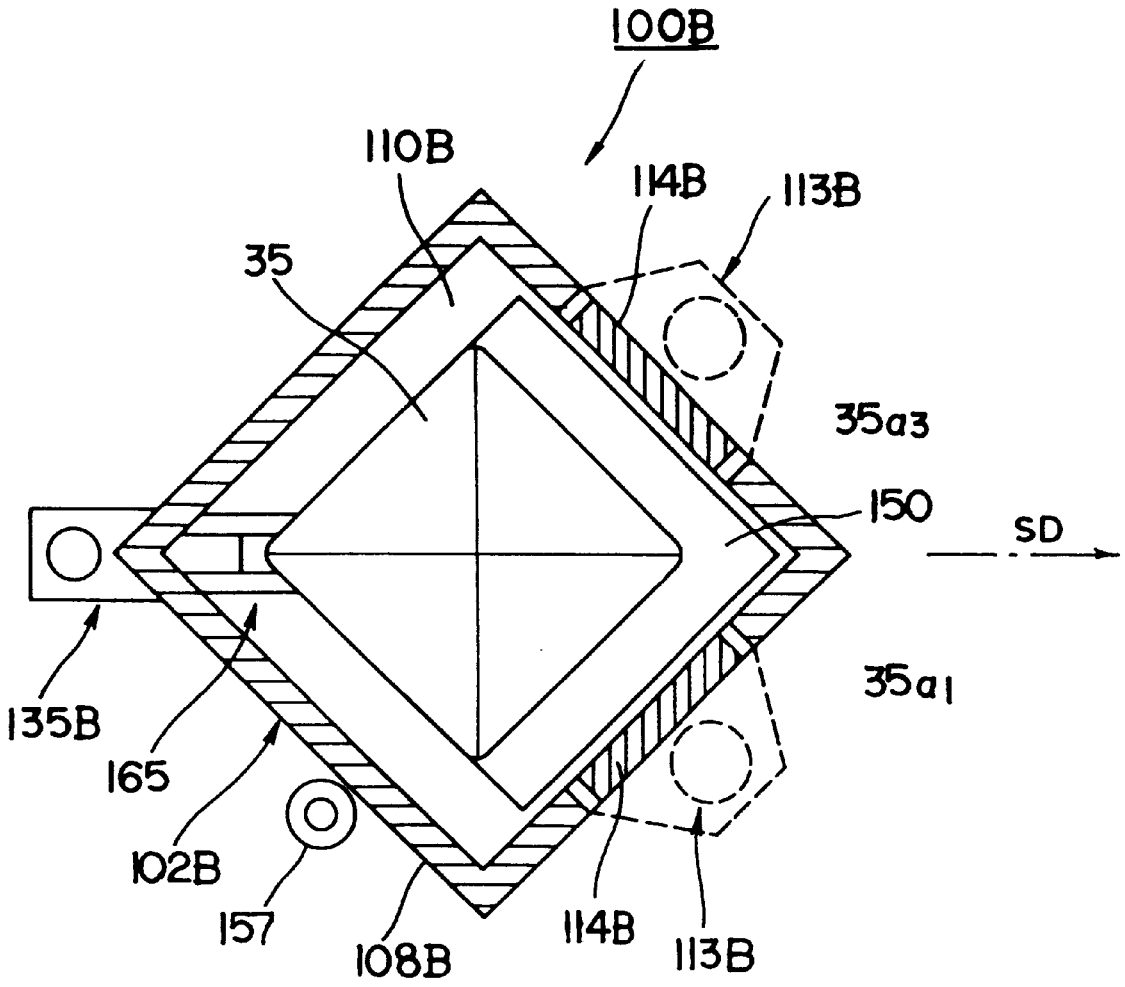
FIG. 28 is a lateral sectional view taken on line XXVIII—XXVIII of FIG. 27.

FIG. 27 and FIG. 28 are views showing a transport container according to a ninth embodiment of the present invention. That is, FIG. 27 is a longitudinal sectional view showing a basket 102B of the transport container 100B arranged in the vertical arrangement according to the ninth embodiment of the present invention and FIG. 28 is a lateral sectional view taken on line XXVIII—XXVIII of FIG. 27.

In the fuel transport container 100B of this ninth embodiment, a fuel receiving base 150 constituting a fuel support member having, for example, substantially rectangular shape in its lateral cross section is independently located on a bottom portion of a basket hole 110B of each basket hole element 108B of the basket 102B. On upper surface of the fuel receiving base 150, a fuel receiving portion 151 is recessed. The distal end portion of the fuel assembly 35 is fitted and positioned onto the fuel receiving portion 151, and then, is placed thereon.

Moreover, a support leg portion 152 having a substantially ring, truss or skirt shape is provided on the lower surface of the receiving base 150 so that the support leg portion 152 projects therefrom. A pressurized gas supply space 155 is formed on the bottom surface of the basket hole 110B surrounded by the support leg portion 152. As shown in FIG. 27, a gas supply hole 156 is opened so as to face the pressurized gas supply space 155. The gas supply hole 156 is connected to a gas supply source (not shown) via a gas supply pipe 157 so that a floating unit 160 for floating the fuel receiving base 150 is constructed. Furthermore, the floating device 160 constitutes a fuel supporting device 161 in cooperation with the fuel receiving base 150.

The floating device 160 is included in the fuel supporting device 161. By driving the floating device 160, a pressurized gas, such as high pressure air is supplied from the gas supply source to the pressurized gas space 155 below the fuel receiving base 150. During the supply of the pressurized gas, the fuel receiving base 150 is shifted up so that the fuel assembly 35 supported on the fuel receiving base 150 is adapted to be slightly floated together therewith.

On the other hand as shown in FIG. 28, a drive device 135B for moving the fuel receiving base 150 is independently located on an extension of the diagonal of the fuel receiving base 150 for each basket hole 110B. The drive device 135B has a drive mechanism 136B such as a hour-joint drive link mechanism, connected to the fuel receiving base 150 so as to drive the drive mechanism 136B by means of a rotation of a rotating shaft 137B. That is, the drive mechanism 136B is adapted to rotate the rotating shaft 137B so that, by the rotation of the rotating shaft 137B, the fuel receiving base 150 is freely reciprocated between the fuel assembly receiving position for receiving the fuel assembly 35 and the one-side biasing position of the eighth embodiment.

The drive device 135B and the fuel supporting device 161 including the floating device 160 constitutes a fuel one-side biasing device 165. The fuel one-side biasing device 165 drives the floating device 160 in cooperation with the drive device 135B so that the fuel assembly 35 is smoothly slid along the shifting direction SD orthogonal to the insertion direction of the fuel assembly 35 into the basket hole 110B. As a result of that, the lower side distal end portion of -the fuel assembly 35 inserted into the basket hole 110B is shifted so that the side surfaces 35*a*1, 35*a*3 of the distal end portion of the fuel assembly 35 are in contact with the inner side walls 110*s*1, 110*s*3 of the basket hole 110B.

In the fuel transport container 100B of this embodiments, each basket hole element 108B (each basket hole 110B) is provided with the fuel one-side biasing device 165, so that the respective lower side portions (distal end portions) of the respective fuel assemblies 35 inserted in respective basket holes 110B can be individually biased so that the respective side surfaces 35*a*1, 35*a*3 of the lower side distal end portion of the respective fuel assemblies 35 are in contact with the respective inner side walls 110*s*1, 110*s*3 of the respective basket holes 110B.

When the lower side portion of each fuel assembly 35 is biased to the one-side biasing position, at the substantially same time with respect to the biasing operation, the fixedly supporting device 113B is driven, so that the fastening plate 114B of the fixedly supporting device 113 presses the fuel assembly 35, and then contacts it with the inner side walls 110*s*1, 110*s*3 the basket hole 110B, by which the fuel assembly 35 is fixedly supported to the basket hole 110B. In addition, the plurality of fixedly supporting devices 113B are provided to two adjacent outer side walls 110*a*2, 110*a*4 of the basket hole element 108B in the axial direction with a given interval.

In the fuel transport container 100B, it is possible to bias the lower side portion of the fuel assembly 35 to the one side biasing portion while fixedly supporting the fuel assembly 35, or to fixedly support the fuel assembly 35 after being biased to the one side biasing portion. Thus, the fuel assembly 35 can be biased to the one side biasing portion and fixedly supported to the basket hole 110B with a degree of freedom and in more safely. Whereby it is possible to solve the problem relative to the one-side biasing of the fuel assembly, and to make the fuel transport container 100B compact and large capacity, thereby reducing the fuel transport cost for transporting the fuel assemblies 35.

In addition, the fuel assembly 35 is mounted into the fuel transport container 100B while the transport container is longitudinally arranged.

After each fuel assembly 35 is inserted into each basket hole 110B of the basket 102B, the pressurized gas is supplied from the gas supply source to the pressurized gas space 155 below the fuel receiving base 150. During the supply of the pressurized gas, each fuel assembly 35 is slightly floated together with the fuel receiving base 150. While the fuel receiving base 150 is floated, when the drive device 135B is driven, the fuel receiving base 150 is laterally moved along the shifting direction from the fuel assembly receiving position, as shown in FIG. 28, to the one-side biasing position by means of the drive device 135B, and simultaneously, the lower side end portions (distal end portion) of each the fuel assembly 35 housed in each basket hole 110B is moved and biased (shifted) so that the side surfaces 35*a*1, 35*a*3 of the lower side end portion of each fuel assembly 35 is in contact with the inner side walls 110*s*1, 110*s*3 of each basket hole 110B.

Simultaneously with the one-side biasing operation, or after the one-side operation, the fixedly supporting device 113B provided on each basket hole element 108B is driven so that each fastening plate 114B is projected from the retreated position. Thus, each fuel assembly 35 is pressed by each fastening plate 114B so as to be biased to the one-side biasing position over the entire length thereof. As a result of that, the inner side surfaces 35*a*1, 35*a*3 of each basket hole 35 forming the V shaped portion is in contact with the inner side walls 110*s*1, 110*s*3 of each basket hole 110B forming the V shaped portion over the entire length thereof.

While the inner side surfaces 35*a*1, 35*a*3 of each fuel assembly 35 is in contact with the inner side walls 110*s*1, 110*s*3 of each basket hole 110B, each fuel assembly 35 is fastened by each fastening plate 114B of each fixedly supporting device 113B so that each fuel assembly 35 is stably and fixedly supported to each basket hole 110B. In the fuel transport container 100B, the fuel one-side biasing device 165 and the fixedly supporting device 113B are provided for each of the basket holes 110B, so that the fuel assemblies 35 are capable of being biased to the one-side biasing portion while the fuel assemblies 35 being fixedly supported to the basket holes 110B, respectively, or the fuel assemblies 35 are capable of being fixedly supported to the basket holes 110B after the one-side biasing operation. Therefore, it is possible to improve a degree of freedom in handling the fuel assembly 35.

Obviously, many modifications and variations of the present invention are possible in the light of the above teachings. It is therefore to be understood that within the scope of the appended claims in the invention may be practiced otherwise than as specifically described.

What is claimed is:

1. A method of transporting a fuel transport container having a basket, the basket having a basket hole in which a fuel assembly is housed, the fuel assembly having four outer side surfaces and a substantially rectangular lateral cross-sectional shape, said method comprising the steps of:

inserting the fuel assembly into the basket hole of the basket, the basket hole having four inner side walls and a substantially rectangular lateral cross-sectional shape, the four side walls of the basket hole having two adjacent inner side walls providing a substantially V-shaped inner corner portion, the four outer side surfaces of the fuel assembly having two adjacent outer side surfaces providing a corner portion which is opposite to the V-shaped inner corner portion of the basket hole, the corner portion of the fuel assembly being configured to be engaged with the V-shaped inner corner portion;

supporting the fuel assembly in the basket hole by sliding the fuel assembly so that the corner portion of the fuel assembly contacts the V-shaped inner corner portion of the basket hole;

providing a force on other two adjacent side surfaces of the slid fuel assembly in a direction toward the V-shaped inner corner portion of the basket hole, respectively, thereby fixedly supporting the fuel assembly to the V-shaped inner corner portion of the basket hole; and transporting the fuel transport container including the fixedly supported fuel assembly while the fuel transport container is arranged such that a center axis of the fuel transport container is parallel to a horizontal plane.

2. A method according to claim 1, wherein the fuel transport container is transported while one of the two adjacent inner side walls of the basket hole is inclined at a predetermined angle with respect to the horizontal plane, and while the V-shaped inner corner portion of the basket hole is positioned to a lower side of the fuel assembly so that the slid fuel assembly is supported by the V-shaped inner corner portion of the basket hole, and wherein said fixedly supporting step has a step of providing a force on other two adjacent side surfaces of the slid fuel assembly in a direction toward the V-shaped inner corner portion of the basket hole, respectively, thereby fastening the fuel assembly to the V-shaped inner corner portion of the basket hole so as to fixedly support the fuel assembly thereto.

3. A method according to claim 1, wherein the fuel transport container is transported while one of the two adjacent inner side walls of the basket hole is inclined at a predetermined angle with respect to the horizontal plane, while the V-shaped inner corner portion of the basket hole is positioned to a lower side of the fuel assembly so that the slid fuel assembly is supported by the V-shaped inner corner portion of the basket hole and while an outer corner portion of the basket hole is inclined with respect to the horizontal plane in a state that a bottom side of the basket hole is directed upward in a center axis direction of the basket hole.

4. A method according to claim 1, wherein the predetermined angle is set as substantially 45°.

5. A method according to claim 1, wherein the fuel transport container is transported while one of the two adjacent inner side walls of the basket hole is inclined at a predetermined angle with respect to the horizontal plane, and while the V-shaped inner corner portion of the basket hole is positioned at a lower side of the fuel assembly so that the slid fuel assembly is supported by the V-shaped inner corner portion of the basket hole, and wherein said fixedly supporting step has a step of providing a force on other corner portion of the fuel assembly in a direction toward the V-shaped inner corner portion of the basket hole thereby fastening the fuel assembly to the V-shaped inner corner portion of the basket hole so as to fixedly support the fuel assembly thereto, the other corner portion of the fuel assembly being opposite to other V-shaped inner corner portion of the basket hole.

6. A fuel transport container for transporting a fuel assembly, the fuel assembly having four outer side surfaces and substantially rectangular lateral cross-sectional shape, said fuel transport container comprising:

a basket having a basket hole configured to receive the fuel assembly, said basket hole having four inner side walls and a substantially rectangular lateral cross-sectional shape, said four inner side walls of the basket hole having two adjacent inner side walls providing a substantially V-shaped inner corner portion, said V-shaped inner corner portion of said basket hole being configured to be opposite a corner portion defined by two adjacent outer side surfaces of the four outer side surfaces of the fuel assembly, said V-shaped inner corner portion being configured to engage the corner portion of the fuel assembly; and a support device provided in said basket and adapted to support the fuel assembly in said basket hole, said support device being adapted to support the fuel assembly so that the corner portion of the fuel assembly contacts said V-shaped inner corner portion of said basket hole.

7. A fuel transport container according to claim 1, wherein:

said fuel transport container is arranged such that a center axis of said fuel transport container is parallel to a horizontal plane in order to transport said fuel transport container;

one of said two adjacent inner side walls of said basket hole is inclined at a predetermined angle with respect to the horizontal plane;

said V-shaped inner corner portion of said basket hole is positioned at a lower side of the fuel assembly so that said V-shaped inner corner portion of said basket hole is adapted to support the slid fuel assembly; and said fuel transport container further comprises means attached to other two adjacent inner side walls of said basket hole and adapted to hold the other two adjacent side surfaces of the slid fuel assembly toward said V-shaped inner corner portion of said basket hole, respectively, thereby fastening the fuel assembly to said V-shaped inner corner portion of said basket hole so as to fixedly support the fuel assembly thereto.

8. A fuel transport container according to claim 1, further comprising:

means for holding other two side surfaces of the fuel assembly so as to fixedly support the fuel assembly to said basket hole, whereby V-shaped inner corner portion of said basket hole is configured to contact the corner portion of the fuel assembly.

* * * * *